US006600263B1

(12) United States Patent
Ito

(10) Patent No.: US 6,600,263 B1
(45) Date of Patent: Jul. 29, 2003

(54) ELECTRON BEAM APPARATUS AND IMAGE FORMING APPARATUS

(75) Inventor: Nobuhiro Ito, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 09/694,271

(22) Filed: Oct. 24, 2000

(30) Foreign Application Priority Data

Feb. 24, 1999 (JP) ..... 11-046875

(51) Int. Cl.[7] ..... H01J 9/02
(52) U.S. Cl. ..... 313/495; 313/292; 313/512
(58) Field of Search ..... 313/292, 495, 313/336, 496, 422, 366, 512, 309, 310, 311

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | * | 11/1991 | Yoshioka et al. | 313/309 |
| 5,569,794 A | | 10/1996 | Tung | 570/168 |
| 5,614,781 A | * | 3/1997 | Spindt et al. | 313/422 |
| 5,682,085 A | | 10/1997 | Suzuki et al. | 315/169.1 |
| 5,760,538 A | | 6/1998 | Mitsutake et al. | 313/422 |
| 5,828,352 A | * | 10/1998 | Nomura et al. | 345/74 |
| 6,005,540 A | * | 12/1999 | Shinjo et al. | 345/74 |
| 6,274,972 B1 | * | 8/2001 | Mitsutake et al. | 313/292 |

FOREIGN PATENT DOCUMENTS

| | | | |
|---|---|---|---|
| EP | 851 458 A1 | 7/1998 | H01J/29/82 |
| JP | 64-31332 | 2/1989 | |
| JP | 2-257551 | 10/1990 | |
| JP | 3-55738 | 3/1991 | |
| JP | 4-28137 | 1/1992 | |
| JP | 8-180821 | 7/1996 | |
| JP | 10-144203 | 5/1998 | |
| JP | 10-284285 | 10/1998 | H05F/1/02 |
| JP | 10-302684 | 11/1998 | H01J/31/12 |

OTHER PUBLICATIONS

Advances in Electronics and Electron Physics; W.P. Dyke et al.; "Field Emission"; vol. 8, pp. 89–185, 1956.
Thin Solid Films; G. Dittmer; "Electrical Conduction and Electron Emission of Discontinuous Thin Films"; 1972, pp. 317–328.
International Electron Devices Meeting; M. Hartwell et al.; "Strong Electron Emission From Patterned Tin–Indium Oxide Thin Films"; 1975, pp. 519–521.
Radio Engineering and Electronic Physics; M.L. Elinson et al.; "The Emission of Hot Electrons and the Field Emission of Electrons from Tin Oxide"; Jul. 1965, pp. 1290–1296.
Journal of Applied Physics; C.A. Spindt et al.; "Physical Properties of Thin–Film Field Emission Cathodes with Molybdenum Cones"; vol. 47, No. 12, pp. 5248–5263. Dec. 1976.
Journal of Applied Physics; C.A. Mead; "Operation of Tunnel–Emission Devices"; vol. 32, Jan.–Dec. 1961, pp. 646–652.
Technical Digest of IVMC 91, Nagahama 1991; R. Meyer et al.; "Recent Development on 'Microtips' Display at Leti"; pp. 6–9.
Electroforming and electron emission of carbon thin films; H. Araki et al.; 1983 pp. 22–29.

* cited by examiner

*Primary Examiner*—Ashok Patel
(74) *Attorney, Agent, or Firm*—Fitzpatrick, Cella, Harper & Scinto

(57) ABSTRACT

The present invention is concerned with an electron beam apparatus comprising: a hermetic container; an electron source disposed within the hermetic container; and a spacer; wherein the spacer includes at least a region where a layer containing fine particles exists, a sheet resistance measured at the surface of the region of the spacer is $10^7$ Ω/□ or more, and the fine particles are 1000 Å or less in the average diameter of the particles and includes at least metal elements. The electron beam apparatus exhibits the excellent display quality which suppresses the displacement of the light emission point with the charge and the creeping discharge, and the long-period reliability.

10 Claims, 26 Drawing Sheets

(a)

(b)

(c)

$$\frac{\delta\theta}{\delta 0} = \frac{1-\left\{1-\dfrac{m_0\cos\theta}{1+(m1)^{-1}\times(m_0\cos\theta)^{m2}}\right\}\exp(-m_0\cos\theta)}{1-\left\{1-\dfrac{m_0}{1+(m1)^{-1}\times m_0^{\,m2}}\right\}\exp(-m_0)}\times\frac{1}{\cos\theta}$$

$m1 = 0.68273, m2 = 0.86212$

CALCULATION OF δ INCIDENT ANGLE DEPENDENCY COEFFICIENT mO AND INCIDENT ANGLE MULTIPLICATION EFFECT (a)

(b)

ELECTRON BEAM APPARATUS AND IMAGE FORMING APPARATUS

This application is a continuation of International Application No. PCT/JP00/01047, filed Feb. 24, 2000, which claims the benefit of Japanese Patent Application No. 11-046875, filed Feb. 24, 1999.

TECHNICAL FIELD

The present invention relates to an electron beam apparatus and an image forming apparatus, particularly to an electron beam apparatus and an image forming apparatus having a spacer, and more particularly to an electron beam apparatus and an image forming apparatus having an anti-static film.

BACKGROUND ART

Up to now, as the electron emitting elements, there have been known a hot cathode element and a cold cathode element. As the cold cathode element of those elements, there have been known, for example, a surface conduction type electron emission element, a field emission element (hereinafter referred to as "FE type"), a metal/insulating layer/metal type emission element (hereinafter referred to as "MIM type"), etc.

As the surface conduction type electron emission elements, there have been known, for example, an example disclosed in Radio Eng. Electron Phys., 10, 1290 (1965) by M. I. Elinson, or other examples which will be described later.

The surface conduction type electron emission element utilizes a phenomenon in which electron emission occurs by allowing a current to flow into a small-area thin film formed on a substrate in parallel to a film surface. As the surface conduction type electron emission element, there have been reported a surface conduction type electron emission element using an $SnO_2$ thin film by the above-mentioned Elinson, a surface conduction type electron emission element using an Au thin film [G. Dittmer: "Thin Solid Films", 9,317 (1972)], a surface conduction type electron emission element using an $In_2O_3/SnO_2$ thin film [M. Hartwell and C. G. Fonstad: "IEEE Trans. ED Conf.", 519 (1975)], a surface conduction type electron emission element using a carbon thin film ["Vapor Vacuum," Vol. 26, No. 1, p22 (1983), by Hisashi Araki, et al.], etc.

As a typical example of those surface conduction type electron emission elements, a plan view of the above-mentioned element by M. Hartwell is shown in FIG. 27. In FIG. 27, reference numeral 3001 denotes a substrate, and reference numeral 3004 denotes an electrically conductive film that is made of a metal oxide formed through sputtering. The electrically conductive film 3004 is formed in an H-shaped plane as shown in FIG. 27. An energizing process called "energization forming" which will be described later is conducted on the electrically conductive thin film 3004 to form an electron emission portion 3005. In FIG. 27, an interval L is set to 0.5 to 1 [mm], and W is set to 0.1 [mm]. For convenience of showing in the figure, the electron emission portion 3005 is shaped in a rectangle in the center of the electrically conductive thin film 3004. However, this shape is schematic and does not faithfully express the position and the configuration of the actual electron emission portion.

In the above-mentioned surface conduction type electron emission elements including the element proposed by M. Hartwell, et al., the electron emission portion 3005 is generally formed on the electrically conductive film 3004 through the energizing process which is called "energization forming" before the electron emission is conducted. In other words, the energization forming is directed to a process in which a constant d.c. voltage or a d.c. voltage that steps up at a very slow rate such as about 1 V/min is applied to both ends of the electrically conductive film 3004 so that the electrically conductive film 3004 is electrified, to thereby locally destroy, deform or affect the electrically conductive film 3004, thus forming the electron emission portion 3005 which is in an electrically high-resistant state. A crack occurs in a part of the electrically conductive film 3004 which has been locally destroyed, deformed or affected. In the case where an appropriate voltage is applied to the electrically conductive thin film 3004 after the above energization forming, electrons are emitted from a portion close to the crack.

Examples of the FE type have been known from "Field Emission" of Advance in Electron Physics, 8, 89 (1956) by W. P. Dyke and W. W. Dolan, "Physical Properties of Thin-Film Field Emission Cathodes with Molybdenum cones" of J. Appl. Phys., 47,5248 (1976), by C. A. Spindt, etc.

As a typical example of the element structure of the FE element, FIG. 28 shows a cross-sectional view of the elements made by the above-mentioned C. A. Spindt, et al. In this figure, reference numeral 3010 denotes a substrate, 3011 is an emitter wiring made of an electrically conductive material, 3012 is an emitter cone, 3013 is an insulating layer, and 3014 is a gate electrode. The element of this type is so designed as to apply an appropriate voltage between the emitter cone 3012 and the gate electrode 3014 to produce electric field emission from a leading portion of the emitter cone 3012.

Also, as another element structure of the FE type, there is an example in which an emitter and a gate electrode are disposed on a substrate substantially in parallel with the substrate plane without using a laminate structure shown in FIG. 28.

Also, as an example of the MIM type, there has been known, for example, "Operation of Tunnel-Emission Devices," J. Appl. Phys., 32,646 (1961) by C. A. Mead, etc. A typical example of the element structure of the MIM type is shown in FIG. 29. FIG. 29 is a cross-sectional view, and in the figure, reference numeral 3020 denotes a substrate, 3021 is a lower electrode made of metal, 3022 is a thin insulating layer about 100 [Å] in thickness, and 3023 is an upper electrode made of metal about 80 to 300 [Å] in thickness. In the MIM type, an appropriate voltage is applied between the upper electrode 3023 and the lower electrode 3021, to thereby produce electron emission from the surface of the upper electrode 3023.

The above-mentioned cold cathode element does not require a heater for heating because it can obtain electron emission at a low temperature as compared with the hot cathode element. Accordingly, the cold cathode element is simpler in structure than the hot cathode element and can prepare a fine element. Also, in the cold cathode element, even if a large number of elements are disposed on the substrate with a high density, a problem such as heat melting of the substrate is difficult to occur. Further, the cold cathode element is advantageous in that a response speed is high which is different from the heat cathode element which is low in the response speed because it operates due to heating by the heater.

For the above-mentioned reasons, a study for applying the cold cathode elements has been extensively conducted.

For example, the surface conduction type electron emission element has the advantage that a large number of elements can be formed on a large area since it is particularly simple in structure and easy in manufacture among the cold cathode elements. For that reason, a method in which a large number of elements are arranged and driven has been studied as disclosed in Japanese Patent Application Laid-Open No. 64-31332 by the present applicant.

Also, as the application of the surface conduction type electron emission element, for example, an image display device, an image forming apparatus such as an image recording device, a charge beam source, and so on have been studied. In particular, as the application to the image display device, there has been studied an image display device using the combination of the surface conduction type electron emission element with a phosphor that emits light by irradiation of an electron beam as disclosed in for example U.S. Pat. No. 5,066,883 by the present applicant, Japanese Patent Application Laid-Open No. 2-257551, and Japanese Patent Application Laid-Open No. 4-28137. In the image display device using the combination of the surface conduction type electron emission element with the phosphor, the characteristic superior to the conventional other image display devices is expected. For example, even as compared with the liquid crystal display device which has been spread in recent years, the above image display device is excellent in that no back light is required because it is of the self light emitting type and the angle of visibility is broad.

Also, a method in which a large number of FE type elements are disposed and driven is disclosed in, for example, U.S. Pat. No. 4,904,895 by the present applicant. Also, as an example of applying the FE type to the image display device, there has been known, for example, a plate type image display device reported by R. Meyer [R. Meyer: "Recent Development on Micro-Tips Display at LETI", Tech. Digest of 4th Int. Vacuum Microelectronics Conf., Nagahama, pp. 6 to 9 (1991)].

Also, an example in which a large number of MIM type elements are arranged and applied to an image display device is disclosed in, for example, Japanese Patent Application Laid-Open No. 3-55738 by the present applicant.

Among the image forming apparatuses using the above-mentioned electron emission element, attention has been paid to the flat type image display device thin in depthwise as a replacement of the CRT type image display device since the space is saved and the weight is light.

FIG. 30 is a perspective view showing an example of a display panel portion which forms a plane-type image display device, in which a part of the panel is cut off in order to show the internal structure.

In FIG. 30, reference numeral 3115 denotes a rear plate, 3116 a side wall, 3117 a face plate, and the rear plate 3115, the side wall 3116 and the face plate 3117 form an envelope (hermetic container) for maintaining the interior of the display panel in a vacuum state. The rear plate 3115 is fixed with a substrate 3111, and N×M cold cathode elements 3112 are formed on the substrate 3111 (N and M are positive integers of equal to or larger than 2 or more and appropriately set in accordance with the target number of display pixels). Also, the N×M cold cathode elements 3112 are wired by M row wirings 3113 and N column wirings 3114 as shown in FIG. 30. A portion made up of the substrate 3111, the cold cathode elements 3112, the row wirings 3113 and the column wirings 3114 is called "multiple electron beam source". Also, at least in portions where the row wirings 3113 and the column wirings 3114 cross each other, an insulating layer (not shown) between both of the wirings is formed to keep electric insulation.

A lower surface of the face plate 3117 is formed with a fluorescent film 3118 formed of a phosphor on which phosphors (not shown) of three primary colors consisting of red (R), green (G) and blue (B) are separately painted. Also, black material (not shown) are disposed between the respective color phosphors which form the fluorescent film 3118, and a metal back 3119 made of Al or the like is formed on a surface of the fluorescent film 3118 on the rear plate 3115 side.

Dx1 to Dxm and Dy1 to Dyn and Hv are electric connection terminals with a hermetic structure provided for electrically connecting the display panel to an electric circuit not shown. Dx1 to Dxm are electrically connected to the row wirings 3113 of the multiple electron beam source, Dy1 to Dyn are electrically connected to the column wirings 3114 of the multiple electron beam source, and Hv is electrically connected to the metal back 3119, respectively.

Also, the interior of the above hermetic container is maintained in a vacuum state of about $10^{-6}$ Torr, and there is required means for preventing the deformation or destruction of the rear plate 3115 and the face plate 3117 due to a pressure difference between the interior of the hermetic container and the external, as a display area of the image display device increases. In a method of thickening the rear plate 3115 and the face plate 3117, not only does the weight of the image display device increase, but also a distortion of an image or a parallax occurs when viewing the display device from an oblique direction. On the contrary, in FIG. 30, there is provided a structure support (called "spacer" or "rib") 3120 which is formed of a relatively thin glass substrate for supporting the atmospheric pressure. With this structure, a space of normally sub mm to several mm is kept between the substrate 3111 on which the multiple beam electron source is formed and the face plate 3117 on which the fluorescent film 3118 is formed, and the interior of the hermetic container is maintained in a high vacuum state as described above.

In the image display device using the display panel as described above, when a voltage is applied to the respective cold cathode elements 3112 through the container external terminals Dx1 to Dxm and Dy1 to Dyn, electrons are emitted from the respective cold elements 3112. At the same time, with the application of a high voltage of several hundreds [V] to several [kV] to the metal back 3119 through the container external terminal Hv, the above emitted electrons are accelerated and allowed to collide with an inner surface of the face plate 3117. As a result, the phosphors of the respective colors which form the fluorescent film 3118 are excited and emit light, thus displaying an image.

DISCLOSURE OF THE INVENTION

An object of the present invention is to realize a preferred electron beam apparatus.

That is, an electron beam apparatus according to one aspect of the present invention is structured as follows:

An electron beam apparatus comprising a hermetic container, an electron source disposed within the above hermetic container, and a spacer; wherein the above spacer includes at least a region where a layer containing fine particles exist, a sheet resistance measured at the surface of the above region of the above spacer is $10^7$ Ω/□ or more, the above fine particles are sized equal to or lower than 1000 Å in the average diameter of the particles, and includes at least metal elements.

The spacer may maintain the configuration of the hermetic container. For example, the spacer may serve as a part of the hermetic container as with a frame. Also, the present invention is more preferably applicable to a structure having the spacer disposed in the hermetic space within the hermetic container.

In particular, the present invention is particularly effective to a case in which the hermetic container includes plate-shaped members that face each other, the height of the spacer that maintains an interval between the members that face each other is equal to or less than 1/50 or less of the main length (diagonal length of the hermetic space in the case where the hermetic space is square) in a direction orthogonal to a heightwise direction of the above spacer in the hermetic space formed between the members that face each other, more particularly in a case where the height of the spacer is equal to or less than 1/100 or less.

If the average particle diameter is set equal to or less than 1000 Å, the deviation of the fine particles, or the deviation of the secondary particles due to the coagulated fine particles may be suppressed. Also, the electric characteristic of the layer including the fine particles is stabilized. In particular, in the case of using a binder, the degree of dispersion of the fine particles within the binder is readily controlled. If the fine particles include metal elements, the electric conductivity (resistance) can be stabilized. The metal elements may be made into a compound with other elements and may preferably form metal oxide or metal nitride. The average particle diameter may be set equal to or less than 200 Å, or more preferably equal to or less than 100 Å.

It is desirable that the sheet resistance measured at the surface of the above region of the spacer is $10^{14}$ Ω/□ or less.

In the above invention, the layer including the above fine particles may be disposed on a base substance that constitutes the above spacer. It is not necessary to expose the layer including the fine particles from the surface of the spacer, and another layer may be further disposed on the layer including the fine particles. In this case, the sheet resistance includes contributions of the resistance of the layer including the fine particles and the resistance of another layer. The use of the base substance of the spacer facilitates the manufacture and also facilitates the control of the electric conductivity (resistance). It is preferable that the base substance of the spacer is made of insulating material. Further, it is unnecessary that the region that satisfies the above conditions of the present invention exists on the entire surface of the spacer.

Also, in the above respective present inventions, the layer including the fine particles according to the respective present inventions may be variously structured in such a case that the layer including the above fine particles is made up of the fine particles and gaps which are disposed between the fine particles and filled with other solid such as binders, or in such a case that the layer including the above fine particles is made up of the fine particles and gaps which are disposed between the fine particles and not filled with the solid. The volume percentage of the fine particles in the layer may be equal to or less than 30%.

Also, in the above respective present inventions, it is preferable that the layer including the above fine particles includes the above fine particles and the binder. The binder preferably includes inorganic compound.

Further, in the above respective present inventions, it is preferable that the average particle diameter of the above fine particles is set equal to or less than 0.1 times of the thickness of the layer including the above fine particles. The average particle diameter may be more preferably set equal to or less than 0.05 times, and most preferably set equal to or less than 0.02 times.

Still further, in the above respective present inventions, it is preferable that the above fine particles include metal oxide or metal nitride, and also it is preferable that the above fine particles include elements of group IIIB or group VB, and also it is preferable that the above fine particles include Sb or P.

Still further, in the above respective present inventions, it is more preferable that the layer including the above fine particles has a rough surface as shown in the embodiments later. In the case where another layer is disposed on the layer including the fine particles, it is preferable that the other layer has a rough surface. It is preferable that the surface roughness of the spacer surface in the region where the layer including the fine particles exists according to the respective present inventions is larger than 100 Å.

Also, an electron beam apparatus according to the present invention is as follows:

An electron beam apparatus comprising a hermetic container, an electron source disposed within the above hermetic container, and a spacer; wherein the above spacer includes at least a region where a layer containing fine particles exist, a sheet resistance measured at the surface of the above region of the above spacer is $10^7$ Ω/□ or more, and the above fine particles are sized equal to or less than 200 Å in the average diameter of the particles and are fine particles having electric conductivity.

Further, an electron beam apparatus according to the present invention in this application is as follows:

An electron beam apparatus comprising a hermetic container, an electron source disposed within the above hermetic container, and an antistatic film disposed within the above hermetic container; wherein the above hermetic preventing film includes at least a layer including fine particles, a sheet resistance measured at the surface of the above antistatic film is $10^7$ Ω/□ or more, and the above fine particles are sized equal to or less than 1000 Å in the average diameter of the particles and include fine particles containing at least metal elements.

Still further, an electron beam apparatus according to the present invention in this application is as follows:

An electron beam apparatus comprising a hermetic container, an electron source disposed within the above hermetic container, and an antistatic film disposed within the above hermetic container; wherein the above antistatic film includes at least a layer containing fine particles, a sheet resistance measured at the surface of the above antistatic film is $10^7$ Ω/□ or more, and the above fine particles are sized equal to or less than 200 Å in the average diameter of the particles and include electrically conductive fine particles.

Further, in this application, the present invention includes an image forming apparatus comprising the above-mentioned respective electron beam apparatuses and an image forming member that forms an image by irradiation of electrons from an electron source provided in the above electron beam apparatus. The image forming member may be made up of, for example, a phosphor.

BRIEF DESCRIPTION OF THE DRAWINGS

FIG. 1(*b*) is a cross-sectional view showing a spacer taken along a section B–B', which is exemplified in FIG. 1(*a*) in accordance with the present invention; and FIG. 1(*c*) is a cross-sectional view showing the spacer taken along a section C–C', which is exemplified in FIG. 1(*a*) in accordance with the present invention.

FIG. 20(*b*) is a graph showing a change of emitted current Ie.

DESCRIPTION OF REFERENCES

Figure 1:
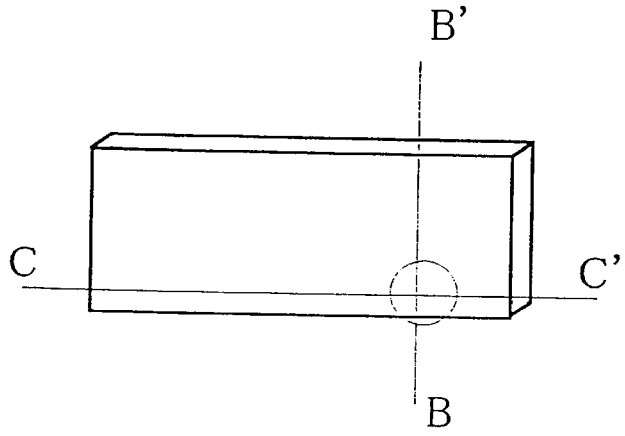
FIG. 1(*a*) is a perspective view showing a spacer substrate in accordance with an embodiment of the present invention.
Figure 1:
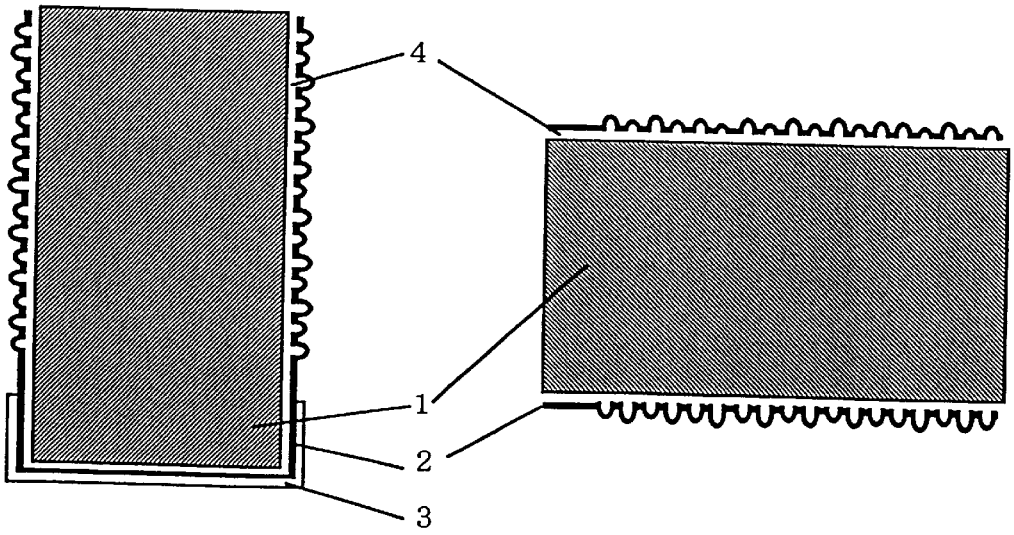

Reference numeral 1 denotes a spacer substrate; 2, a high resistive film; 3 and 21, low resistive films; 5, a side portion; 11, an antistatic film; 1011, a substrate; 1102 and 1103, element electrodes; 1104, an electrically conductive thin film; 1105, an electron emission portion formed through an energization forming process; 1113, a film formed through an energization activating process; 1015, a rear plate; 1016, a side wall; 1017, a face plate (FP); and 1020, a spacer.

BEST EMBODIMENT MODES FOR CARRYING OUT THE INVENTION

Hereinafter, a description will be given of the embodiments of the present invention. The following embodiments will be described with reference to an example in which a layer including fine particles is provided in a spacer of an electronic beam device.

Figure 30:
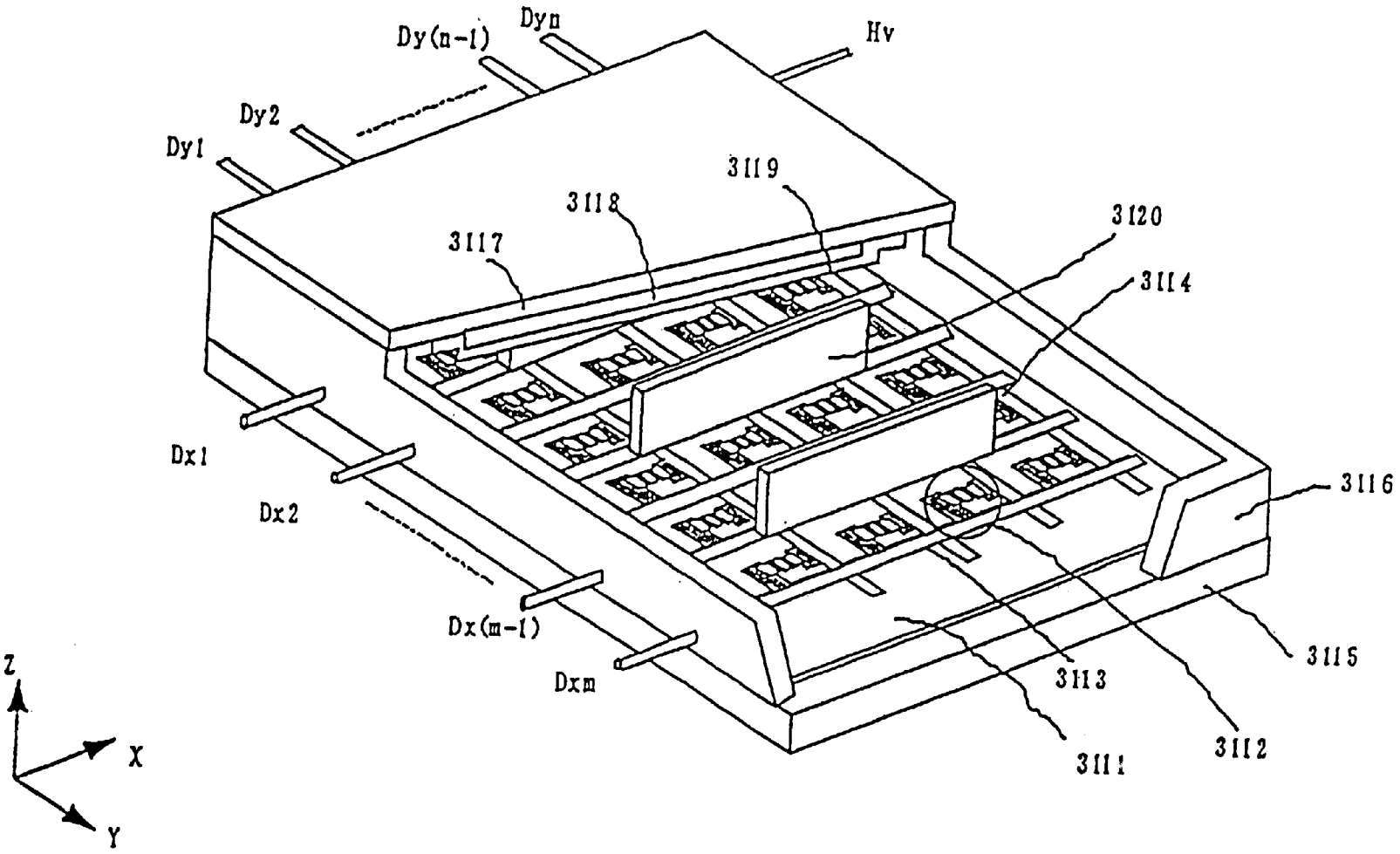
FIG. 30 is a perspective view showing a conventional plane type image display device in which a part of a display panel is cut off.

First, more specific problems will be described. For example, if a structure shown in FIG. 30 is exemplified, the following problems occur.

First, when a part of electrons emitted from a portion in the vicinity of a spacer 3120 is hit against the spacer 3120 or when ions ionized by the action of emitted electrons are stuck onto the spacer, there is the possibility that the spacer is electrically charged. The loci of the electrons emitted from cold cathode elements 3112 are bent due to the charged spacer, the electrons reach a location different from a regular position on a phosphor, and an image in the vicinity of the spacer is strained and displayed.

Second, because a high voltage of several hundreds V or more (that is, a high electric field of 1 kV/mm or more) is applied between the multiple beam electron source and the face plate 3117 in order to accelerate the emitted electrons from the cold cathode elements 3112, there is a fear that a creeping discharge occurs along the surface of the spacer 3120 between the multiple electron source and the face plate 3117. In particular, in the case where the spacer is charged as described above, there is the possibility that discharge is induced.

There has been proposed in U.S. Pat. No. 5,760,538 that a fine current is permitted to flow in the spacer to remove charge. In the proposal, a high-resistive thin film is formed on a surface of the insulating spacer as an antistatic film, to thereby allow a fine current to flow on the surface of the spacer. The antistatic film used in this example is formed of a tin oxide film, a mixed crystal thin film of tin oxide and indium oxide, or a metal film.

Also, it has been found that it is insufficient to reduce the strain of the image by only a method of removing the charge by the high-resistive film. It is presumed that the above problem is caused by a factor in which electric junction between the spacer with the high resistive film and the upper and lower substrates, that is, the face plate (hereinafter referred to as "FP") and the rear plate (hereinafter referred to as "RP") is insufficient, and charges are concentrated in the vicinity of the joint portion. In order to solve the above problem, Japanese Patent Application Laid-Open No. 8-180821 and Japanese Patent Application Laid-Open No. 10-144203 have proposed a method in which an end surface of the spacer on the FP side and an end surface of the spacer on the RP side are coated with a material lower in resistivity than metal or the high resistive film in a range of about 100 to 1000 micron, to thereby ensure the electric contact with the upper and lower substrates and suppress the charges by reflected electrons (radiation electrons) from the face plate.

Even by the means for giving the high resistive film, the control of the loci of the emitted electrons and the formation of a low resistive film portion for the purpose of achieving an electric contact as described later, the suppression of the charges on the spacer is insufficient depending on other design parameters of the electron beam apparatus such as the raw material, the thickness and the configuration of the face plate or an anode accelerating voltage, resulting in such problems that a light emission point is displaced and fine discharge partially occurs in the vicinity of the spacer.

Although the above causes for the charges do not become apparent in detail, it is presumed that the following backgrounds are the factors.

It is presumed that there exists a factor that effectively increases the capacitance and the resistance of the spacer which will be described later, and that the spacer is exposed to the reflected electrons from the cold cathode elements 3112 other than the cold cathode element nearest to the spacer during a non-selection period of the cold cathode element 3112 close to the spacer or abnormal electric field emission from an electric field concentrated region in the vicinity of a junction with the cathode, become factors for the charge of the spacer. Also, it is presumed that the secondary electron emission coefficient of the spacer surface is not controlled by design which will be described later becomes a factor for the charge of the spacer.

Under the above circumstances, the present inventors have studied several factors, separately, as will be described below.

[Background 1] Limit of the high resistive film on the spacer surface by a relaxation time constant:

The progress of a charge phenomenon in an arbitrary region on the spacer surface can be regarded as a change of the charge potential to an inrush current with time, by generally applying a charge model of a dielectric.

Figure 4:
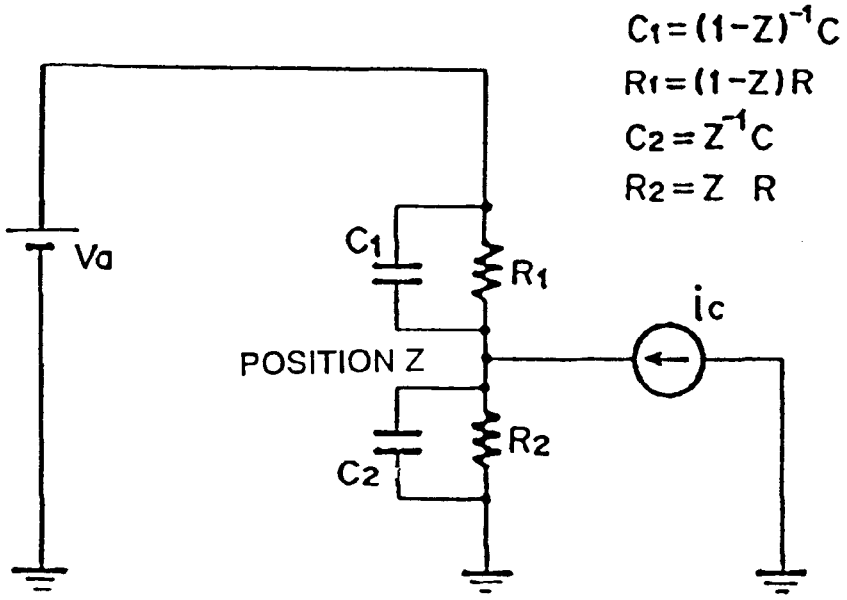
FIG. 4 is a diagram showing a basic calculation model of a charge potential taking the secondary electron emission effect into consideration.
Figure 5:
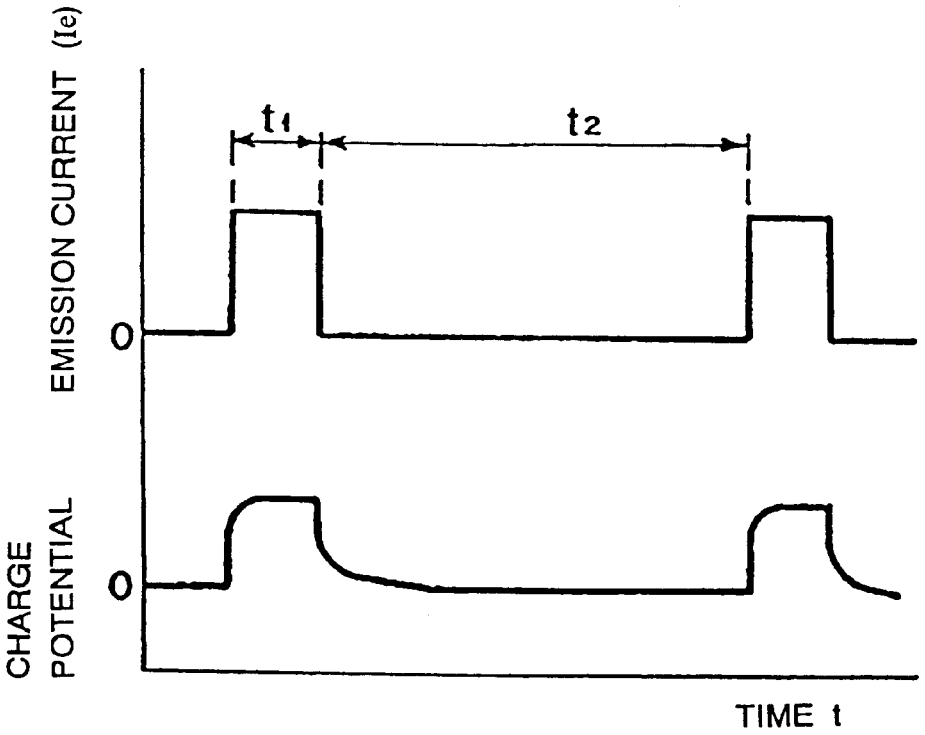
FIG. 5 is an explanatory diagram showing an example of driving time for explanation of a charge storing effect.

FIG. 4 is a diagram for explaining the relaxing model by a capacitive resistant component when the upper and lower electrodes are viewed from an inrush region in a state where an effective inrush current ic is supplied to an arbitrary position z on the spacer surface from a current source. In the figure, Va means a voltage which is applied to an anode from a voltage source, ic is an effective inrush current which is supplied to a position of a height zh (h corresponds to the height of the spacer $0<z<1$) and corresponds to a difference between a secondary electron current and a primary electron current. C1 and R1 mean a capacitance value and a resistance value which regulate a relax time constant between the inrush region and the anode, respectively, and C2 and R2 mean a capacitance value and a resistance value which regulate a relax time constant between the inrush region and the cathode, respectively. In this example, when the resistance and the capacitance are uniformly distributed in the heightwise direction, C1, C2, R1 and R2 are represented by $C/(1-z)$, $R(1-z)$, $C/z$, and $Rz$ by using the resistor R and the capacitor C of the spacer, respectively.

Since the superposition principle is completed with respect to the inrush current of an arbitrary position, a high voltage Va is applied between the anode and the cathode by the voltage source as shown in FIG. 4, and the electron current incident to a subject region position z from a vacuum side is treated as the effective inrush current Ic which is a value of the difference between an outgoing current and an incoming current, and then formulated by an equivalent circuit that supplies the effective inrush current Ic as a current source, and the potential of a region having an arbitrary height on the spacer can be regulated without losing the generality taking the charge process into consideration.

Hereinafter, in order to devise a preferred structure as the structure of the spacer, specifically, in the electron beam emission device according to the present invention, a process of relaxing the charge potential on a spacer having a preferable insulating or high-resistive film is formulated. For simplification, it is assumed that the distribution of the electric constant on the spacer surface is uniform. First, if the effective charge speed onto the spacer surface is treated as a current amount which is supplied from the current source and then formulated taking the energy distribution incident angle distribution of the incident electron into consideration:

The emitted electron current amount from the electron emission element is Ie;

an incident electron amount rate at the height zh ($0<z<1$) is $\beta_{ij}$;

a secondary electron emission coefficient at the height zh ($0<z<1$) is $\delta_{ij}$;

where subscripts i and j correspond to an incident energy and an incident angle, respectively;

a primary electron current amount Ip at the position z is $Ip=\Sigma\Sigma Ip_{ij}=\Sigma\Sigma\beta_{ij}\times Ie$;

a secondary electron current amount Is at the position z is $Is=\Sigma\Sigma\delta_{ij}\times Ip_{ij}=\Sigma\Sigma\delta_{ij}\times\beta_{ij}\times Ie$; and The charge inrush speed Ic at the position z is $Ic=\Sigma\Sigma(\delta_{ij}-1)\times Ip_{ij}=\Sigma\Sigma(\delta_{ij}-1)\times\beta_{ij}\times Ie$.

Finally, the inrush charge speed Ic can be represented by:

$$Ic=P\times It \qquad \text{general expression (2)}$$

where P is represented by $P=\Sigma\Sigma(\delta_{ij}-1)\times\beta_{ij}$, and Ie is an independent coefficient, and it is presumed that those values are in fact changed as the charge is progressed.

Subsequently, for simplification, it is assumed that in the arrangement of the capacitors and the resistors of the spacer film when viewed from the inrush region, the distribution of the resistors and the capacitors does not exist in the height-wise direction of the spacer (which coincides with the high-voltage applying direction between the anode and the cathode). In this case, assuming that the resistor and the capacitor in the facial direction of the spacer when viewed from the anode and the cathode are R and C, the height of the spacer is h, and the height of the inrush region is zh ($0\leqq z\leqq 1$, anode side z=1), the electric constant existing above and below the inrush region is regulated in correspondence with the position z. In addition, since a voltage is applied between the anode and the cathode from the voltage source, the effective impedance Z is regarded as 0. Accordingly, it is understood that the inrush charged charges relax through a parallel resistor and a parallel capacitor respectively of the resistors and the capacitors situated above and below the inrush region. The resistor between the inrush region at the position z and the GND is z(1−z)R, the capacitor is C/z+C/(1−z), and a response time constant τ of a relax path coincides with an original spacer resistant capacitance product which is CR.

In this situation, the potential at an arbitrary location is represented as a time function from an integral obtained from a differential equation of a current in a totally closed circuit in the above-mentioned equivalent circuit shown in FIG. 4.

Under the continuous drive condition of the electron emission element, assuming that the electron emission start time is t=0, ΔV(t) representing the progressing process of the charge potential in the inrush region is finally represented by:

$$\Delta V(t)=z(1-z)*R*ic*(1-\exp(-t/\tau)) \qquad \text{general expression (3)}$$

From the above expression, it is understood that ΔV(t) depends on a product of the resistance R and the effective inrush current Ic.

Considering the charge progress with time when the axis of abscissa is the time and the axis of ordinate is the emission current amount from the electron emission element and the charge potential electron emission time on the spacer, and driving is repeated every t1 sec and t2 sec as a dead time (that is, a selection time and a non-selection time), the charge potential ΔV at the time of completing an initial period (t1+t2 sec) of the inrush region is represented through the general expression (3) as follows:

$$\Delta V(t)=z(1-z)*R*ic*(1-\exp(-t\mathbf{1}/\tau)*\exp(-t\mathbf{2}/\tau) \qquad \text{general expression (4)}$$

From this expression, it is expected that the charges are stored every time the element close to the spacer is driven except for the condition of t2>>τ or t1<<τ. The above description is given of the process for relaxing the charge of the spacer.

On the other hand, as the display element, there arises a problem that a beam position changes depending on the emitted electron amount during a selection period t1 (Duty dependency). Since the Duty dependency of the light emission position can be regarded as a change of ΔV represented by the general expression (3) to the emitted electron amount (a product of Ie and the pulse width), both sides of the general expression (3) are differentiated by the emitted electron amount (a product of Ie and the pulse width).

$$d\Delta V(t)/d(Ie\times t\mathbf{1})=z(1-z)*R*\{P*(1-\exp(-t\mathbf{1}/\tau)/t\mathbf{1}+P*\exp(-t\mathbf{1}/\tau)/\tau\}=z(1-z)*/C*P/t\mathbf{1}*\{\tau+(t-\tau)*\exp(-t\mathbf{1}/\tau)\} \qquad \text{general expression (5)}$$

The above expression is simplified by the drive condition or the material constant, and in the case where the material is an insulating material or in the case where a selection time is very short, CR=τ<<t1 is accomplished, and the following expression is obtained.

$$d\Delta V(t)/d(Ie\times t\mathbf{1})=z(1-z)*P/C \qquad \text{general expression (6)}$$

In a case where the material is an insulating material or in the case where a selection time is very long, CR=τ>>t1 is accomplished, and the following expression is obtained.

$$d\Delta V(t)/d(Ie\times t\mathbf{1})=z(1-z)*P*R/t\mathbf{1} \qquad \text{general expression (7)}$$

A description will be given of a parameter that regulates the Duty dependency of the light emission position, that is, a graduation dependency during a selection period on the basis of the above formulation.

It is preferable that the spacer has the insulating property or the high resistant property to some degree in the surface direction in the condition that the accelerating voltage between the anodes and the cathodes are maintained. For that reason, in the case where the Duty dependency of the charge potential at an arbitrary position is usually considered, it is preferable to apply the general expression (5) or (6). Accordingly, in order to suppress the Duty dependency, it is required to increase a dielectric constant of the spacer material or to increase a sectional area. However, the controllable range of the material of the dielectric constant is extremely narrow as compared with the specific resistance, and the effective size of the film thickness cannot be ensured for the reason caused by the process. Therefore, it is necessary to suppress the parameter P.

In addition, from the viewpoint of enhancing the effect of the charge relaxation during the dead period, the charges are caused to be stored if the charges are implemented into the spacer in a cycle period shorter than the time constant regulated by the resistance and the capacitance as described in the above-mentioned general expression (4). Even if such a material that the relaxation time constant of the high resistive film on the spacer surface is smaller than the line non-selection period t2 seconds (≅selection period×the number of scanning lines) of the electron emission element is applied, the cumulative charges may be formed.

The present inventors have further studied the following matters.

[Background 2] In general, the secondary electron emission coefficient is large in the incident angle dependency of incident electrons, and secondary electron emission coefficient δ is exponential-functionally multiplied by making the incident angle larger.

Figure 2:
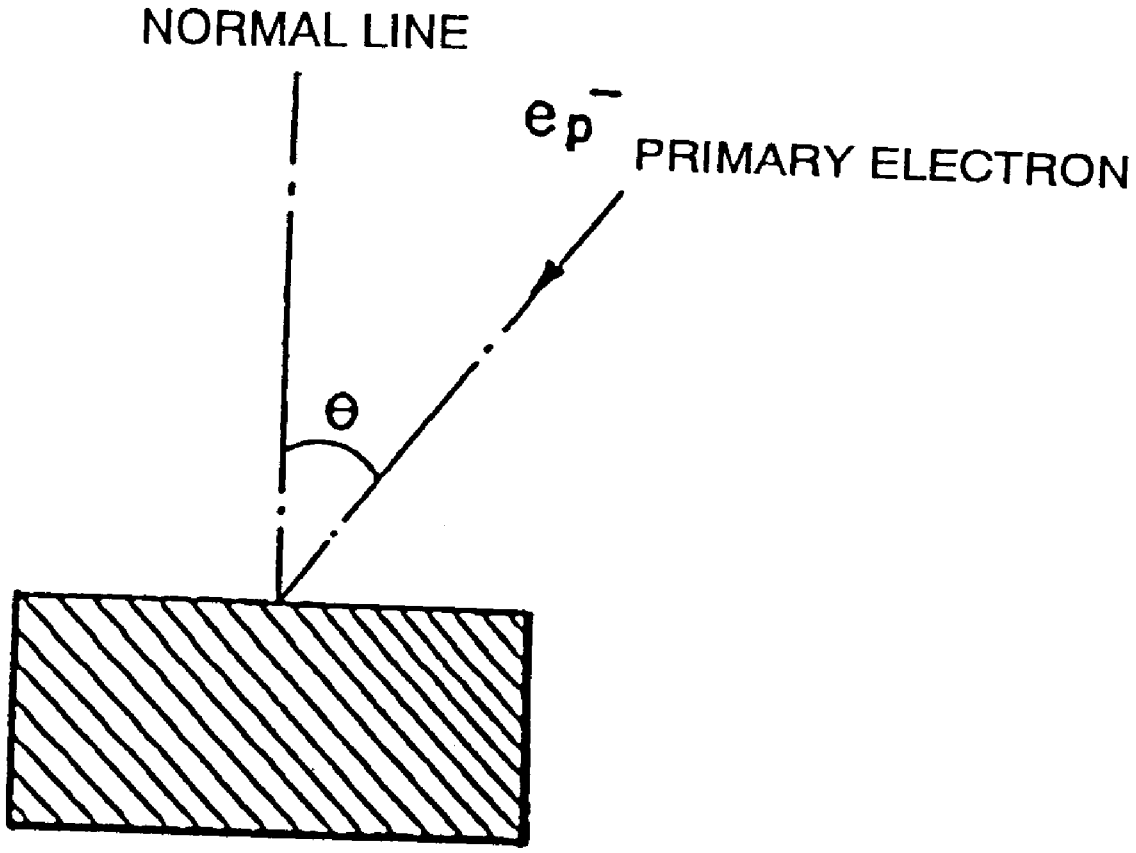
FIG. 2 is an explanatory diagram showing the positional relationship between a primary electron incident angle and a secondary electron emission.

In general, as shown in FIG. 2, assuming that the incident angle θ (degree) is (−90<θ<90), the incident energy is Ep [keV], the penetration distance of the incident electrons into the film is d [Å], the absorption coefficient of the secondary electrons is α [1/Å], the average energy of the primary electrons necessary for production of the secondary electrons into the film is ξ [eV], and the escape probability of the secondary electrons into vacuum from the surface is B, the secondary electron emission coefficient in the case where the primary electrons are made incident to a smooth surface is quantitatively represented by the following general expression (0) with parameters A and n that represent an energy loss process in the film of the primary electrons.

$$\delta = \frac{B}{4\xi}\left(\frac{An}{\alpha'}\right)^{\frac{1}{n}} (\alpha' d_p)^{\frac{1}{n}-1}\left[-\left\{1+\left(\frac{1}{\gamma}-1\right)\alpha' d_p\right\}\exp(-\alpha' d_p)\right] \quad \text{general expression (0)}$$

where $\alpha'=\alpha \cos\theta$ $\gamma=1+m1\times(\alpha' dp)^{-m2}$, m1=0.68273, m2=0.86212 and $dp=E_p^n/An$.

Figure 10:
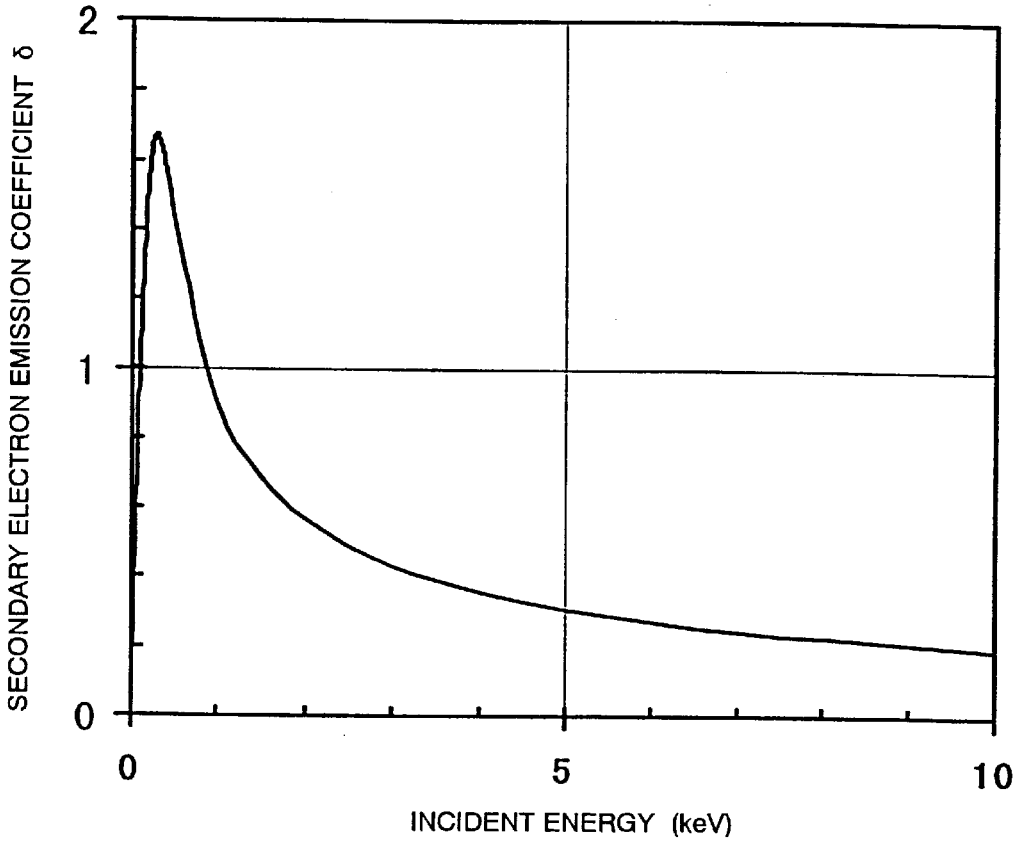
FIG. 10 is an explanatory diagram showing the incident energy dependency characteristic of the secondary electron emission coefficient.

The incident energy dependency characteristic of the secondary electron emission coefficient represented by the above general expression (0) generally exhibits the mountain-type characteristic having a peak on the low energy side as shown in FIG. 10, and in many cases, a peak value of the secondary electron emission coefficient δ exceeds 1, and two incident energies that satisfy δ=1 are provided. In the incident energy between those two cross point energies, the secondary electron emission coefficient becomes positive, which means the generation of positive charges. The smaller one of those two cross point energies is called "first cross point energy E1", and the larger one of those two cross point energies is called "second cross point energy E2".

In this case, in the general expression (0), the incident angle dependency degree of the secondary electron emission coefficient which is regulated by the vertical incident angle, that is θ=0, becomes an index that evaluates the secondary electron emission multiplication effect due to the oblique incident angle.

This is represented by the following general expression (1).

$$\frac{\delta_\theta}{\delta_0} = \frac{1-\left\{1-\frac{m_0\cos\theta}{1+(m1)^{-1}\times(m_0\cos\theta)^{m2}}\right\}\exp(-m_0\cos\theta)}{1-\left\{1-\frac{m_0}{1+(m1)^{-1}\times m_0^{m2}}\right\}\exp(-m_0)}\times\frac{1}{\cos\theta} \quad \text{general expression (1)}$$

However, in the general expression, the parameters m1 and m2 are constants having values of m1=0.68273 and m2=0.86212, respectively. But, reference $m_o$ coincides with αd which is a product of the absorption coefficient α of the secondary electrons and the penetration distance d of the primary electrons, which is a function of the incident energy, and may be a positive real number. The reference $m_0$ is called "the incident angle multiplication coefficient of the secondary electron emission coefficient" from its property.

Figure 3:
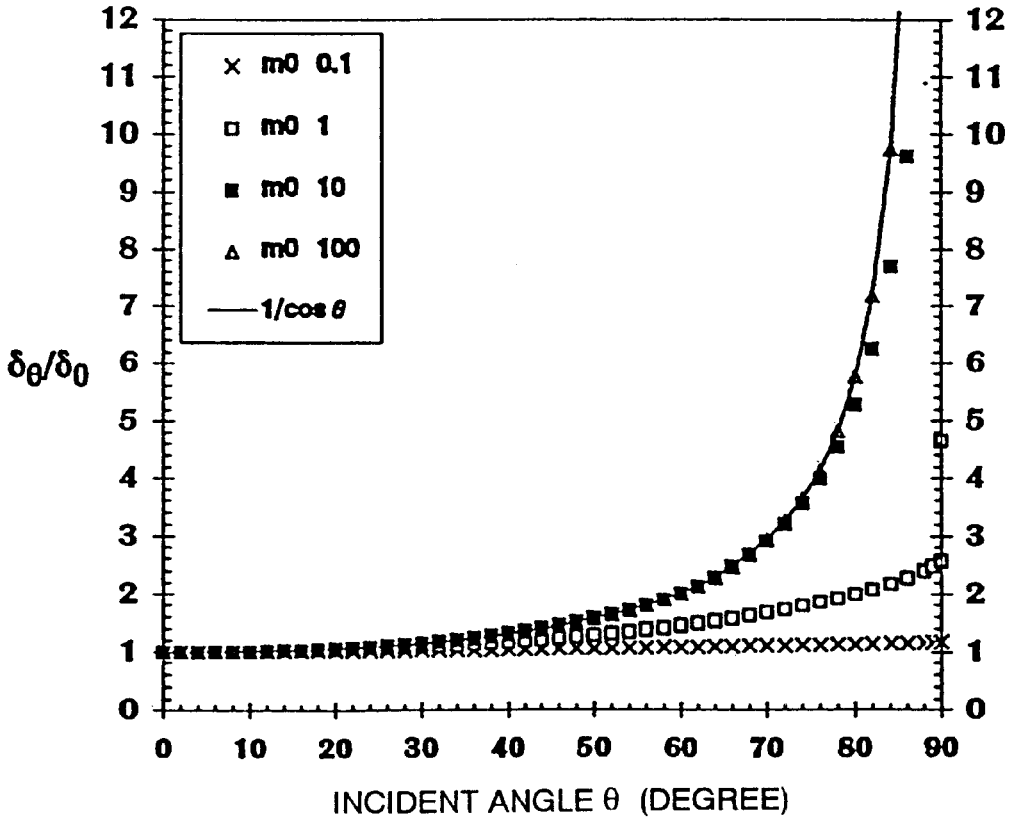
FIG. 3 is an explanatory diagram showing the incident angle θ dependency characteristic of the secondary electron emission coefficient.

The above general expression (1) exhibits a monotonic increase tendency to the incident angle |θ| under an arbitrary incident energy condition which rapidly increases in the vicinity of an incident condition of 90°. The high incident angle multiplication effect of the secondary electron emission coefficient is shown in FIG. 3. This is because the distribution of a portion of the film where the secondary electrons are produced is moved to a shallow portion close to the film surface due to oblique incident angle, to thereby increase the rate of the secondary electrons which are emitted to vacuum without disappearing due to the recombination. This can be apparently regarded as the reduction of absorption coefficient α of the secondary electrons to α cos θ. In a smooth film formed on a smooth surface as an actual spacer material, for example, under the condition where the incident energy which is larger than an energy having the positive secondary electron emission coefficient, that is, the first cross point energy, and smaller than the second cross point energy is 1 keV, many antistatic films have the incident angle multiplication coefficient $m_0$ of the secondary electron emission coefficient as more than 10, and the positive charge due to an increase in the incident angle is enlarged, resulting in a large factor of the positive charge of the spacer material.

[Background 3] The incident angle distribution to the spacer is large, and the incident electrons large in incident angle is dominant.

Although the incident paths of the electrons onto the spacer surface variously exist, those incident paths are roughly represented by three paths. The first path is a direct incident path of the emission electrons from the electron emission elements, and the incident angle takes an incident mode of the high incident angle such as about 80 to 86° and the high incident energy although depending on the degree of the distortion of the magnetic field in the vicinity of the spacer and the design value of other devices. Also, because a distance between the spacer and the emission electron device in the vicinity of the spacer is short, there is a feature that the amount of incident electrons becomes very large. The second path is an indirect incident path of the reflected electrons reflected from the face plate to the circumference, the incident angle distributes from 0 to the high incident angle, and the incident energy also distributes but is smaller than the incident energy of the first path. The third path is a re-incident path of the first and second incident electrons or the electrons electric-field-emitted from the electric field concentric point in the vicinity of a contact point of the spacer and the cathode onto the spacer surface. The third path is considered to occur because the electrons are liable to be made re-incident to a region which is locally positively charged, although there are the configuration of the spacer surface and the distribution of the charge potential. The third path also has the distribution of the incident angle, and a high electric field of about several to several tens kV/cm is normally applied along a creeping direction as an accelerating voltage. Therefore, the incident angle is modulated from the vertical incident angle and becomes a high incident angle. Accordingly, the incident electrons through any paths have the incident angle distributions, and the effective charge penetration is conducted by the positive charges formed in the interior of the solid due to the incident electrons of the high incident angle. The path which is dominant by the positive charge which is the problem among the above incident modes, is normally the direct incident electrons of the first path. However, the direct incident electrons of the first path depend on the drive state or the design of the electron emission element and may suffer from problems such as the radiation electrons from the face plate or the re-incident multiple scattering electrons which will be described in the following item.

[Background 4] The multiple scattering electrons on the surface.

The secondary electrons emitted from the spacer surface once have a relatively small initial energy of about 50 eV at the largest. Although those electrons receive the energy from the electric field between the anode and the cathode in a space, because there frequently occurs a state in which the spacer is positively charged in addition to the electrons that reach the anode, there exist many electrons that reenter in the positive charge region on the spacer. Those phenomenons lead to problems because the positive charges are accumulatively stored on the spacer while the incidence and the emission are alternately repeated with the relatively low incident energy and at a high incident angle. Accordingly, it is desirable to suppress the above multiple electron emission.

The following embodiment shows an example that realizes a preferable spacer using a layer containing fine particles. In particular, there is exemplified an embodiment in which not only electrically conductive fine particles with a preferred average particle diameter are used and a layer containing the fine particles is made of the fine particles containing metal elements, but also the above-mentioned backgrounds are taken into consideration.

<Suppress Effect of the Incident Angle Dependency of the Secondary Electron Emission Coefficient Due to a Fine Particle Dispersion Type Rough Surface Layer>

As a result of studying how to reduce the incident angle multiplication coefficient $m_0$ of the secondary electron emission coefficient and also to reduce the secondary electron emission coefficient $\delta_o$ of the vertical incidence, it has been found further preferably if the following conditions are more preferably satisfied. That is, in order to relax the incident angle dependency, two manners are roughly proposed.

There are proposed a manner of relaxing the uniformity of the incident angle per se, or a method of reducing the surface effect, that is, the ratio $d/\lambda$ of the penetration depth of the primary electrons to the secondary electrons as the characteristic of the material side.

(1) Dispersion of the Incident Angle of the Primary Electrons

The distribution is provided in a normal direction of an interface which is regarded as the surface as a result of which the incident angle is not limited to an angle regulated by the external portion, and the incident angle locally defined has the distribution with respect to an angle defined macroscopically, to thereby relax the incident angle dependency. Because the dependency of the incident angle exhibits the characteristic of rapidly increasing in the vicinity of the incident angle of 90°, the effect of dispersing the incident angle and relaxing it is large.

(2) A Reduction of the Ratio of the Penetration Depth of the Primary Electrons to the Secondary Electrons Since the penetration depth of the electrons in a solid is proportional to an inverse number of the electron density $\rho Zeff/Aeff$ (in this example, $\rho$ is the density of the solid, Zeff is the substantial atomic No. (or equivalent atomic No.), and Aeff is the substantial atomic weight [g/ml] (or the equivalent atomic weight), and in a case of material made of a plurality of elements, the equivalent value of the respective component ratios multiplied by the atomic No. (or the atomic weight) for each element is used.), if the electron density is large, the incident angle multiplication coefficient $m_0$ of the secondary electron emission coefficient can be reduced. Since Zeff/Aeff is in a range of 2 to 2.5 and small as compared with a change of $\rho$ in elements other than hydrogen, the penetration depth is regulated by the density $\rho$ of the solid. In other words, in the primary electrons of the same incident energy, the penetration depth becomes smaller as the density $\rho$ of the film is larger. Accordingly, since the suppression of the incident angle multiplication coefficient $m_0$ of the secondary electron emission coefficient means $m_0=d/\lambda$ (where $\lambda$ is the escape depth of the secondary electrons, and $\lambda=1/\alpha$), it can be understood that the suppression of the incident angle multiplication coefficient $m_0$ is to suppress the ratio of the penetration distance of the primary electrons to the secondary electrons in a medium.

However, in the uniform material, it is very difficult to control the relationship between $\lambda$ and d, independently, and as a result of studying by the present inventors, in many cases, it has been found that the incident angle multiplication coefficient $m_0$ of the secondary electron emission coefficient is a value of 10 or more with respect to the primary electrons of second cross point energy E2 or less.

As a result of the detailed study by the present inventors, as the structure for functioning the above actions (1) and (2), there has been found a structure stated below.

A structure in which the position of the surface is distributed in a film thickwise direction, to thereby disperse the escape depth $\lambda$ and increase it in a depthwise direction. Because $\lambda/d$ is satisfied from a difference of the energy of the electrons in many regions of the solid, the increase ratio of d with the dispersion of the surface position is slight as compared with the increase ratio of $\lambda$, as a result of which $d/\lambda$ becomes a small value, and the incident angle multiplication coefficient $m_0$ of the secondary electron emission coefficient is reduced. The above-mentioned method of dispersing the portion of the surface in the thickwise direction is realized by the provision of a complicated concave/convex structure in which the surface locally gets in the interior.

As a result of the detailed study by the present inventors, it has been found that a specific example of the above complicated structure is not always limited to the structure in which the configuration of the uppermost surface of the spacer has concave and convex, but even in a structure in which an interface having a difference in quality gets in the interior in a region of the penetration depth of the electrons where the uppermost surface is smooth, a structure small in the incident angle multiplication coefficient of the secondary electron emission coefficient can be realized.

Those methods makes $\lambda$ increase to conduct a preferred design, whereby the incident angle multiplication coefficient $m_0$ of the secondary electron emission coefficient with respect to the primary electrons of the second cross point energy E2 or less becomes about ⅓ or less as compared with the conventional example, and $m_0$ with respect to the primary electrons of the second cross point energy or less can be reduced to about 3.

<Suppress Effect of the Secondary Electron Emission Coefficient Due to a Fine Particle Dispersion Type Rough Surface Layer>

In addition, it has been found that the spacer with the structure in which the surface gets in the interior has the effect of reducing the absolute value of the secondary electron emission amount due to the above fine particle dispersion type rough surface layer, and this operational mechanism is understood as follows:

The secondary electrons and the primary electrons which travel in the layer containing the fine particles and the high-resistive film portion repeat collision and dispersion while conducting the mutual operation with the atoms in the interior of the medium and lose their energies. In this situation, the penetration depth and the energy reduction ratio strongly depend on the electron density of the medium through which the electrons pass, and since the probability of dispersion in the medium large in electron density is high, the penetration depth becomes small. In addition, the ratio of reduction of the energy per a constant penetration distance is large, and the secondary electron production amount per a unit depth increases. The structure large in electron density, that is, a material large in specific gravity is small in the penetration depth of the electrons and becomes large in the secondary electron production amount in the medium as compared with a material small in gravity.

Taking the penetration depth and the production amount of the electrons into consideration, when the movement of the produced secondary electrons in the interface of the medium different in the electron density is considered, it is presumed that there microscopically occurs a phenomenon in which the secondary electrons are emitted into a region small in the electron density from a region large in the electron density.

In this example, in the case where the above-mentioned interface is formed with concave and convex and formed so that the surface area is increased, the electrons again reach an interface with the high electron density region while traveling the region on the low electron density side large in the penetration length of the electrons, to thereby lose the energy. The charges remain in the film as a dielectric polarization for a given period of time, as a result of which the charges re-combine with the positive holes and finally disappear in the interior of the film. Consequently, most of those electrons are not finally emitted to vacuum and the secondary electron emission amount to the vacuum is reduced.

Because a specific embodiment stated below utilizes an antistatic film and vacuum as two regions different in the electron density and those two regions form a complicated interface, the secondary electron emission amount to the vacuum can be effectively reduced as described above, thereby being capable of preventing the charges.

The actions realized by the following embodiment is summarized in Table 1.

TABLE 1

| | Fine grain dispersion + Binder matrix film | |
|---|---|---|
| Spacer surface concave/convex mechanism<br>Interface (surface concave/convex) | First region<br>Vacuum | Second region Film |
| Specific gravity<br>Electron density ρAeff/Zeff | Small (0) | Large |
| Primary electron penetration distance d | Large | Small |
| Secondary electron escape distance λ | Large | Small |
| Secondary electron production amount dE/dX/ξ | Small (o) | Large |

Also, if the regions different in the electron density is regarded as an interface, even with a structure in which the interface of both the regions are complicated in the film, that is, a structure in which the interface is sparse and crowded in the film, the same effect can be realized without being limited to a specific material.

Also, the spacer in this embodiment is suitably used in the electron beam apparatus, and in such case, the spacer has a high-resistive antistatic film on a surface thereof, and a structure in which an electrically conductive film is disposed on an abutment surface with the electron source and/or an abutment surface with an electrode on a plate which faces the electron source is enabled. It is preferable that the high resistive film is electrically connected to above electron source and the above electrode through the above electrically conductive film.

The embodiments of the electron beam apparatus are as stated below.

(1) An embodiment mode of an image forming apparatus in which the above electrode is an accelerating electrode that accelerates the electrons emitted from the above electron source, and the electrons emitted from the above cold cathode element are irradiated onto the above target in response to an input signal to form an image. In particular, an image display device in which the above target is a phosphor.

(2) An embodiment mode in which the above cold cathode element is a cold cathode element having an electrically conductive film containing an electron emission portion between a pair of electrodes, and particularly preferably a surface conduction type electron emission element.

(3) An embodiment mode in which the above electron source is an electron source of a simple matrix arrangement having a plurality of cold cathode electrodes which are wired in a matrix by a plurality of row wirings and a plurality of column wirings.

(4) An embodiment mode in which the above electron source is an electron source of a ladder arrangement where a plurality of cold cathode element rows whose both ends are connected to a plurality of cold cathode elements which are disposed in parallel, respectively, are disposed (called row direction), and the electrons from the cold cathode elements are controlled by a control electrode (also called grid) disposed above the cold cathode elements along a direction orthogonal to the wirings (called column direction).

(5) Also, the present invention is not limited to an image forming apparatus suitable for display but the above-described image forming apparatus can be used as the light emission source instead of a light emitting diode or the like of an optical printer made up of a photosensitive drum, a light emitting diode, etc. Also, in this case, if the above described m row wirings and n column wirings are appropriately selected, the present invention is applicable to not only a linear light emission source but also a two-dimensional light emission source. In this case, the image forming member is not limited to a material which directly emits a light such as a phosphor which is used in the following embodiment, but a member on which a latent image due to the electron charge is formed can also be used. Also, according to the concept of the present invention, for example, with an electron microscope, even in the case where a member onto which the electrons emitted from the electron source are irradiated is other than the image forming member such as the phosphor, the present invention is applicable thereto. Accordingly, the present invention is applicable to an embodiment mode of a general electron beam apparatus which does not specify the member to be irradiated.

Hereinafter, a description will be given of preferred embodiments of the present invention.

A spacer according to the present invention includes a spacer substrate and a layer containing fine particles therein which covers at least one part of the spacer substrate (in the following embodiment, the layer is also called surface roughing layer, since charge suppression is conducted due to the surface roughing and the layer containing the fine particles also serves as a layer for roughing the surface), and the surface roughing layer is so structured as to contain the fine particles and binders therein. With the above structure, the concave and convex on the spacer substrate is so formed as to relax the incident angle with respect to a plurality of directions. FIG. 1 is a diagram showing the configuration of the spacer in accordance with the present invention, which is used, for example, as a spacer 1020 in an image display device shown in FIG. 11. FIGS. 1(*b*) and 1(*c*) are cross-sectional schematic views showing a concave/convex substrate spacer of this embodiment, in which FIG. 1(*b*) is a cross-section taken along a longitudinal direction B–B' in FIG. 1(*a*), and similarly FIG. 1(*c*) is a schematic view showing a cross-section taking along a lateral line C–C'. Reference numeral 1 denotes a spacer substrate, 4 is a surface roughing layer in which fine particles are dispersed, and 2 is a high resistive film formed on a surface of the spacer substrate 1 for the purpose of further retaining the charges. The high resistive film 2 forms concave and convex on a final surface so as to coincide with the concave/convex surface of the surface roughing layer. In this embodiment, the antistatic film is made up of a layer containing the fine particles and the high resistive film, but the antistatic film may be made up of only a layer containing the fine particles (more preferably, the surface roughing layer) 2. Reference numeral 3 denotes a low resistive film disposed to obtain an ohmic contact between the upper and lower electrode substrate and the spacer as occasion demands. As is apparent from FIGS. 1(*b*) and 1(*c*), the spacer substrate has the concave and convex configuration both in a B–B' cross-sectional direction and a C–C' cross-sectional direction which are orthogonal to each other. Accordingly, the concave and convex configurations are provided in other cross-sectional directions.

Further, the spacer according to this embodiment has the antistatic film which prefers the average particle diameter of the fine particles and is stable in electric characteristic, and in addition, in order to also preferably use the layer containing the fine particles as the surface roughing layer, the thickness of the surface roughing layer is small with respect to the dispersed fine particles or the particle diameter of the secondary particles due to coagulation of the fine particles. In the case where the secondary particle diameter is larger than the film thickness, because the fine particles are sparsely and crowdedly distributed in the film, further if the electrically conductivity of the fine particles is larger than the electrically conductivity of the binder matrix, no boundary is provided in the electrically conductive path in the thickwise direction and a plurality of boundaries exist in the electrically conductive path in the film surface direction. Therefore, a secondary effect that can reveal the anisotropy of a resistant value in the film thickwise direction and the film surface direction can be obtained.

Figure 6:
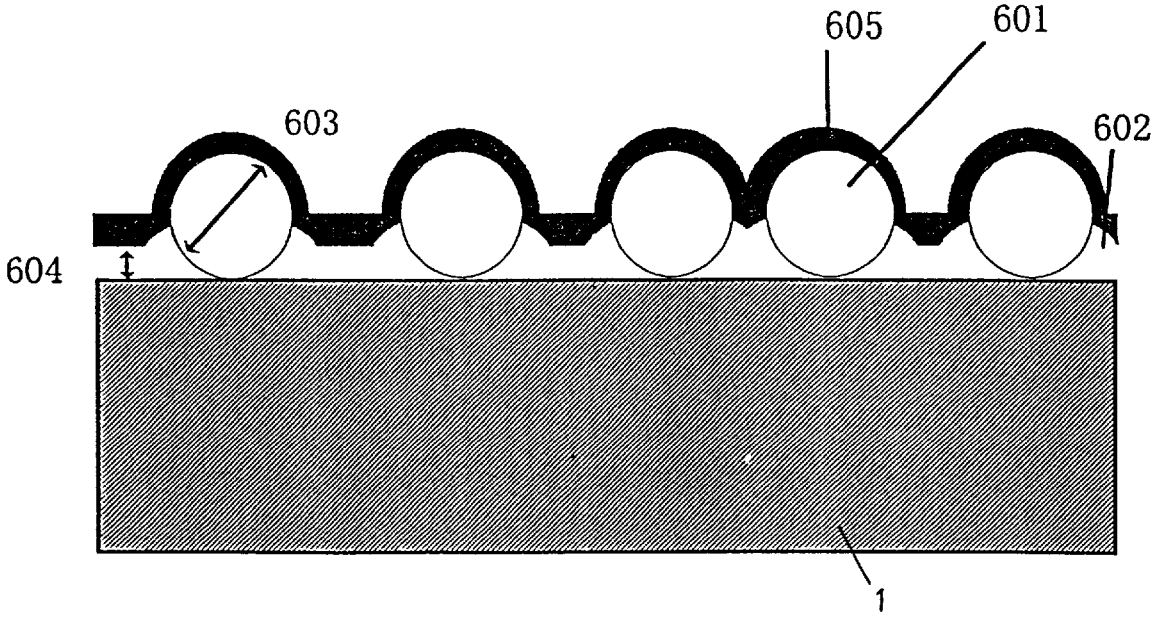
FIG. 6 is an explanatory diagram showing the surface structure of the spacer in accordance with an embodiment of the present invention.
Figure 8:
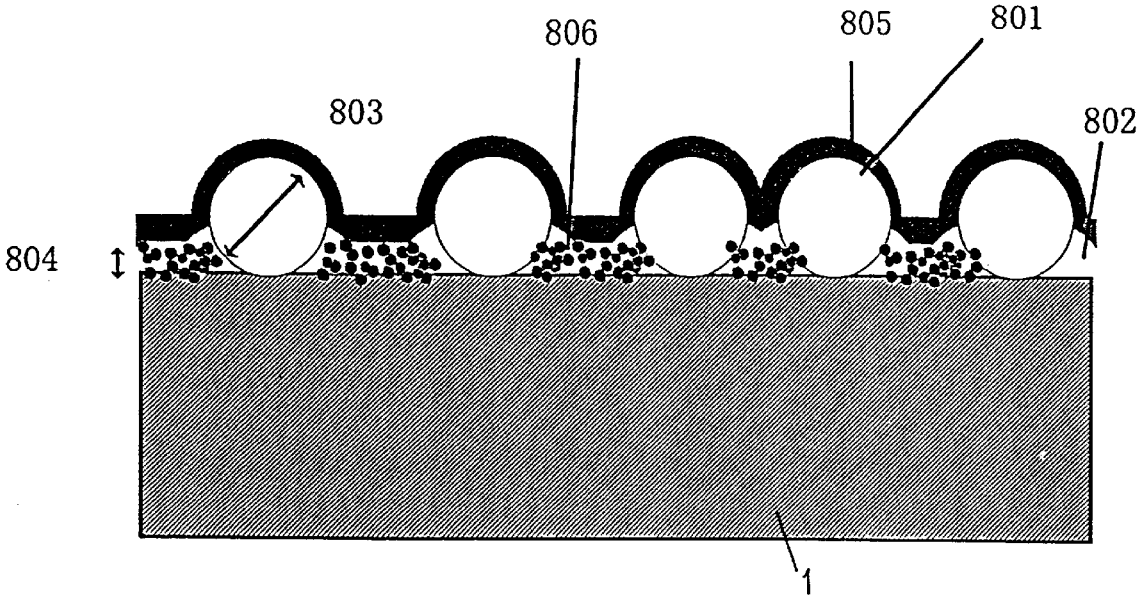
FIG. 8 is an explanatory diagram showing the surface structure of the spacer in accordance with still another embodiment of the present invention.

Hereinafter, in any of the embodiment modes, the average particle diameter of the primary particles (fine particles) is preferable, and as an embodiment mode which particularly suitably roughs the surface, a structure in which the particle diameter of the primary particles is larger than the film thickness is exemplified as a first embodiment mode in FIGS. 6 and 8. In the figures, reference numeral 601 and 801 denote fine particles provided for roughing the surface, and 602 and 802 are binder matrix portions provided for the purpose of fixing the fine particles with respect to the substrate, etc. The fine particle diameters 603 and 803 respectively are so designed as to have large values with respect to the film thicknesses 604 and 804 of the binder matrix portion. From the viewpoints of the substrate adhesion and the electrically conductivity, as shown in FIG. 8, fine particles 806 of another size may be contained in the binder other than the surface roughing fine particles.

On the other hand, in the case where the primary particles are aggregated and the sparse and crowded distribution of the primary particles exist, because there is the distribution in which the binder is dotted with the secondary particles that produce a crowded portion through the sparse portion, the aggregated fields (boundary) and the aggregated masses (cluster) are formed from the macroscopic viewpoint. This structure is called a second embodiment mode that suitably roughs the surface, and the second embodiment mode is exemplified in FIGS. 7 and 9. In the figures, reference numeral 701 and 901 are primary particles contained in the binder each having a diameter smaller than the film thicknesses 706 and 906, and 702 and 902 are binder matrixes. In the case where the primary particles are aggregated, although the sparse and crowded distribution exists in the film, since the aggregation of the fine particles is larger than that of the binder, there is normally exhibited the distribution in which the crowded portions 703 and 903 are surrounded by the sparse regions 704 and 904. In addition, the film thicknesses 706 and 906 are smaller than the secondary particle diameter, a structure in which the film is dotted with the secondary particle masses in the film surface direction can be realized. Further, there may be disposed a surface coating layer 705 necessary for suppressing the secondary electron emission, etc.

In any of the embodiment modes, if the average particle diameter of the primary particles is made smaller, the distribution of the primary particles can be made preferable. Even in the case where the primary particles are aggregated to produce the secondary particles, the distribution of the secondary particles can be made preferable.

<First Embodiment Mode>

A first embodiment mode of this embodiment is structured so that the primary particle diameter of the fine particles are larger than the average film thickness of the binder (hereinafter also referred to simply as binder thickness). In this embodiment mode, as shown in FIGS. 6 and 8, in the surface roughing surface, there always exist the binder matrix portion 602 or 802 in which the fine particles 601 or 801 for roughing the surface do not exist. Under the circumstance, in the present invention, the average film thickness of the binders means the average film thickness of the binder matrix portion (except for a portion where a meniscus is raised in the vicinity of the fine particles).

In this example, in order to rough the surface, the size of the fine particle diameter as compared with the binder thickness is preferably 1.2 times or more, more preferably a value of 1.5 times to 100 times. In a case where the particle diameter is smaller than the lower limit, the surface roughing effect cannot be sufficiently obtained, whereas in a case where the particle diameter is larger than the upper limit, the adhesion of the fine particles to the substrate is reduced.

Also, in this case, electric conductivity may be given to the binders. Also, in a case where the resistance of the layer per se which contains the fine particles is particularly made high, a high resistive film may be given as a charge relaxation path.

In addition, for the purpose of suppressing the secondary electron emission coefficient, independently from the control of the electric conductivity, a low secondary electron emission coefficient material of about several to several tens Å may be coated on the surface as the surface coating layer.

<Second Embodiment Mode>

In a second embodiment mode of this embodiment, the thickness of the surface roughing layer which is a layer containing the fine particles is a value larger than the particle diameter of the primary particles and is substantially equal to or smaller than the secondary particles. In this example, the thickness of the surface roughing layer means the average thickness of a region which satisfies the requirements of the present invention.

The primary particles dispersed in a coating solution form the secondary particles aggregated in a more stable state from a monodisperse state due to unstable factors such as an energy balance of a solid and a solution, a temperature during retention, a light stimulus, an atmosphere during formation of a film and cleaning conditions, thereby being capable of forming the sparse and crowded distribution of the primary particles in the film. In this situation, since the specific resistance of the fine particles in respect to the binder material is so designed as to be small, and the film thickness is so set as to be smaller than the particle diameter of the secondary particles, there is no boundary that exhibits the sparse distribution in the thickwise direction, and a structure in which the cluster of the secondary particles is surrounded by the boundary can be formed in the film surface direction. In this situation, the anisotropy of a resistance where the resistance in the film thickwise direction is lower than that in the film surface direction in the film thickwise direction can be revealed. A lower limit of a preferred sheet resistance is set in the film surface direction on the basis of the power consumption, etc., and a film which can satisfy the above condition and relax the charge in the film thickwise direction efficiently can be realized. As an additional effect, because the film thickness is larger than that of a portion of the surrounding boundary in the aggregated cluster region, the concave and convex structure of the particle diameter order of the secondary particles can be given to a final surface. Even in this embodiment mode, as occasion demands, a surface of a low secondary electron emission coefficient material can be coated separately.

[Forming Method]

In the spacer according to this embodiment, the surface roughing layer is formed through a liquid-phase film forming method. The liquid-phase film forming method includes a process of coating a dispersion liquid containing a solvent, a solution, etc., and a process of drying the solvent.

As the method of coating the surface roughing layer, a known antistatic film producing process can be applied. For example, a wet type printing method, an aerosol method, a dipping method, etc., can be applied. From the viewpoint of reducing the costs of the process of forming a coat on the fine shaped substrate, a simple process such as the dipping method is preferred. In particular, in the case of roughing the surface by thinning the film as in the first embodiment mode, a method of transferring a coating solution developed to another member through a process excellent in the uniformity of the film thickness such as spin coating through an offset printing is preferable from the viewpoint of the film thickness controllability.

As described above, since the coating film is obtained through a coating process and a dry process of a paste containing the fine particle component and the binder component through the wet type process in this embodiment mode, there are advantageous in that the efficiency of use of the raw material is high, and the costs are reduced such that a tack time is reduced and the vacuum pressure reduction fixing is not required, as compared with the gas phase process.

[Fine Particle Size and Density]

In the case where the layer containing the fine particles is used also as the surface roughing layer, concave and convex may be formed on the surface of the layer, and in the case of using the binder, the concave and convex structure may be provided on the surface by the fine particle component and the binder component. Basically, various fine particles and/or binder materials can be used. In the present invention, the fine particles 1000 Å or less in the average particle diameter is suitably employed. The average particle diameter is preferably 200 Å or less, and more preferably 100 Å or less. The lower limit is suitably 50 Å or more. In the layer containing the fine particles having the above range, a stable characteristic can be obtained. From the viewpoint of obtaining the rough surface as the above concave and convex structure, in the first embodiment mode, the fine particles as large as possible within the above range are selected.

On the other hand, in the second embodiment, because it is necessary to form the aggregated masses of the film, the fine particles as small as possible is preferably used.

In addition, from the viewpoint of obtaining the rough surface as the above concave/convex structure, the density of the fine particles in the solid is preferably high, and the density of 10 to 80 weight % is usually used. In order to make the degree of dispersion of the fine particles suitable, the layer containing the fine particles may include the fine particles of 30% or more at a volume ratio. In addition, the density of the solid in the coating solution is preferably 15 weight % or less. The upper limit is determined from the coating solution keeping property.

[Fine Particle Material, Binder Material]

In this embodiment, the fine particles as used may be made of, for example, carbon, silicon dioxide, tin dioxide, chrome dioxide, etc. The layer containing metal elements is preferable from the viewpoint of the stability, and particularly, the layer containing tin dioxide is more preferably used.

Also, as the binder, any material is applicable if the binder function that can retain the fine particles on the spacer substrate when braking is provided, and for example, the binder including silica component or metal oxide may be preferable.

[Spacer Substrate Configuration]

Figure 31:
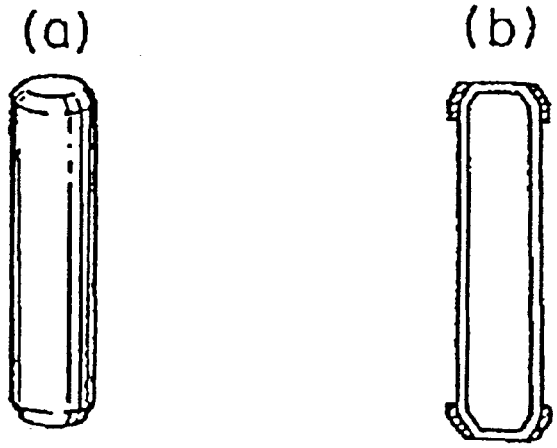
FIG. 31 is an explanatory diagram showing a spacer in accordance with another mode of the embodiment of the present invention, in which FIG. 31(*a*) is a diagram showing the appearance of a columnar spacer in accordance with another embodiment of the present invention, and FIG. 31(*b*) is a vertical cross-sectional view showing the columnar spacer in accordance with another embodiment of the present invention.
Figure 32:
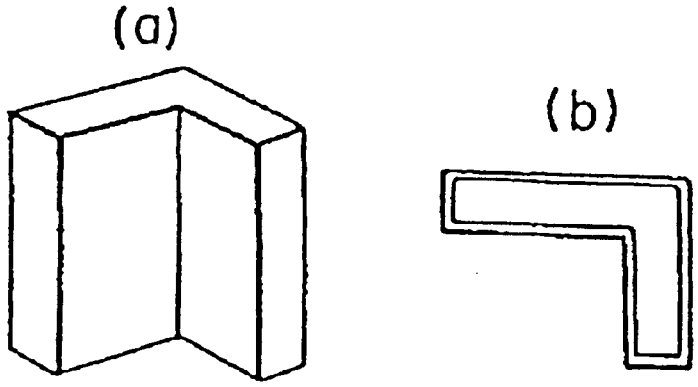
FIG. 32 is an explanatory diagram showing a spacer in accordance with still another mode of the embodiment of the present invention, in which FIG. 32(*a*) is a diagram showing the appearance of an angular spacer in accordance with still another embodiment of the present invention, and FIG. 32(*b*) is a horizontal cross-sectional view showing the angular spacer in accordance with still another embodiment of the present invention.

The spacer of this embodiment is not limited to a spacer of a specific configuration. FIGS. 31 and 32 show a embodiment mode of a columnar structure as another structure of a spacer to a surface of which the concave and convex configuration is given by the surface roughing layer in accordance with this embodiment.

[Spacer Substrate Material]

In order that the spacer substrate obtains a heat resistance during a heating process in a paste, the material of the substrate may be preferably ceramic glass such as alumina, non-alkalic glass, low alkalic glass, or glass that suppresses the alkali moving amount. Further, in order to prevent the image forming apparatus from being destroyed due to a difference in the coefficient of thermal expansion between the face plate or the rear plate and the spacer during the heating process in the assembling, as occasion demands, a thermal expansion coefficient adjusting material may be added to the substrate material for the purpose of adjusting the thermal expansion coefficient.

As the thermal expansion coefficient adjusting material, in the case where an alumina substrate is used as, for example, the spacer substrate, there are zirconia (zirconium oxide), etc. For example, when the face plate made of a blue plate glass $80\times10^{-7}$/°C. to $90\times10^{-7}$/°C. in thermal expansion coefficient is assembled with the spacer having a spacer substrate made of alumina, if the weight mixture ratio of alumina and zirconia is set to 70:30 to 10:90, thereby being capable of setting the thermal expansion coefficient of the spacer substrate to $75\times10^{-7}$/°C. to $95\times10^{-7}$/°C. The weight mixture ratio of alumina and zirconia is preferably set to 50 to 80%. The thermal expansion coefficient adjusting material may be other materials such as lanthanum oxide ($La_2O_3$), except for zirconia.

In addition, the secondary electron emission coefficient of the surface roughing layer is preferably low, and a peak value is more preferably 3.5 or lower as the secondary electron emission coefficient of the smooth film. In other words, it is more preferable that the secondary electron emission coefficient measured under the vertical incident condition with respect to the smooth film surface formed on the smooth substrate is 3.5 or less. In addition, from the viewpoint of the chemical stability of the film, it is preferable that the surface layer is in a high oxidation state as compared with the film interior.

Figure 11:
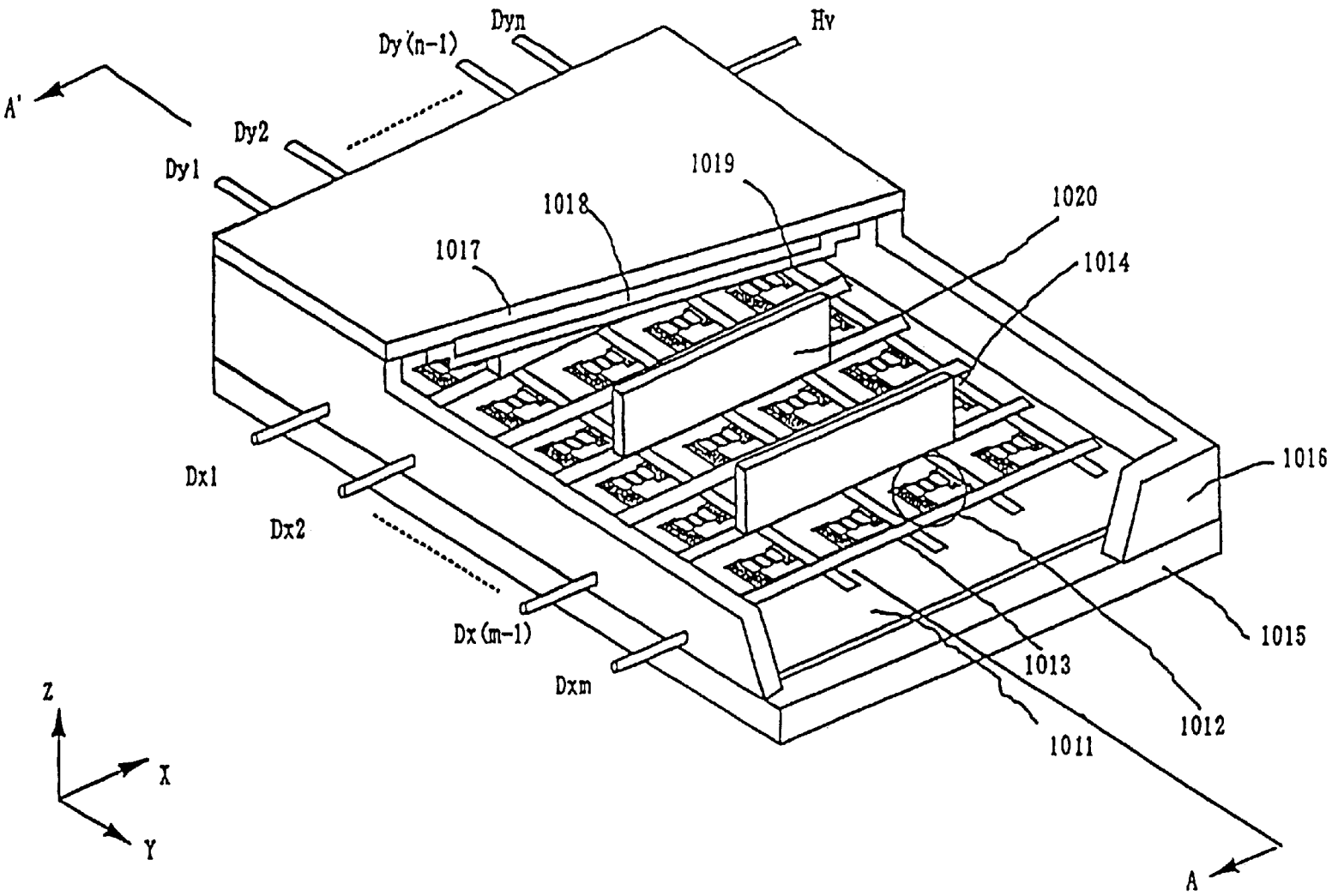
FIG. 11 is a perspective view showing an image display device in which a part of a display panel is cut off in accordance with an embodiment of the present invention.

In the spacer according to this embodiment, for example, in the image display device shown in FIG. 11, one side of the spacer 1020 is electrically connected to a wiring on the substrate 1011 on which the cold cathode element is formed. Also, its opposite side is electrically connected to an accelerating electrode (metal back 1019) for permitting the electrons emitted from the cold cathode element to collide with a light emitting material (a fluorescent film 1018) with a high energy. In other words, a current obtained by substantially dividing an accelerating voltage by the resistance of the antistatic film flows in the antistatic film formed on the surface of the spacer.

Therefore, the resistance Rs of the spacer is set to a desired range from the antistatic and power consumption viewpoints. From the antistatic viewpoint, it is preferable that the sheet resistivity R/□ is $10^{14}$ [Ω/□] or less. In order to obtain a sufficient antistatic effect, it is more preferable that the sheet resistance is $10^{13}$ [Ω/□] or less. It is preferable that the lower limit of the sheet resistivity is $10^{7}$ [Ω/□] or more.

It is preferable that the thickness t of the layer containing the fine particles or the thickness t also including another layer in the case where another layer except for the layer containing the fine particles is provided, is 0.1 to 10 μm taking the penetration depth of the primary electrons and the roughness of the concave and convex structure into consideration as its upper limit, taking peeling off of the layer due to the film stress into consideration as its upper limit.

The sheet resistance R/□ is ρ/t (in this context, ρ represents a specific resistance), and the specific resistance ρ of the antistatic film is preferably $10^{2}$ to $10^{11}$ Ωcm from the above-described preferred ranges of R/□ and t. Further, in order to realize the more preferable ranges of the sheet resistance and the film thickness, it is preferable to set ρ to $10^{5}$ to $10^{9}$ cm.

The temperature of the spacer rises because a current flows in the film formed on the spacer, or because the entire display generates heat during the operation. When the resistant temperature coefficient of the antistatic film is a large negative value, the resistance is reduced when the temperature rises, the current flowing in the spacer increases, and the temperature further rises. Then, the current continues to increase until reaching the limit of a power supply. The conditions under which the above-mentioned run-away of the current occurs are featured by a value of the temperature coefficient TCR (Temperature Coefficient of Resistance) of the resistance which will be described with reference to the following general expression (ξ), where ΔT and ΔR are increase amounts of the temperature T and the resistance R of the spacer in a real drive state with respect to a room temperature.

$$TCR=\Delta R/\Delta T/R\times 100\ [\%/^{\circ}\mathrm{C.}] \qquad \text{expression } (\xi)$$

The resistant temperature coefficient value at which the current thermally runs away is a negative value and 1%/°C. or more in absolute value experimentally. That is, it is desirable that the resistant temperature coefficient of the antistatic film is larger than −1%/°C. (at the time of a negative value, it is desirable that the absolute value is less than 1%.)

The surface roughing layer of the spacer according to this embodiment can conduct other than the resistance control due to the component ratio control, the control of the temperature dependency characteristic of the resistance due to an addition agent. In this case, there is an advantage in that the control can be conducted without largely changing the network structure of the film. Metal oxide is excellent as the addition agent. Among the metal oxide, a transition metal oxide such as chromium, nickel or copper is a preferable material.

The above film having the antistatic function is not limited to the spacer but can be used as the antistatic film in another application.

Also, if a low resistive film is disposed on a contact portion with the upper and lower substrate of the spacer on which the above film is formed, it becomes possible to suppress the local storage of the charges in the vicinity of the joint portions of the spacer and the anode/cathode. Also, the resistance of the low resistive film is desirably 1/10 or less of the resistance of the above film as its sheet resistance and $10^{7}$ [Ω/□] or less for the purpose of making the electric joint of the upper and lower substrates excellent.

[Summary of Image Display Device]

Subsequently, a description will be given of the structure and a manufacturing method of a display panel in an image forming apparatus to which the present invention is applied with reference to specific examples.

FIG. 11 shows the rough structure of one example of a plane type image display device (electron beam apparatus) using the above-described spacer with the surface roughing layer (the details will be described later). The image display device is structured in such a manner that a substrate 1011 on which a plurality of cold cathode electrodes 1012 are formed and a transparent face plate 1017 on which a fluorescent film 1018 which is a light emitting material is formed are opposite to each other through spacers 1020. Each of the spacers 1020 is coated with a film made of fine particles and binder components and having a concave/convex structure.

FIG. 11 is a perspective view showing a display panel used in this embodiment in which a part of the panel is cut off for the purpose of showing the inner structure.

In the figure, reference numeral 1015 denotes a rear plate, 1016 is a side wall, 1017 is a face plate, and the members 1015 to 1017 form a hermetic container for maintaining the interior of the display panel in a vacuum state. In assembling the hermetic container, it is necessary to seal the joint portions of the respective members in order to retain the sufficient strength and the gas tightness. For example, flit glass is coated on the joint portions and then baked in the atmosphere or the nitrogen atmosphere at 400 to 500° C. for 10 minutes or longer, to thereby achieve the sealing. A method of exhausting the gas from the interior of the hermetic container into vacuum will be described. Also, since the interior of the above hermetic container is retained to vacuum of about $10^{-6}$ [Torr], the spacers 1020 are disposed as an interval maintaining structural body for the purpose of preventing the hermetic container from being destroyed due to the atmospheric pressure, an unintentional impact, etc.

Subsequently, a description will be given of an electron emission element substrate which can be used in the image forming apparatus of the present invention.

The electron source substrate used in the image forming apparatus of this embodiment is formed by arranging a plurality of cold cathode electrodes on the substrate.

As systems of arranging the cold cathode electrodes, there are a ladder type arrangement (hereinafter called "ladder type arrangement electron source substrate") in which the cold cathode elements are disposed in parallel, and both ends of the respective elements are connected by wirings, and a simple matrix arrangement (hereinafter called "matrix type arrangement electron source substrate") which connects the X-directional wiring and the Y-directional wiring of a pair of element electrodes of the cold cathode element. The image forming apparatus having the ladder type arrangement electron source substrate requires a control electrode (grid electrode) which is an electrode that controls the fly of the electrons from the electron emission elements. The rear plate 1015 is fixed onto the substrate 1011, and N×M cold cathode electrodes 1012 are formed on the substrate. Reference N and M are positive integers of 2 or more and appropriately set in accordance with a desired number of display pixels. For example, in the image display device for the purpose of displaying in a high-grade television, it is desirable that the number of N=3000 and M=1000 or more is set. The above N×M cold cathode elements are wired in a simple matrix by M row-directional wirings 1013 and N column-directional wirings 1014. A portion made up of the above members 1011 to 1014 is called multiple electron beam source.

The multiple electron beam source used in the image display device of this embodiment is not limited to the material or configuration of the cathode elements and the manufacturing method if it is an electron source with the cold cathode elements wired in a single matrix or arranged in a ladder.

Accordingly, for example, a surface conduction type electron emission element or an FE type or MIM type cold cathode element can be used.

Subsequently, a description will be given of a structure of the multiple electron beam source in which the surface conduction type electron emission elements (which will be described later) are disposed on the substrate as the cold cathode elements and wired in a simple matrix.

Figure 13:
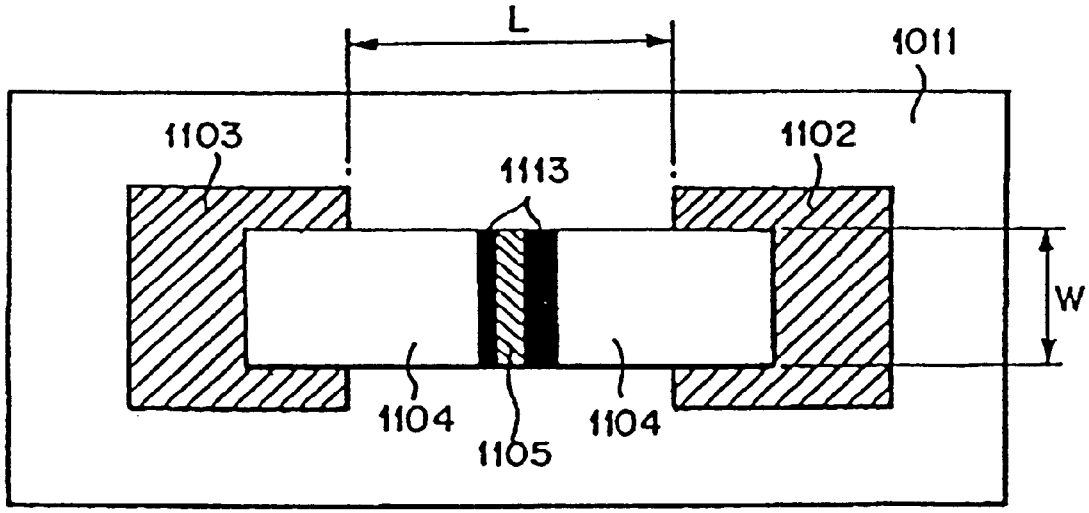
FIG. 13(*a*) is a plan view showing a plane-type surface conduction type electron emission element used in the embodiment of the present invention, and FIG. 13(*b*) is a cross-sectional view thereof.
Figure 13:
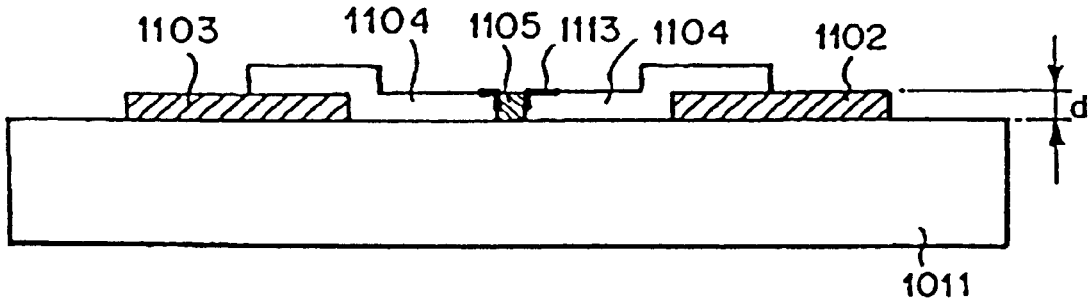
Figure 14:
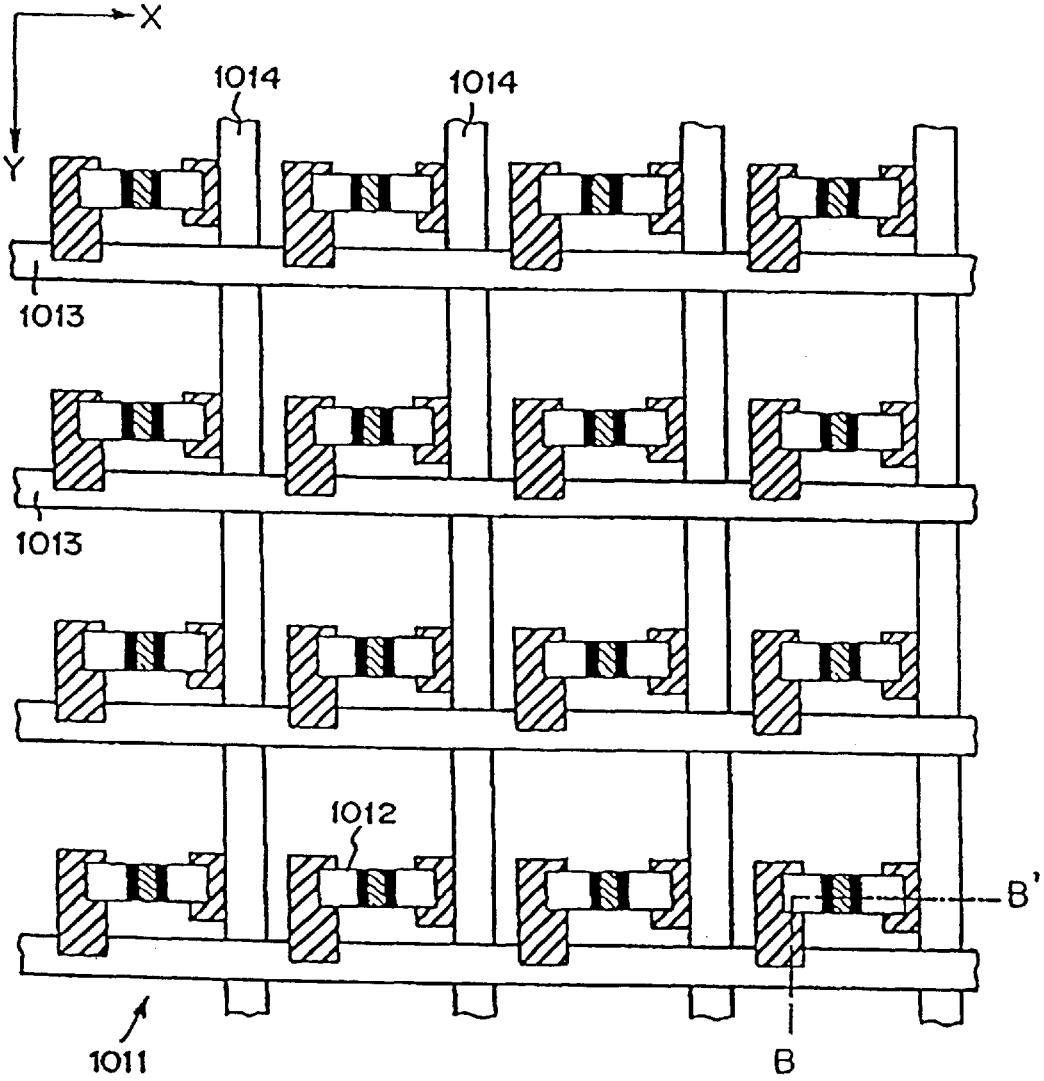
FIG. 14 is a plan view showing a substrate of a multiple electron beam source used in the embodiment of the present invention.

FIG. 14 shows a plan view of the multiple electron beam source used in the display panel shown in FIG. 11. The same surface conduction type electron emission elements 1012 as those shown in FIG. 13 which will be described later are arranged on the substrate 1011, and those elements are wired in a simple matrix by the row-directional wirings 1013 and the column-directional wirings 1014. Portions where the row-directional wirings 1013 and the column-directional wirings 1014 cross each other are formed with insulating layers (not shown) between electrodes, to keep electric insulation.

Figure 15:
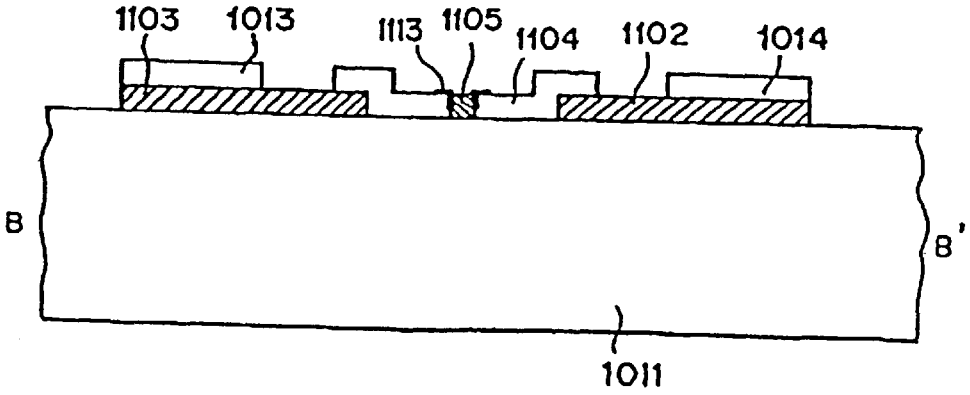
FIG. 15 is a partially cross-sectional view showing the substrate of the multiple electron beam source used in the embodiment of the present invention.

FIG. 15 shows a cross-sectional view taken along a line B–B' of FIG. 14.

The multiple electron source thus structured is manufactured in such a manner that the row-directional wirings 1013, the column-directional wirings 1014, inter-electrode insulating layers (not shown), the element electrodes of the surface conduction type electron emission elements 1012 and the electrically conductive thin film have been formed on a substrate in advance, electricity is supplied to the respective elements through the row-directional wirings 1013 and the column-directional wirings 1014 to conduct an energization forming process (which will be described later) and an energization activating process (which will be described later).

This embodiment is structured in such a manner that a substrate 1011 of a multiple electron beam source is fixed onto the rear plate 1015 of the hermetic container. In the case where the substrate 1011 of the multiple electron beam source has a sufficient strength, the substrate 1011 per se of the multiple electron beam source may be used as the rear plate of the hermetic container.

Figure 16:
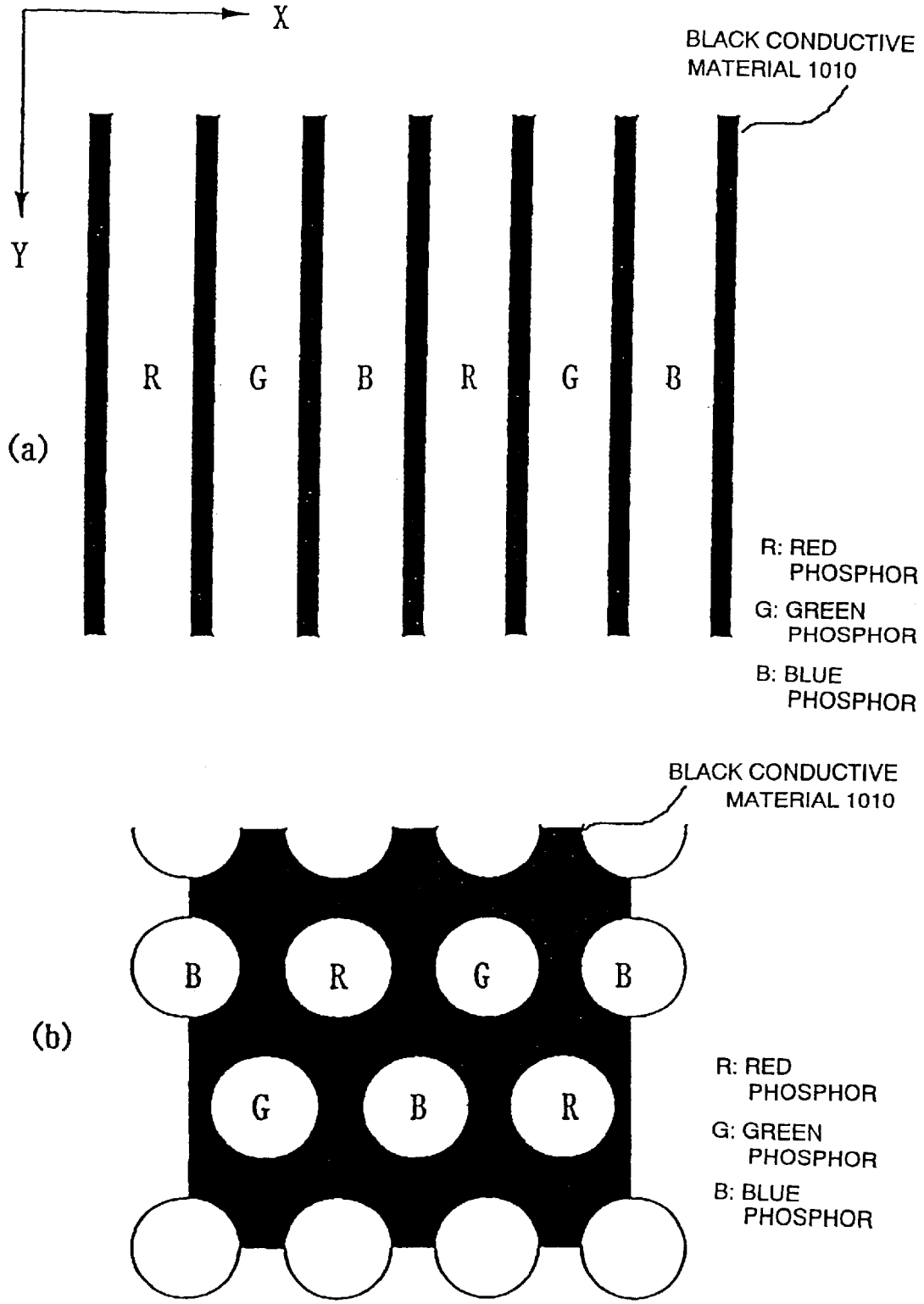
FIG. 16 is a plan view showing an example of the arrangement of phosphors of a face plate of a display panel.

Also, the fluorescent film 1018 is formed on the lower surface of the face plate 1017. Because this embodiment pertains to the color image display device, phosphors of three primary colors consisting of red, green and blue used in a field of CRT are painted on a portion of the fluorescent film 1018. The phosphors of the respective colors are distinguishably painted, for example, in stripes as shown in FIG. 16(*a*), and a black electric conductor 1010 is disposed between the stripes of the phosphors. The purposes of providing the electric conductor 1010 are to prevent the shift of the display colors even if a position to which an electron beam is irradiated is slightly displaced, to prevent the deterioration of display contrast by preventing the charge-up of the fluorescent film due to the electron beams, etc. The black electric conductor 1010 mainly contains black lead, however a material other than black lead may be used if the material is appropriate for the above purposes.

Figure 17:
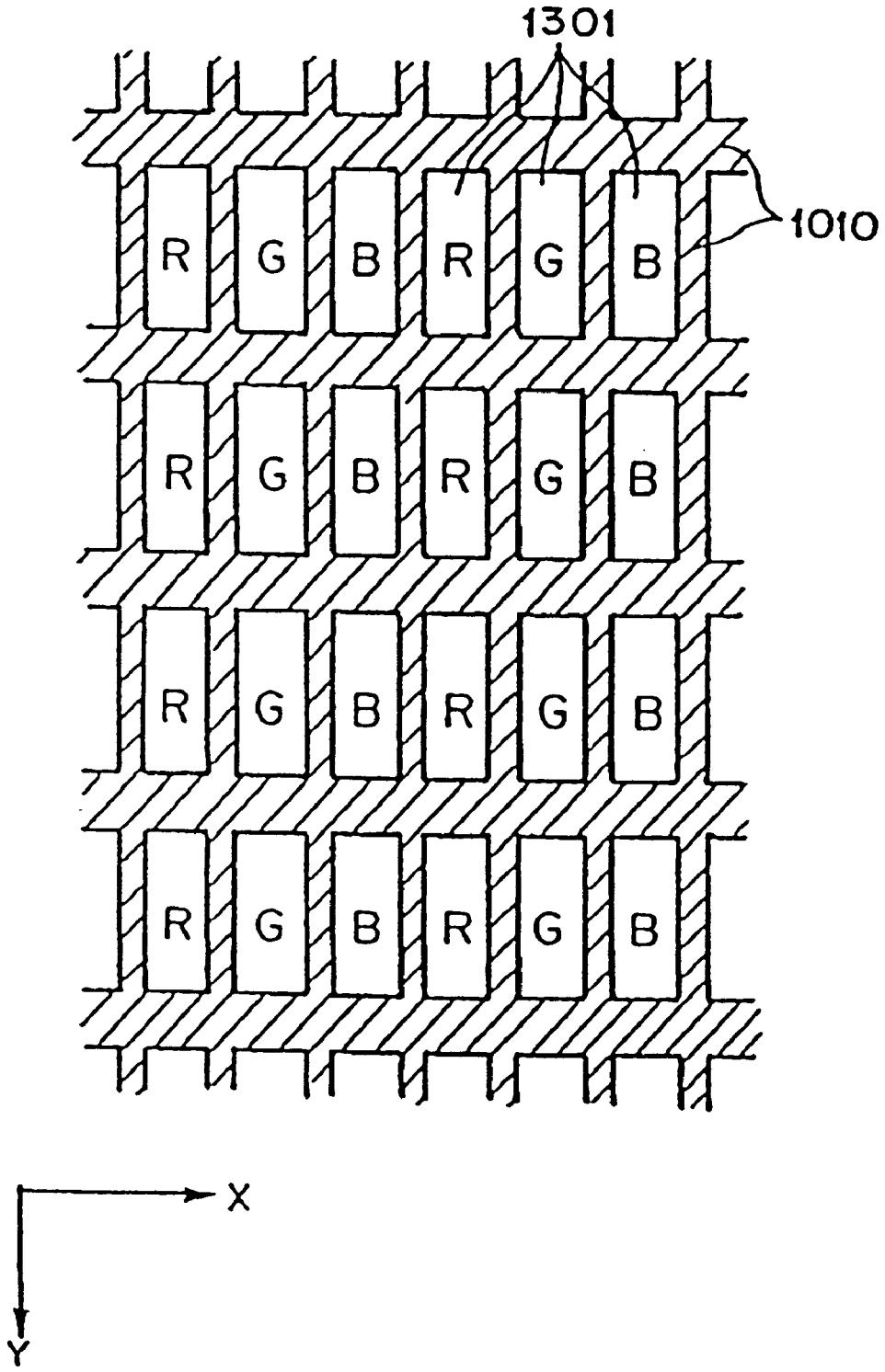
FIG. 17 is a plan view showing an example of the arrangement of phosphors of a face plate of a display panel.

Also, the manner of distinguishably painting the phosphors of three primary colors is not limited to the arrangement of the stripes shown in FIG. 16(*a*), but, for example, an arrangement in the form of delta shown in FIG. 16(*b*) or other arrangements (for example, FIG. 17) may be applied.

In the case of producing a monochrome display panel, a mono-color phosphor material may be used for the fluorescent film 1018, and the black electric conductor 1010 may not be always used.

Also, a metal back 1019 known in the field of CRTs is disposed on a surface of the fluorescent film 1018 on the rear plate side. The purposes of providing the metal back 1019 are to improve the light use ratio by partially reflecting a light emitted from the fluorescent film 1018 by a mirror surface, to protect the fluorescent film 1018 from collision of negative ions, to operate the metal back as an electrode for applying the electron beam accelerating voltage, to operate the metal back as an electric conductive path of electrons that excite the fluorescent film 1018, etc. The metal back 1019 is formed in such a manner that after the fluorescent film 1018 has been formed on the face plate substrate 1017, the surface of the fluorescent film is smoothed, and Al is vacuum-deposited on the smoothed surface. In the case where the fluorescent film 1018 is made of a phosphor material for a low voltage, the metal back 1019 may not be used.

Also, although being not used in this embodiment, for the purposes of applying the accelerating voltage and improving the electric conductivity of the fluorescent film, for example, a transparent electrode made of ITO may be disposed between the face plate substrate 1017 and the fluorescent film 1018.

Figure 12:
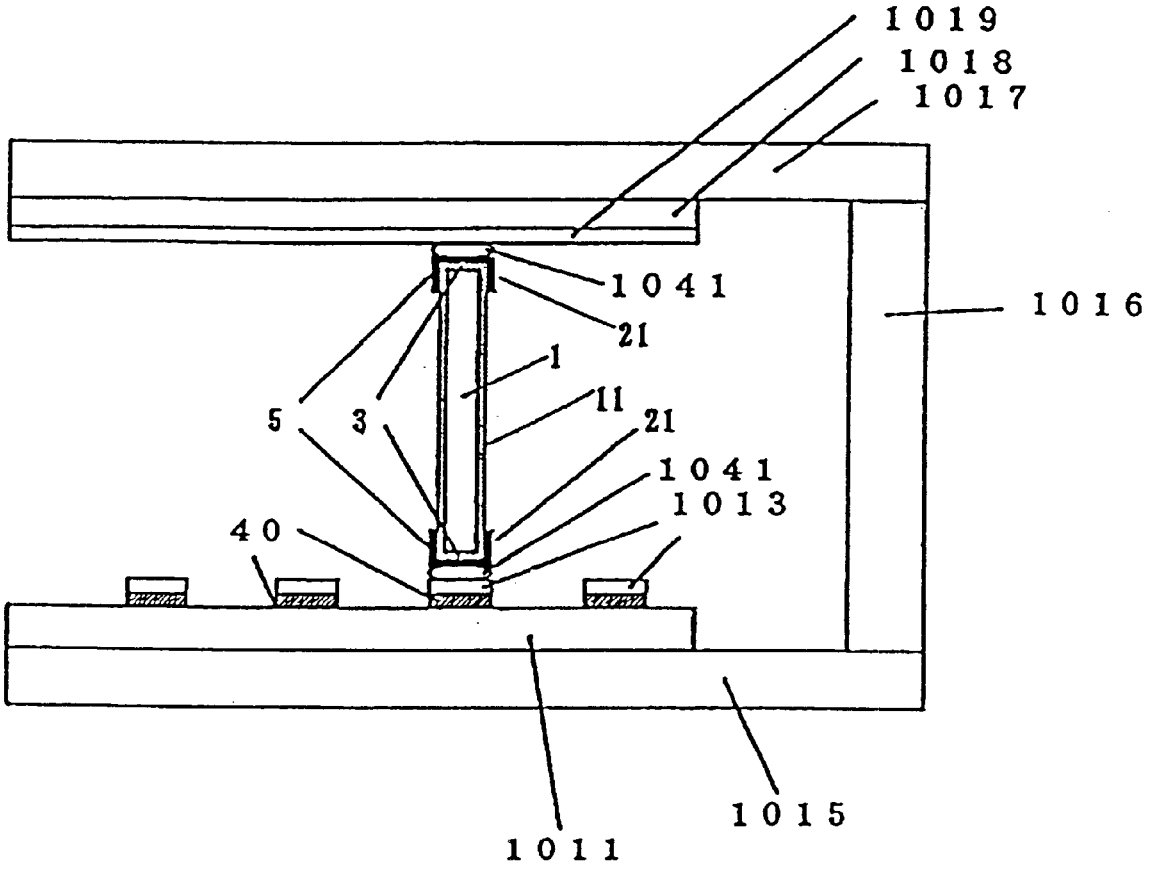
FIG. 12 is a cross-sectional view showing a display panel taken along a line A–A' in accordance with the embodiment of the present invention.

FIG. 12 is a schematic cross-sectional view taken along a line A–A' of FIG. 11, in which numeral reference of the respective members correspond to those in FIG. 11. The spacer 1020 is coated with an antistatic film 11 for the purpose of preventing the charge on the surface of the insulating member 1. Also, a low resistive film 21 is formed on abutment surfaces which face the inner side of the face plate 1017 (metal back 1019, etc.) and the surface of the substrate 1011 (row-directional wirings 1013 or the column-directional wirings 1014) and side portions 5 in the vicinity of the abutment surfaces. The spacers 1020 of the number required for achieving the above objects are arranged at required intervals and fixed onto the inner side of the face plate and the surface of the substrate 1011 by a bond 1041. Also, the antistatic film is formed on at least the surfaces exposed to vacuum within the hermetic container among the surface of the insulating member 1, and electrically connected to the inside of the face plate 1017 (metal back 1019, etc.) and the surface of the substrate 1011 (the row-directional wirings 1013 or the column-directional wirings 1014) through the low resistive film 21 and the bond 1041 on the spacer 1020. In the embodiment mode described now, the spacers 1020 are shaped in a thin plate, disposed in parallel with the row-directional wirings 1013, and electrically connected to the row-directional wirings 1013.

It is necessary that the spacer 1020 has the insulation sufficient to withstand a high voltage applied between the row-directional wirings 1013 and the column-directional wirings 1014 on the substrate 1011 and the metal back 1019 on the inner surface of the face plate 1017, and also has the electric conductivity so that the charge on the surface of the spacer 1020 is prevented.

The insulating material 1 of the spacers 1020 may be made of, for example, quartz glass, glass reducing impurity content such as Na, soda lime glass, or a ceramic member such as alumina. It is preferable that the coefficient of thermal expansion of the insulating member 1 is close to that of the members of the hermetic container and the substrate 1011.

The low resistive film 21 that forms the spacers 1020 is so disposed as to electrically connect the antistatic film 11 to the face plate 1017 at the high potential side (metal back 1019, etc.) and the substrate 1011 (wirings 1013, 1014, etc.) at the low potential side. Hereinafter, the low resistive film 21 is also called "intermediate electrode layer (intermediate layer)". The intermediate electrode layer (intermediate layer) can provide a plurality of functions stated below.

(1) The antistatic film 11 is electrically connected to the face plate 1017 and the substrate 1011.

As is already described above, the antistatic film 11 is provided for the purpose of preventing the charge on the surface of the spacer 1020. In the case where the antistatic film 11 is connected to the face plate 1017 (metal back 1019, etc.) and the substrate 1011 (wirings 1013 and 1014, etc.) directly or through the abutment member 1041, a large contact resistor occurs on the interface of the connecting portion with the result that there is the possibility that the charges occurring on the surface of the spacer 1020 cannot be rapidly removed. In order to remove this drawback, the low-resistive intermediate layer is disposed on the abutment surfaces 3 and the side portions 5 of the spacers 1020 which are in contact with the face plate 1017, the substrate 1011 and the abutment member 1041.

(2) The potential distribution of the antistatic film 11 is unified.

The electrons emitted from the cold cathode elements 1012 forms electron loci in accordance with the potential distribution formed between the face plate 1017 and the substrate 1011. In order to prevent the electron loci from being disordered in the vicinity of the spacers 1020, it is desirable to control the potential distribution of the antistatic film 11 over the entire regions. In the case where the antistatic film 11 is connected to the face plate 1017 (metal back 1019, etc.) and the substrate 1011 (wirings 1013 and 1014, etc.) directly or through the abutment member 1041, there is the possibility that the unevenness of the connecting state occurs, and the potential distribution of the antistatic film 11 is shifted from a desired value because of the contact resistance on the interface of the connecting portion. In order to prevent this drawback, the low-resistive intermediate layers are disposed over the overall region of the space end portions (the abutment surface 3 or the side portion 5) where the spacers 1020 abut against the face plate 1017 and the substrate 1011, and a desired potential is applied to the intermediate layer portion, thereby being capable of controlling the potential of the entire antistatic film 11.

(3) The loci of the emission electrons are controlled.

The electrons emitted from the cold cathode elements 1012 form the electron loci in accordance with the potential distribution formed between the face plate 1017 and the substrate 1011. There is the possibility that the electrons emitted from the cold cathode elements 1012 in the vicinity of the spacers are limited (the change in wirings and the element positions, etc.) with the location of the spacers 1020. In this case, in order to form an image without any strain and unevenness, it is necessary that the loci of the emitted electrons are controlled to irradiate the electrons at a desired position on the face plate 1017. If the low-resistive intermediate layer is disposed on the side portion 5 of the surfaces which abut against the face plate 1017 and the substrate 1011, the potential distribution in the vicinity of the spacers 1020 can provide a desired characteristic so as to control the loci of the emitted electrons.

The low resistive film 21 may be selected from materials having a resistance lower than the antistatic film 11 by at least one digit, and is appropriately selected from metal such as Ni, Cr, Au, Mo, W, Pt, Ti, Al, Cu or Pd, or alloy of those metal, metal such as Pd, Ag, Au, $RuO_2$, Pd—Ag, metal oxide, a printing conductor made of glass, transparent conductor such as $In_2O_3$—$SnO_2$, and semiconductor material such as polysilicon.

It is necessary that the bond 1041 provides electric conductivity so that the spacers 1020 are electrically connected to the row-directional wirings 1013 and the metal back 1019. That is, flit glass to which an electrically conductive adhesive, metal particles, or electrically conductive filler is added, is preferable.

Also, in FIG. 11, Dx1 to Dxm and Dy1 to Dyn and Hv are electric connection terminals with a hermetic structure provided for electrically connecting the display panel to an electric circuit not shown. Dx1 to Dxm are electrically connected to the row-directional wirings 1013 of the multiple electron beam source, Dy1 to Dyn are electrically connected to the column-directional wirings 1014 of the multiple electron beam source, and Hv is electrically connected to the metal back 1019 of the face plate, respectively.

Also, in order to exhaust the gas from the interior of the hermetic container, after the hermetic container has been assembled, it is connected to an exhaust tube and a vacuum pump not shown, and the gas is exhausted from the interior of the hermetic container to the degree of vacuum of about $10^{-7}$ [Torr]. Thereafter, the exhaust tube is sealed, and in order to maintain the degree of vacuum within the hermetic container, a getter film (not shown) is formed at a given position within the hermetic container immediately before sealing or after sealing. The getter film is formed by heating and depositing a getter material that mainly contains, for example, Ba by a heater or a high-frequency heating, and the interior of the hermetic container is maintained to the degree of vacuum of $1\times10^{-5}$ to $1\times10^{-7}$ [Torr] due to the adsorption action of the getter film.

In the image display device using the above-described display panel, when a voltage is applied to the respective cold cathode element 1012 through the container external terminals Dx1 to Dxm and Dy1 to Dyn, electrons are emitted from the respective cold cathode elements 1012. At the same time, when a high voltage of several hundreds [V] to several [kV] is applied to the metal back 1019 through the container external terminal Hv, the emitted electrons are accelerated and collide with the inner surface of the face plate 1017. As a result, the phosphors of the respective colors which form the fluorescent film 1018 are excited to emit a light, thereby displaying an image.

Usually, a supply voltage to the surface conduction type electron emission elements 1012 which are the cold cathode elements according to the present invention is about 12 to 16 [V], a distance d between the metal back 1019 and the cold cathode elements 1012 is about 0.1 to 8 [mm], a voltage between the metal back 1019 and the cold cathode elements 1012 is about 0.1 [kV] to 10 [kV].

Subsequently, a description will be given of a method of manufacturing a multiple electron beam source used in the above image display device. The multiple electron beam source in the above image display device to which the spacer of the present invention is used is not limited to the material or the configuration of the cold cathode elements if the cold cathode elements are arranged in a simple matrix, and the electron sources or the cold cathode elements which are wired are arranged in a ladder, and the electron sources are wired. Accordingly, for example, the surface conduction type electron emission element, or the cold cathode element of the FE type, the MIM type, or the like can be employed.

Under the circumstances where the image display device large in a display screen and inexpensive is demanded, the surface conduction type electron emission element is particularly preferable among those cold cathode elements. That is, in the FE type, because the relative position and the configuration of the emitter cone and the gate electrode largely depend on the electron emission characteristic, the manufacturing technique with an extremely high precision is required. However, this becomes a disadvantageous factor in order to achieve the large area and the reduction of the manufacture costs. Also, in the MIM type, it is necessary to thin the thicknesses of the insulating layer and the upper electrode and also unify the thicknesses. However, this also leads to a disadvantageous factor in order to achieve the large area and the reduction of the manufacture costs. From this viewpoint, in the surface conduction type electron emission element, because the manufacturing method is relatively simple, it is easy to achieve the large area and the reduction of the manufacture costs. Also, the present inventors have found that among the surface conduction type electron emission elements, the electron emission element in which the electron emission portion or its peripheral portion is formed of a fine particle film is particularly excellent in the electron emission characteristic and is readily manufactured. Accordingly, such an element is most preferable when being used in the multiple electron beam source in the image display device high in luminance and large in screen. Therefore, in the display panel of the above-mentioned embodiment, there is used the surface conduction type electron emission element in which the electron emission portion or its peripheral portion is formed of a fine particle film. First, a description will be given of a basic structure, the manufacturing method and the characteristic in the preferable surface conduction type electron emission element, and thereafter a description will be given of the structure of the multiple electron beam source in which a large number of elements are wired in a simple matrix.

[Preferable Element Structure and Manufacturing Method of Surface Conduction Type Electron Emission Element]

The representative structure of the surface conduction type electron emission element in which the electron emission portion or its peripheral portion is formed of a fine particle film are classified into two kinds consisting of the plane type and the vertical type.

[Plane Type Surface Conduction Type Electron Emission Element]

First of all, a description will be given of the element structure and the manufacturing method of the plane type surface conduction type electron emission element. FIGS. 13(*a*) and 13(*b*) are a plan view and a cross-sectional view for explanation of the structure of the plane type surface conduction type electron emission element. In the figures, reference numeral 1011 denotes a substrate, 1102 and 1103 are element electrodes, 1104 is an electrically conductive thin film, 1105 is an electron emission portion formed through an energization forming process, and 1113 is a film formed through an energization activating process.

The substrate 1011 may be formed of, for example, various glass substrates such as quartz glass or blue plate glass, various ceramics substrate such as alumina, the above-mentioned substrates on which an insulating layer with material of, for example, $SiO_2$ is stacked, etc.

Also, the element electrodes 1102 and 1103 which are disposed on the substrate 1011 and face each other in parallel with the substrate surface are made of electrically conductive material. For example, the material of the element electrodes 1102 and 1103 is appropriately selected from the material consisting of, for example, metal such as Ni, Cr, Au, Mo, W, Pt, Ti, Cu, Pd or Ag, or alloy of those metal, metal oxide such as $In_2O_3$—$SnO_2$, or semiconductor material such as polysilicon. The formation of the element electrodes 1102 and 1103 can be readily achieved by using the combination of, for example, the film forming technique such as vapor evaporation with the patterning technique such as photolithography or etching. However, those element electrodes 1102 and 1103 may be formed by using other methods (for example, printing technique).

The configuration of the element electrodes 1102 and 1103 can be appropriately designed in accordance with the applied purpose of the electron emission element. In general, the electrode interval L is designed by selecting an appropriate numeral value usually from a range of from several hundreds [Å] to several hundreds $\mu$m. Among them, the range preferred for applying the electron emission element to the image display device is several $\mu$m to several tens $\mu$m. Also, the thickness d of the element electrode is usually selected from an appropriate numeral value of a range of from several hundreds [Å] to several $\mu$m.

Also, the fine particle film is used on a portion of the electrically conductive thin film 1104. The fine particle film described here means a film containing a large number of fine particles as the structural element (also containing the assembly of islands). When investigating the fine particle film microscopically, there are usually observed a structure in which the respective fine particles are isolated from each other, a structure in which the respective fine particles are adjacent to each other, or a structure in which the respective fine particles are overlapped with each other.

The diameter of the fine particles used in the fine particle film is in a range of from several [Å] to several thousands [Å], and more preferably in a range of from 10 [Å] to 200 [Å]. Also, the thickness of the fine particle film is appropriately set taking the various conditions stated below into consideration. That is, the various conditions are a condition required for electrically satisfactorily connecting the fine particle film to the element electrodes 1102 or 1103, a condition required for satisfactorily conducting the energization forming which will be described later, a condition required for setting the electric resistance of the fine particle film per se to an appropriate value which will be described later, etc. Specifically, the electric resistance is selected in a range of from several [Å] to several thousands [Å], and most preferably in a range of from 10 [Å] to 500 [Å].

Also, the material used for forming the fine particle film may be, for example, metal such as Pd, Pt, Ru, Ag, Au, Ti, In, Cu, Cr, Fe, Zn, Sn, Ta, W, or Pd, oxide such as PdO, $SnO_2$, $In_2O_3$, PbO, or $Sb_2O$, boride such as $HfB_2$, $ZrB_2$, $LaB_6$, $CeB_6$, $YB_4$ or $GdB_4$, carbide such as TiC, ZrC, HfC, TaC, SiC or WC, nitride such as TiN, ZrN or HfN, semiconductor such as Si or Ge, and carbon, from which an appropriate material is selected.

As described above, the electrically conductive thin film 1104 is formed of the fine particle film, and its sheet resistance is set in a range of $10^3$ to $10^7$ [Ω/□].

Because it is desirable that the electrically conductive thin film 1104 and the element electrodes 1102, 1103 are electrically satisfactorily connected to each other, portions of the respective members are superimposed on each other. The superimposing manner is that in the example of FIG. 13, where the substrate, the element electrodes, and the electrically conductive thin film are stacked on each other in the stated order from the bottom, but depending on the occasion, the substrate, the electrically conductive thin film and the element electrodes may be stacked on each other in the stated order from the bottom.

Also, the electron emission portion 1105 is a crack portion formed on a portion of the electrically conductive thin film 1104 and electrically has a higher resistant property than the electrically conductive thin film. The crack is formed by conducting the energization forming process which will be described later with respect to the electrically conductive thin film 1104. There is a case in which the fine particles several [Å] to several hundreds [Å] in particle diameter are disposed within the crack. Because it is difficult to show the position and the configuration of the actual electron emission portion with precision and accuracy in the figure, it is schematically shown in FIG. 13.

Also, the thin film 1113 a thin film made of carbon or carbon compound and coats the electron emission portion 1105 and its vicinity. The thin film 1113 is formed by conducting the energization activating process which will be described later after the energization forming process.

The thin film 1113 is made of any one of mono-crystal graphite, poly-crystal graphite and amorphous carbon, or the mixture thereof, and the thickness is set to 500 [Å] or less, and more preferably set to 300 [Å] or less. Because it is difficult to show the position and the configuration of the actual thin film 1113 with precision in the figure, it is schematically shown in FIG. 13.

Also, the plan view of FIGS. 13(*a*) shows an element from which a part of the thin film 1113 (the upper layer portion of 1105) is removed.

The above description is given of the basic structure of the preferred element, and a specific structure will be described below.

That is, the substrate 1101 is made of blue plate glass, and the element electrodes 1102 and 1103 are formed of Ni thin films. The thickness d of the element electrodes 1102 and 1103 is 1000 [Å], and the electrode interval L is 2 [μm].

As the main material of the fine particle film, Pd or PdO is used and the thickness of the fine particle frame is about 100 [Å] and the width is 100 [μm].

Figure 18:
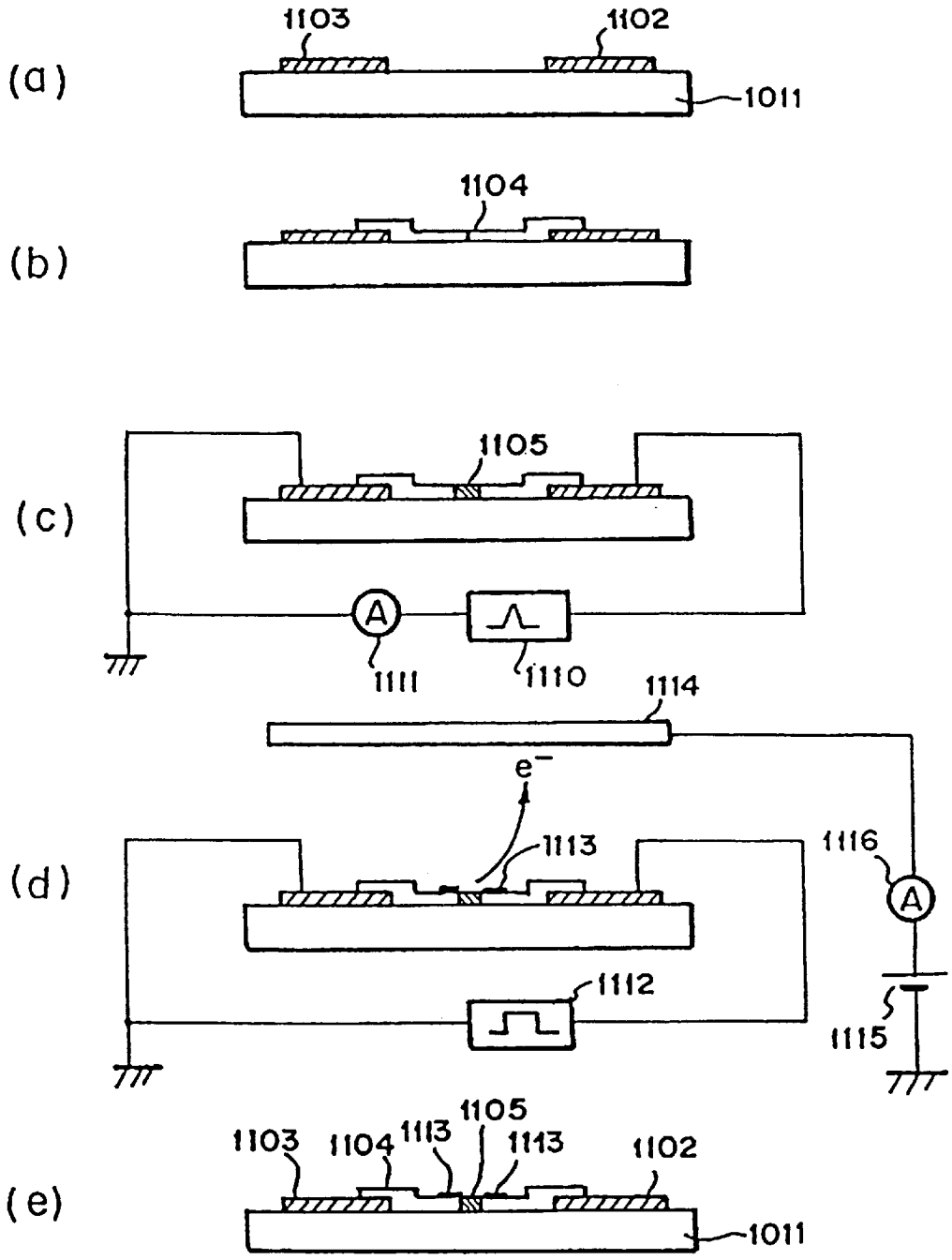
FIG. 18 is a cross-sectional view showing a process of manufacturing a plane-type surface conduction type electron emission element.

Subsequently, a description will be given of a method of manufacturing the preferred plane type surface conduction type electron emission element. FIGS. 18(*a*) to 18(*e*) are cross-sectional views for explanation of a process of manufacturing the surface conduction type electron emission element, and the references of the respective members are identical with those in FIG. 13.

1) First, as shown in FIG. 18(*a*) the element electrode 1102 and 1103 are formed on the substrate 1011.

In formation of the element electrode 1102 and 1103, the substrate 1011 has been sufficiently cleaned by using a detergent, pure water and organic solvent in advance, and the material of the element electrodes are deposited. As a depositing method, for example, a vacuum film forming technique such as the vapor evaporation method or the sputtering method may be used. Thereafter, the deposited electrode material is patterned by using the photolithography and etching technique to form a pair of element electrodes 1102 and 1103 shown in FIG. 18(*a*).

2) Then, as shown in FIG. 18(*b*), the electrically conductive thin film 1104 is formed.

In formation of the electrically conductive thin film 1104, after an organic metal solvent is coated on the substrate shown in the above FIG. 18(*a*), it is dried. After a heat baking process is conducted to form the fine particle film, the film is patterned in a given configuration by the photolithography etching. In this example, the organic metal solvent is directed to a solution of the organic metal compound which contains as the main element the material of the fine particles used for the electrically conductive thin film. Specifically, the main elements in this embodiment is Pd. Also, in this embodiment, as a coating method, the dipping method is used, however, other methods such as a spinner method or a spray method may also be used.

Also, as a method of forming the electrically conductive thin film 1104 formed of the fine particle film, there is a case of using, for example, a vapor evaporation method, a sputtering method, or a chemical gas phase depositing method, other than the organic metal solution coating method used in this embodiment.

3) Then, as shown in FIG. 18(*c*), an appropriate voltage is applied between the element electrodes 1102 and 1103 from the forming power supply 1110 to conduct the energization forming, thus forming the electron emission portion 1105.

The energization forming process means a process in which energization is conducted on the electrically conductive thin film 1104 formed of the fine particle film to appropriately destroy, deform or affect a part of the electrically conductive film 1104 into a structure suitable for conducting electron emission. In a portion which is changed into the preferred structure for conducting the electron emission among the electrically conductive thin film formed of the fine particle film (that is, the electron emission portion 1105), an appropriate crack is formed in the thin film. As compared with the electron emission portion 1105 before formation, the electric resistance measured between the element electrodes 1102 and 1103 greatly increases after the electron emission portion 1105 has been formed.

Figure 19:
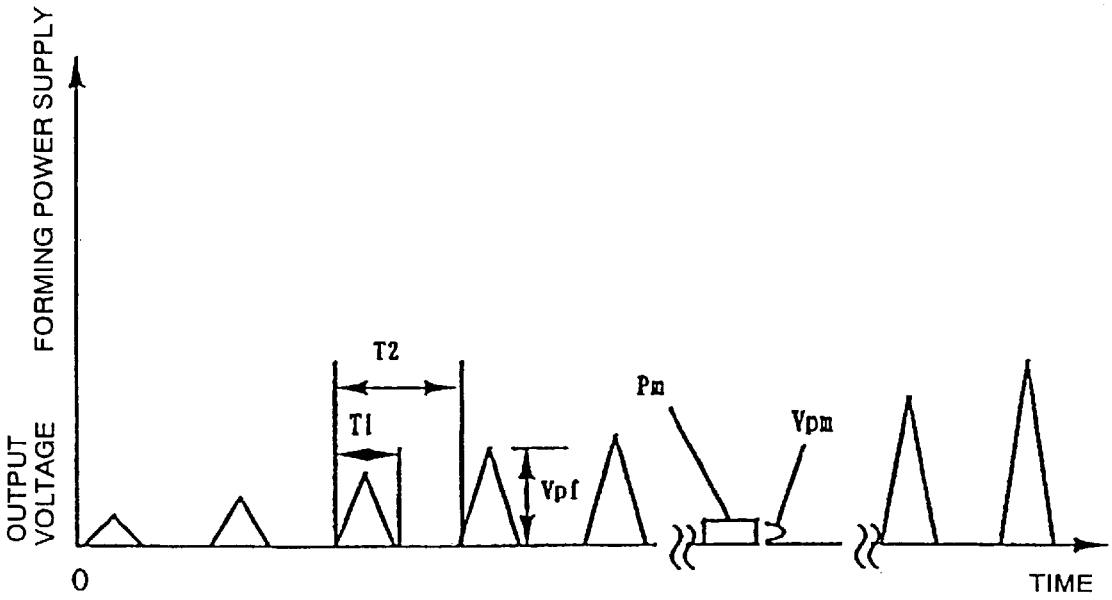
FIG. 19 is a graph showing a supply voltage waveform during an energization forming process.

In order to describe the energizing method in more detail, FIG. 19 shows an example of an appropriate voltage waveform which is applied from the forming power supply 1110. In the case where the electrically conductive thin film 1104 formed of the fine particle film is formed, a pulse voltage is preferable, and in case of this embodiment, as shown in the figure, chopping pulses each having a pulse width T1 is continuously applied at a pulse interval T2. In this situation, a peak value Vpf of the chopping pulse sequentially stepped up. Also, a monitor pulse Pm for monitoring the forming state of the electron emission portion 1105 is inserted between the chopping pulses at an appropriate interval, and a current that flows in this state was measured by an ammeter 1111.

In this embodiment, under the vacuum atmosphere of, for example, about $10^{-5}$ [Torr], for example, the pulse width T1 is 1 [msec], the pulse interval T2 is 10 [msec], and the peak value Vpf steps up 0.1 [V] every 1 pulse. Then, one monitor pulse Pm was inserted between the chopping pulses every time 5 chopping pulses are applied. The voltage Vpm of the monitor pulse was set to 0.1 [V] so that the forming process was not adversely affected. Then, at a state where the electric resistance between the element electrodes 1102 and 1103 was $1\times10^6$ [Ω], that is, at a stage where the current measured by the ammeter 1111 was $1\times10^{-7}$ [Å] or less under application of monitor pulse, the energization for the forming process was terminated.

In the above method, there is a preferable method pertaining to the surface conduction type electron emission element according to this embodiment, for example, in the case where the design of the surface conduction type electron emission element such as the material and the thickness of the fine particle film, the element electrode interval L, etc., are changed, it is desirable to change the conditions of the energization in accordance with the change of design.

4) Then, as shown in FIG. 18(*d*), an appropriate voltage is applied between the element electrodes 1102 and 1103 by using the activation power supply 1112 to conduct the energization activating process, thus improving the electron emission characteristic.

The energization activating process is directed to a process in which the electron emission portion 1105 formed through the above energization forming process is electrified under an appropriate condition to deposit carbon or carbon compound in the vicinity of the electron emission portion 1105 (in the figure, an accumulation made of carbon or carbon compound is schematically shown as the member 1113). The emission current at the same supply voltage can increase typically 100 times or more through the energization activating process as compared with a case in which the energization activating process is not yet conducted.

Specifically, the voltage pulses are periodically applied under the vacuum atmosphere within a range of $10^{-5}$ to $10^{-4}$ [Torr] to deposit carbon or carbon compound derived from the organic compound existing in the vacuum atmosphere. The accumulation 1113 is made of any one of mono-crystal graphite, poly-crystal graphite, and amorphous carbon, or the mixture thereof, and the thickness is set to 500 [Å] or less, and more preferably set to 300 [Å] or less.

Figure 20:
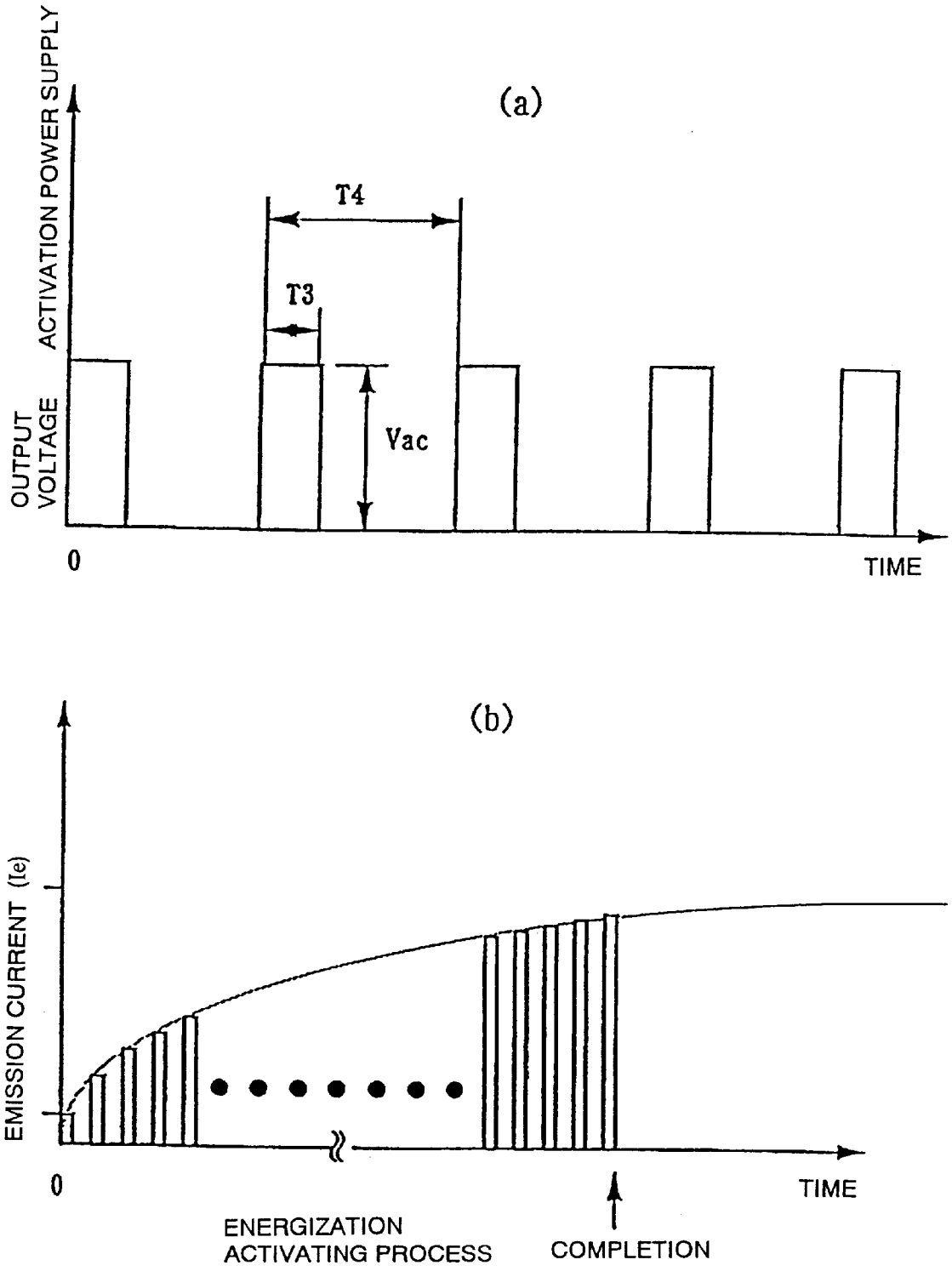
FIG. 20(*a*) is a graph a supply voltage waveform during an energization activating process.

In order to describe the energizing method in more detail, FIG. 20(*a*) shows an example of the appropriate voltage waveform which is applied from the activation power supply 1112. In this embodiment, a rectangular wave of a constant voltage is periodically applied to conduct the energization activating process. Specifically, the voltage Vac of the rectangular wave is set to 14 [V], the pulse width T3 was set at 1 [msec], and the pulse interval T4 is set to 10 [msec]. The above-described energizing conditions are preferable conditions pertaining to the surface conduction type electron emission element according to this embodiment, and in the case where the design of the surface conduction type electron emission element is changed, it is desirable to appropriately change the conditions in accordance with the change of the design.

Reference numeral 1114 shown in FIG. 18(*d*) is an anode electrode for catching the emission current Ie emitted from the surface conduction type electron emission element, and a d.c. high voltage power supply 1115 and the current ammeter 116 are connected (in the case where the substrate 1011 is assembled into the display panel to conduct the activating process, the fluorescent surface of the display panel is used as the anode electrode 1114). The emission current Ie is measured by the ammeter 1116 while a voltage is applied from the activation power supply 1112, and the progress state of the energization activating process is monitored, to control the operation of the activation power supply 1112. An example of the emission current Ie measured by the ammeter 1116 is shown in FIG. 20(*b*). When a pulse voltage starts to be applied from the activation power supply 1112, the emission current Ie increases with time but thereafter is saturated so as not to substantially increase. In this way, at a time point where the emission current Ie is substantially saturated, the voltage supply from the activation power supply 1112 stops to complete the energization activating process.

The above-described energizing conditions are preferable conditions pertaining to the surface conduction type electron emission element according to this embodiment, and in the case where the design of the surface conduction type electron emission element is changed, it is desirable to appropriately change the conditions in accordance with the change of the design.

In the above-mentioned manner, the plane type surface conduction type electron emission element according to this embodiment as shown in FIG. 18(*e*) is manufactured.

[Vertical Type Surface Conduction Type Electron Emission Element]

Subsequently, another representative structure of the surface conduction type electron emission element in which the electron emission portion or its peripheral portion is formed of the fine particle film, that is, the structure of the vertical type surface conduction type electron emission element, will be described.

Figure 21:
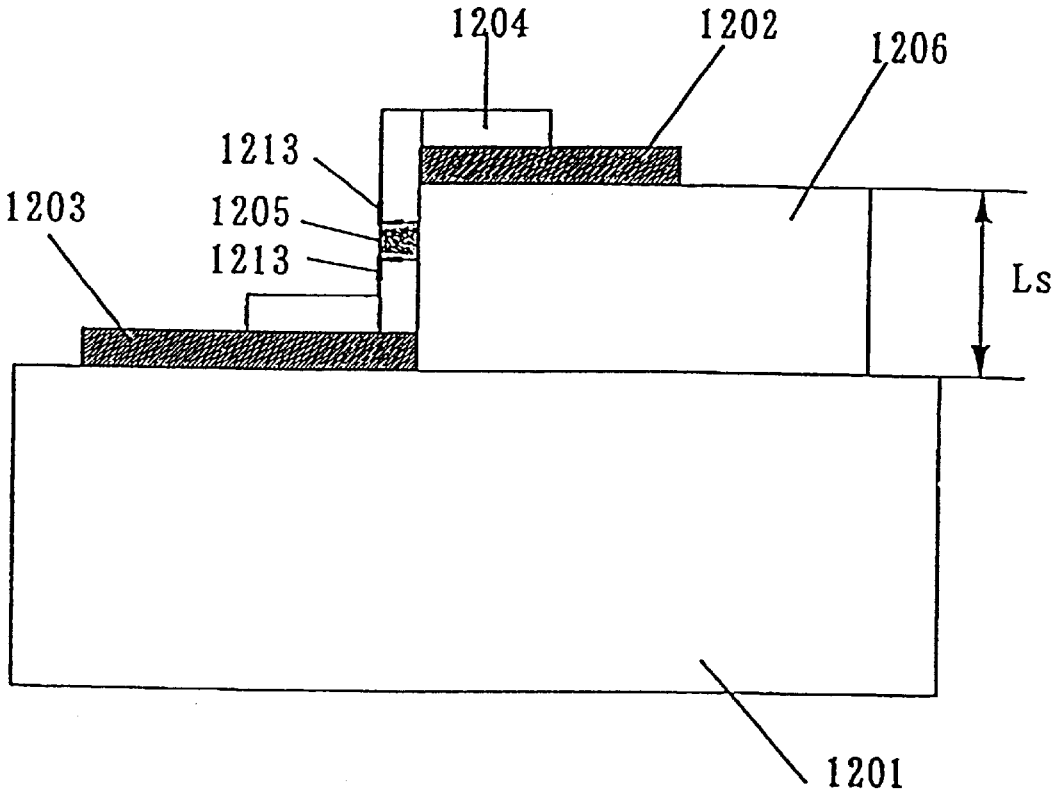
FIG. 21 is a cross-sectional view showing a vertical type surface conduction type electron emission element used in the embodiment of the present invention.

FIG. 21 is a schematic cross-sectional view for explaining the basic structure of the vertical type, and in the figure, reference numeral 1201 denotes a substrate, 1202 and 1203 are element electrodes, 1206 is a step forming member, 1204 is an electrically conductive thin film formed of the fine particle film, 1205 is an electron emission portion formed through the energization forming process, and 1213 is a thin film formed through the energization activating process.

Differences of the vertical type from the plane type described in the above reside in that one of the element electrodes (1202) is disposed on the step forming member 1206, and the electrically conductive thin film 1204 is coated on the side surface of the step forming member 1206. Accordingly, the element electrode interval L in the plane type shown in the above FIG. 13 is set as a step height Ls of the step forming member 1206 in the vertical type. In the substrate 1201, the element electrodes 1202, 1203, and the electrically conductive thin film 1204 formed of the fine particle film, the same materials as those described in the above plane type can be similarly used. Also, the step forming member 1206 is made of an electrically insulating material, for example, such as $SiO_2$.

Figure 22:
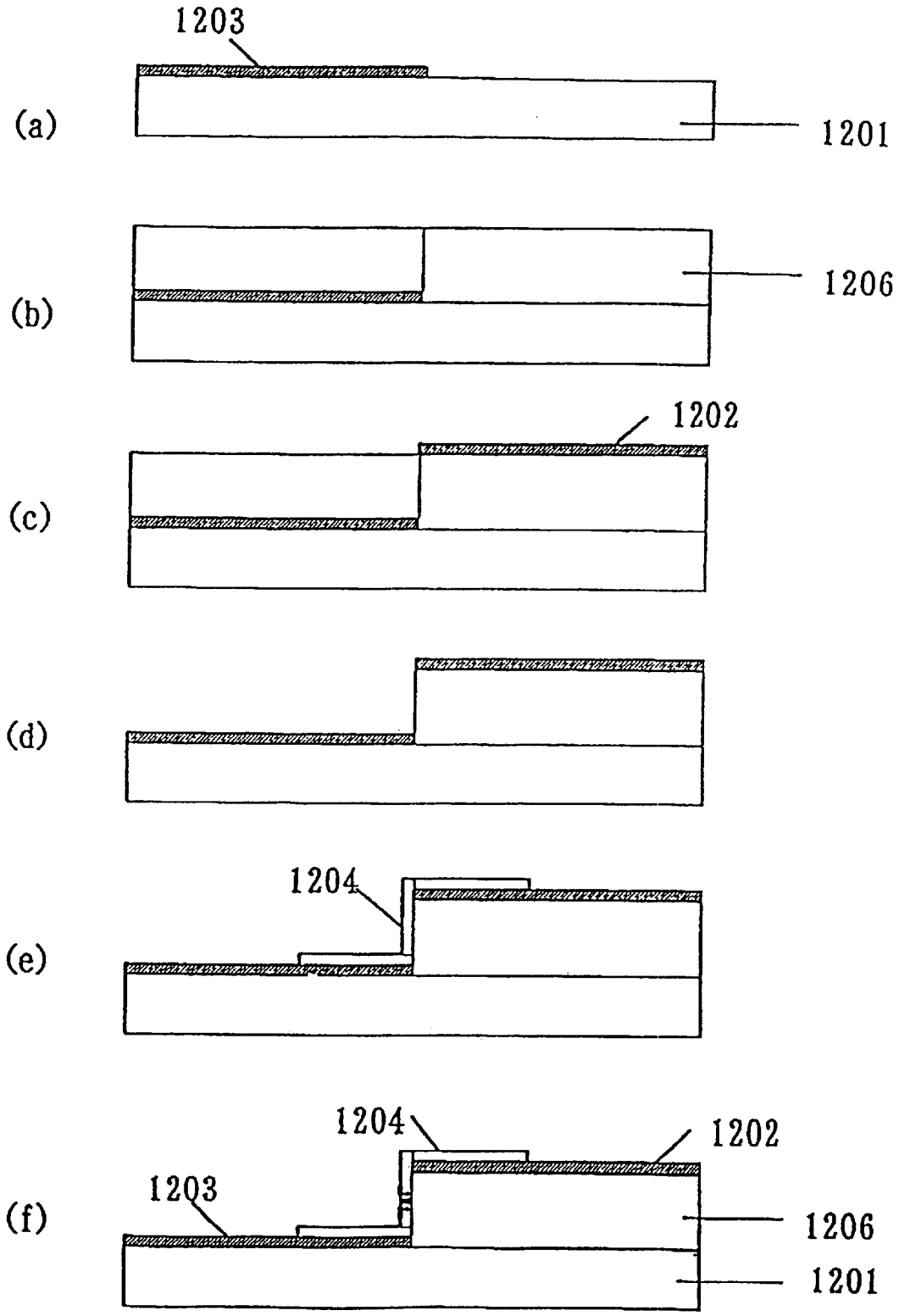
FIG. 22 is a cross-sectional view showing a process of manufacturing the vertical-type surface conduction type electron emission element.

Subsequently, a method of manufacturing the vertical type surface conduction type electron emission element will be described. FIGS. 22(*a*) to 22(*f*) are cross-sectional views for explaining of the manufacturing process, and the references of the respective members are identical with those in FIG. 21.

1) First, as shown in FIG. 22(*a*), the element electrode 1203 is formed on the substrate 1201.
2) Subsequently, as shown in FIG. 22(*b*), an insulating layer for forming the step forming member is stacked. The insulating layer may be formed by stacking, for example, $SiO_2$ through the sputtering method, however, other film forming method such a vapor evaporation method or a printing method may be used.
3) Then, as shown in FIG. 22(*c*), the element electrode 1202 is formed on the insulating layer.
4) Then, as shown in FIG. 22(*d*), a part of the insulating layer is removed by using, for example, the etching method to expose the element electrode 1203.

5) Then, as shown in FIG. 22(*e*), the electrically conductive thin film 1204 formed using the fine particle film is formed. In the formation, a film forming technique, for example, such as a coating method may be used similarly as in the above plane type.
6) Then, the energization forming process is conducted to form the electron emission portion as in the above plane type (the same process as that of the plane type energization forming process described with reference to FIG. 18(*c*) may be conducted.)
7) Then, the energization activating process is conducted to deposit carbon or carbon compound in the vicinity of the electron emission portion as in the above plane type (the same process as that of the plane type energization activating process described with reference to FIG. 18(*d*) may be conducted.)

In the above-mentioned manner, the vertical type surface conduction type electron emission element shown in FIG. 22(*f*) was manufactured.

[Characteristic of Surface Conduction Type Electron Emission Element Used in Image Display Device]

The above description is given of the element structures and the manufacturing methods of the plane type and vertical type surface conduction type electron emission element. Subsequently, the characteristic of the element used in the image display device will be described.

Figure 23:
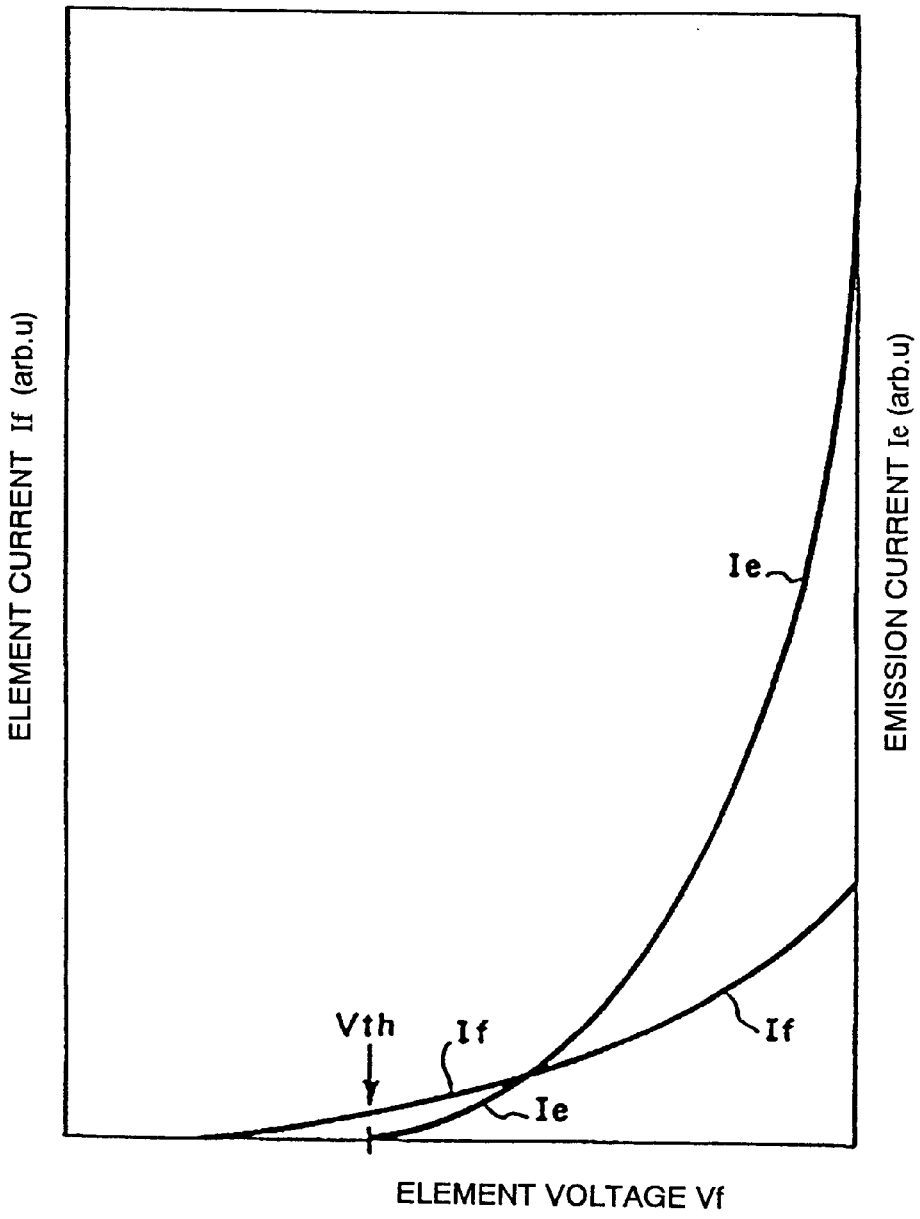
FIG. 23 is a graph showing a typical characteristic of the surface conduction type electron emission element used in the embodiment of the present invention.

FIG. 23 shows a typical example of the emission current Ie to element supply voltage Vf characteristic, and the element current If to the element supply voltage Vf characteristic in the element used in the image display device. Since the emission current Ie is remarkably small as compared with the element current If, it is difficult to show the emission current Ie by the same unit, and those characteristics are changed by changing the design parameters such as the size or configuration of the element. Therefore, those two characteristics are exhibited by arbitrary units, respectively.

The element used in the image display device has the following three characteristics related to the emission current Ie.

First, when a voltage of a given voltage or more (called "threshold voltage Vth") is applied to the element, the emission current Ie rapidly increases. On the other hand, when the voltage is lower than the threshold voltage Vth, the emission current Ie is hardly detected.

In other words, it is a non-linear element having a definite threshold voltage Vth with respect to the emission current Ie.

Second, because the emission current Ie changes depending on the voltage Vf applied to the element, the amplitude of the emission current Ie can be controlled by the voltage Vf.

Thirdly, because a response speed of the current Ie emitted from the element with respect to the voltage Vf applied to the element is high, the amount of charges of electrons emitted from the element can be controlled by the length of a period of time during which the voltage Vf is applied.

Because the above-mentioned characteristics are provided, the surface conduction type electron emission element can be preferably used in the image display device. For example, in the image display device in which a large number of elements are disposed in correspondence with the pixels of the display screen, the display screen can be sequentially scanned and displayed by using the first characteristic. In other words, a voltage of the threshold voltage Vth or higher is appropriately applied to the driving element in response to the desired light emitting luminance, and a voltage lower than the threshold voltage Vth is applied to a non-selected state element. When the driving element is sequentially changed over, the display screen can be sequentially scanned and displayed.

Also, because the light emitting luminance can be controlled by using the second characteristic or the third characteristic, the graduation display can be displayed.

[Drive Circuit Structure (and Driving Method)]

Figure 24:
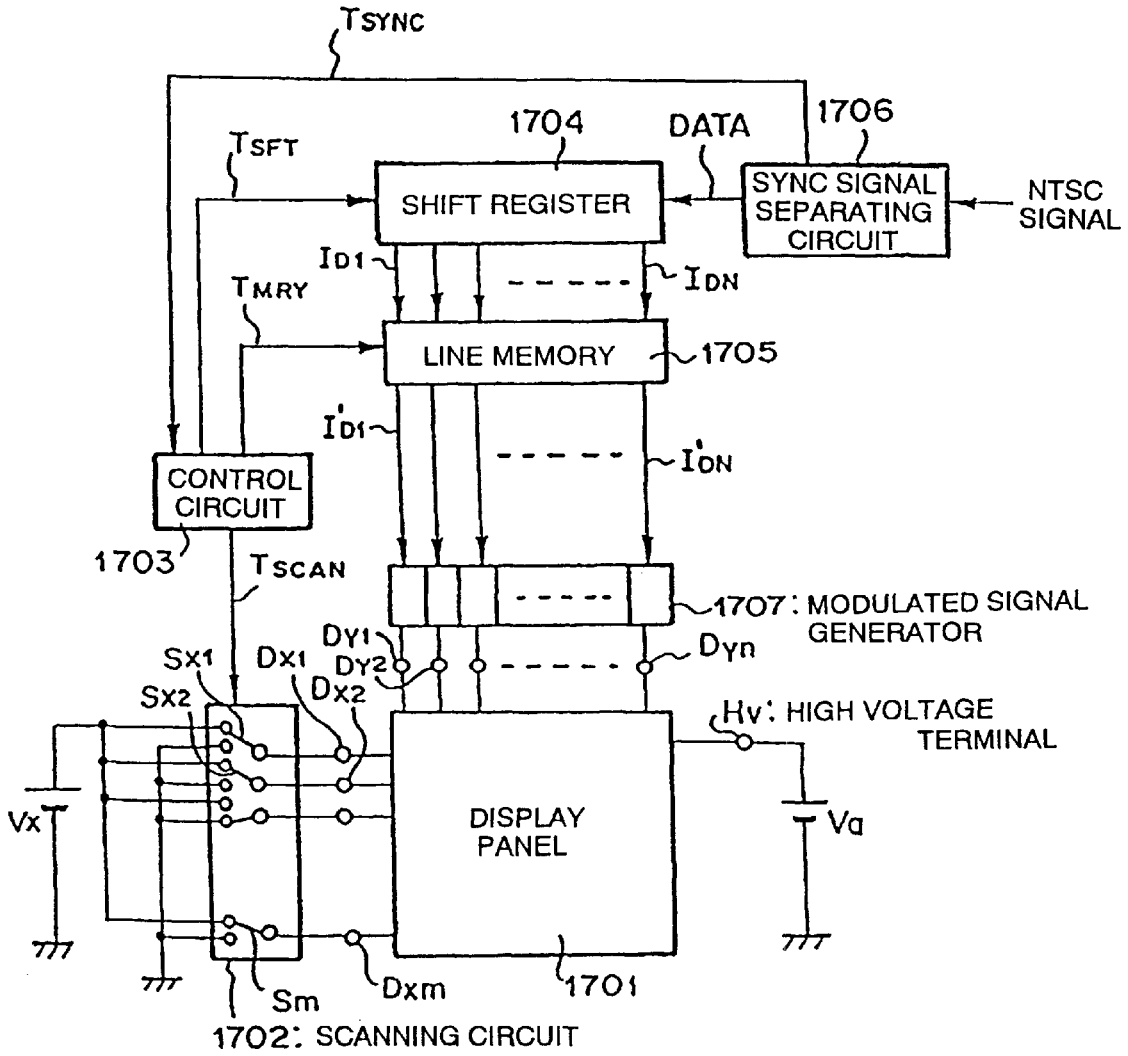
FIG. 24 is a block diagram showing the rough structure of a drive circuit of an image display device in accordance with the embodiment of the present invention.

FIG. 24 is a block diagram showing the rough structure of a drive circuit for an television display on the basis of a television signal of the NTSC system. In the figure, a display panel 1701 corresponds to the above-described display panel, which is manufactured and operates as described above. Also, a scanning circuit 1702 scans the display line, and a control circuit 1703 produces a signal, etc. inputted to the scanning circuit 1702. A shift register 1704 shifts data for one line, and a line memory 1705 outputs data for one line from the shift register 1704 to a modulated signal generator 1707. A synchronous signal separating circuit 1706 separates a synchronous signal from the NTSC signal.

Hereinafter, the functions of the respective portions in the device shown in FIG. 24 will be described in more detail.

First, the display panel 1701 is connected to an external electric circuit through terminals Dx1 to Dxm, Dy1 to Dyn and a high voltage terminal Hv. To the terminals Dx1 to Dxm is applied a scanning signal for sequentially driving the multiple beam source disposed within the display panel 1701, that is, the cold cathode elements which are wired in a matrix of m rows×n columns for each row (n pixels). On the other hand, to the terminals Dy1 to Dyn is applied a modulated signal for controlling the output electron beams of the respective n elements for one row which is selected by the above scanning signal. Also, to the high voltage terminal Hv is applied a d.c. voltage of, for example, 5 [kV] from the d.c. voltage source Va. This is an accelerating voltage for giving sufficient energy for exciting the phosphors to the electron beam outputted from the multiple electron beam source.

Then, the scanning circuit 1702 will be described. The circuit includes m switching elements (in the figure, schematically represented by S1 to Sm) therein, and the respective switching elements select any one of the output voltage of the d.c. voltage source Vx and 0 [V] (ground level) and are electrically connected to the terminals Dx1 to Dxm of the display panel 1701.

The respective switching elements of S1 to Sm operate on the basis of a control signal Tscan outputted from the control circuit 1703, and in fact, can be readily structured by the combination of the switching elements such as FETS. The above d.c. voltage source Vx is so set as to output a constant voltage so that the drive voltage applied to the element not scanned becomes the electron emission threshold voltage Vth or lower on the basis of the characteristic of the electron emission element exemplified in FIG. 23.

The control circuit 1703 matches the operation of the respective portions so that appropriate display is conducted on the basis of an image signal inputted from the external. The respective control signals of Tscan, Tsft, and Tmry are produced to the respective portions, on the basis of the synchronous signal Tsync transmitted from the synchronous signal separating circuit 1706 which will be described next. The synchronous signal separating circuit 1706 is a circuit for separating a synchronous signal component and a luminance signal component from a television signal of the NTSC system which is inputted from the external. The synchronous signal separated from the synchronous signal separating circuit 1706 consists of a vertical synchronous signal and a horizontal synchronous signal as is well known, but shown as a Tsync signal for convenience of description. On the other hand, the luminance signal component of the image separated from the above television signal is represented by a DATA signal for convenience, and the signal is inputted to the shift register 1704.

The shift register 1704 serial to parallel converts the above DATA signal inputted in a serial manner in a time series for one line of the image, and operates on the basis of the control signal Tsft transmitted from the above control circuit 1703. In other words, the control signal Tsft can be also called "the shift clock of the shift register 1704. The data for one line of the image which is serial/parallel converted (corresponding to the drive data for n elements of the electron emission element) is outputted from the shift register 1704 as n signals of Id1 to Idn.

The line memory 1705 is a memory device for storing data for one line of the image for a required period of time, and appropriately stores the contents of Id1 to Idn in accordance with the control signal Tmry transmitted from the control circuit 1703. The stored contents are outputted as I'd1 to I'dn and then inputted to the modulated signal generator 1707.

The modulated signal generator 1707 is a signal source for appropriately driving and modulating the respective electron emission elements 1012 in correspondence with the above respective image data I'd1 to I'dn, and its output signal is supplied to the electron emission element 1015 within the display panel 1701 through the terminals Dy1 to Dyn.

As was described with reference to FIG. 23, the surface conduction type electron emission element according to the present invention has the following basic characteristics with respect to the emission current Ie. That is, the electron emission provides the definite threshold voltage Vth (8 [V] in the surface conduction type electron emission element according to an embodiment which will be described later), and the electrons are emitted only when a voltage of the threshold voltage Vth or higher is applied. Also, the emission current Ie also changes with respect to the voltage of the electron emission threshold value Vth or higher in correspondence with a change in voltage as shown in the graph of FIG. 23. From this fact, in the case where a pulse voltage is applied to the element, for example, even if a voltage of the electron emission threshold value Vth or lower is applied to the element, the electrons are not emitted. On the other hand, in the case where a voltage of the electron emission threshold value Vth or higher is applied to the element, the electron beam is outputted from the surface conduction type electron emission element. In this situation, it is possible to control the intensity of the output electron beam by changing the peak value Vm of the pulse. Also, it is possible to control the total amount of the charges of the outputted electron beam by changing the width Pw of the pulse.

Accordingly, as a system of modulating the electron emission element in response to an input signal, a voltage modulating system, a pulse width modulating system, etc., are applicable. In realizing the voltage modulating system, as the modulated signal generator 1707, there can be used a circuit of the voltage modulating system which generates a voltage pulse of a constant length, and appropriately modulates the peak value of the pulse in accordance with the inputted data. Also, in implementing the pulse width modulating system, as the modulated signal generator 1707, there can be used a circuit of the pulse width modulating system which generates a voltage pulse of a constant peak value and appropriately modulates the width of the voltage pulse in accordance with the inputted data.

The shift register 1704 and the line memory 1705 may be of the digital signal type or the analog signal type. Namely, this is because the serial to parallel conversion of the image signal and the storage may be conducted at a given speed.

In the case of using the digital signal system, it is necessary to convert the output signal DATA of the synchronous signal separating circuit 1706 into a digital signal. To satisfy this, an A/D convertor may be disposed on an output portion of the synchronous signal separating circuit 1706. In association with this, the circuit used in the modulated signal generator is slightly different depending on whether an output signal of the main memory 115 is a digital signal or an analog signal. In other words, in a case of the voltage modulating system using the digital signal, for example, a D/A converting circuit is used for the modulated signal generator 1707, and as necessary, an amplifying circuit is added. In a case of the pulse width modulating system, in the modulated signal generator 1707, there is a circuit that combines a high-speed oscillator, a counter that counts the number of waves outputted from the oscillator, and a comparator that compares an output value of the counter with an output value of the memory. As necessary, there can be added an amplifier for voltage-amplifying the modulated signal which is modulated in pulse width and outputted from the comparator up to the drive voltage of the electron emission element.

In a case of the voltage modulating system using the analog signal, for example, an amplifying circuit using an operational amplifier can be applied to the modulated signal generator 1707, and as necessary, a shift level circuit, etc., can be added. In a case of the pulse width modulating system, for example, a voltage control type oscillating circuit (VCO) can be applied, and as necessary, an amplifier for amplifying the voltage up to the drive voltage of the electron emission element can be added.

In the image display device thus structured to which the present invention can be applied, a voltage is applied to the respective electron emission elements through the container external terminals Dx1 to Dxm, and Dy1 to Dyn to emit the electrons. A high voltage is applied to the metal back 1019 or the transparent electrode (not shown) through a high voltage terminal Hv to accelerate the electron beam. The accelerated electrons collide with the fluorescent film 1018 and emit a light, to thereby form an image.

[Case of Ladder Type Electron Source]

Subsequently, a description will be given of the above-described ladder type arrangement electron source substrate and the image display device using the electron source substrate with reference to FIGS. 25 and 26.

Figure 25:
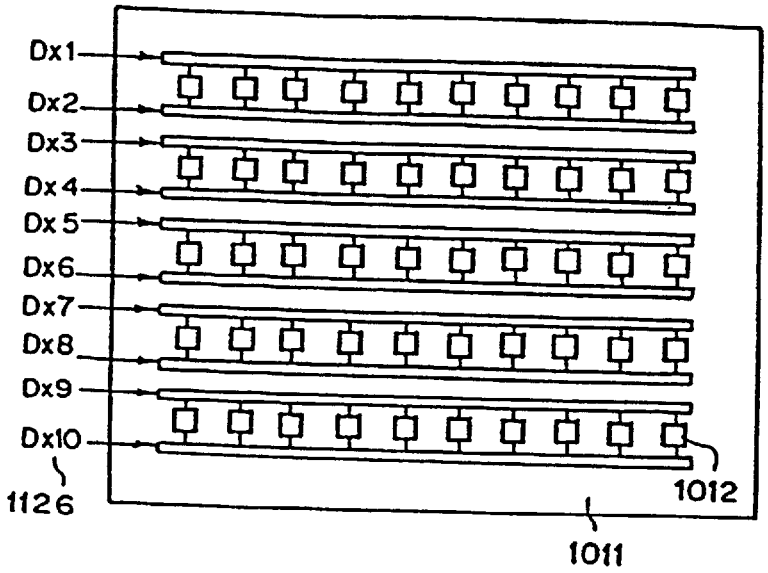
FIG. 25 is a schematic plan view showing an electron source of a ladder arrangement in accordance with an example of the present invention.

In FIG. 25, reference numeral 1011 denotes an electron source substrate, 1012 is an electron emission element, Dx1 to Dx10 of 1126 are common wirings connected to the above electron emission elements. A plurality of electron emission elements 1012 are disposed on the substrate 1011 in parallel with the X-direction (this is called element row). A plurality of element rows are disposed on the substrate to form a ladder type electron source substrate. A drive voltage is appropriately applied between the common wirings of the respective element rows, thereby enabling driving the respective element rows, independently. That is, an electron beam of the voltage of the electron threshold value or higher is applied to the element row that emits the electron beam whereas the voltage of the electron threshold value or lower is applied to the element row that does not emit the electron beam. Also, the common wirings Dx2 to Dx9 between the respective element rows may be structured such that, for example, Dx2 and Dx3 are the same wiring.

Figure 26:
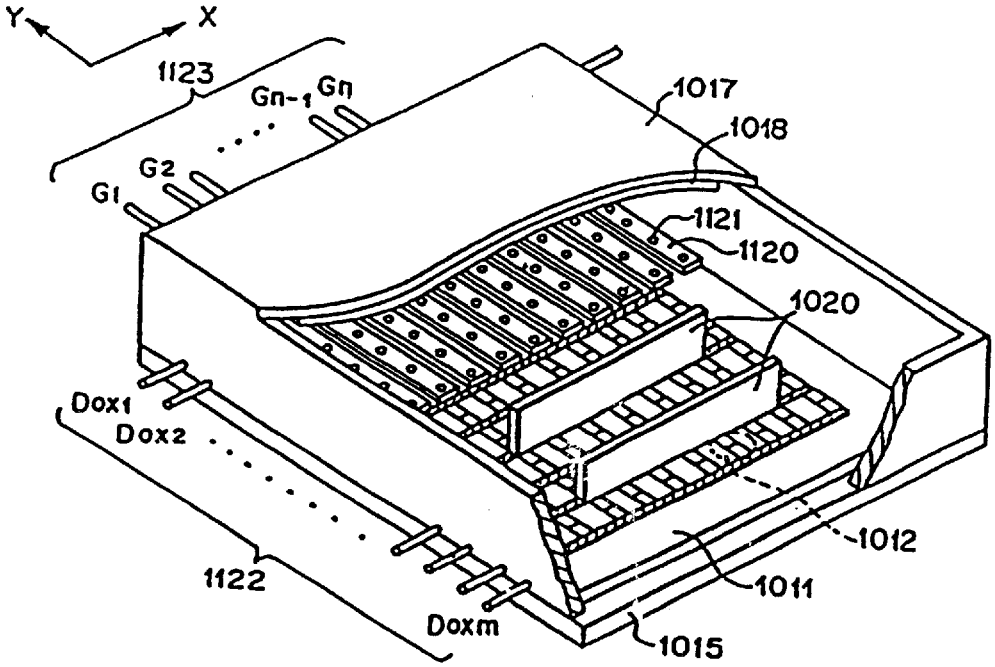
FIG. 26 is a perspective view showing a plane type image display device having the electron source of the ladder arrangement in accordance with an example of the present invention.
Figure 27:
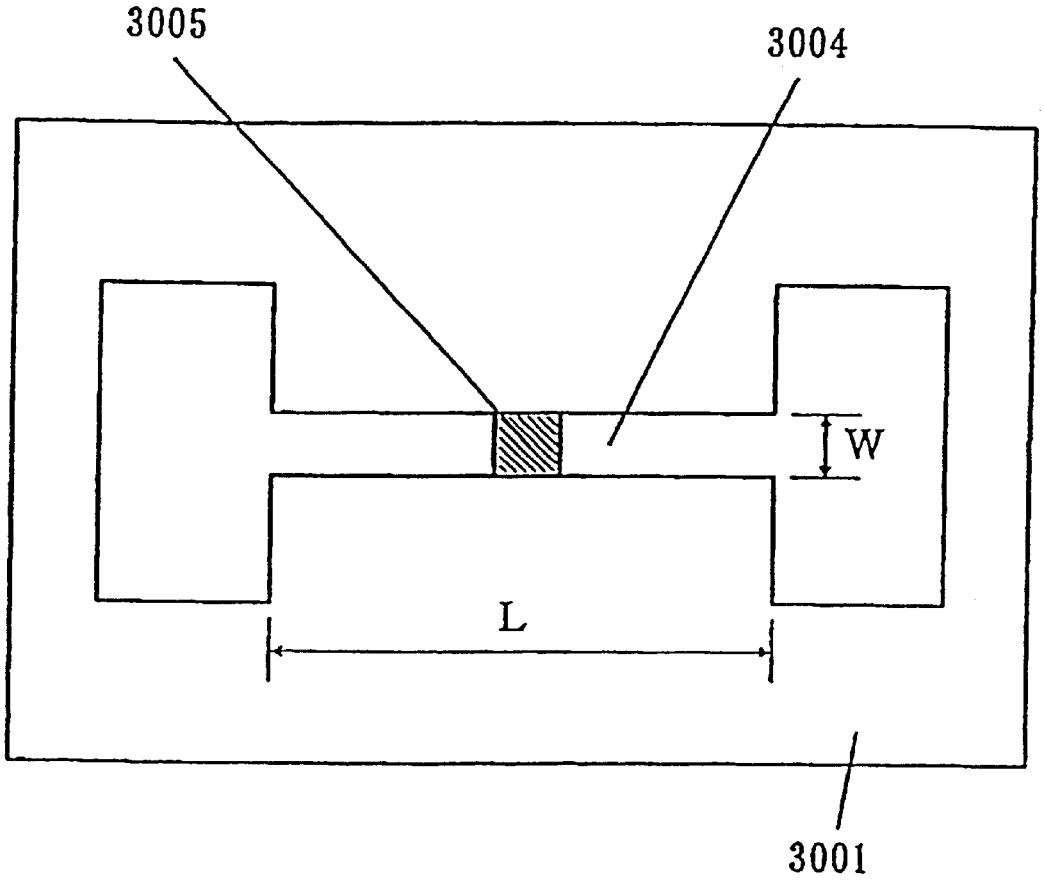
FIG. 27 is a diagram showing an example of the surface conduction type electron emission element.
Figure 28:
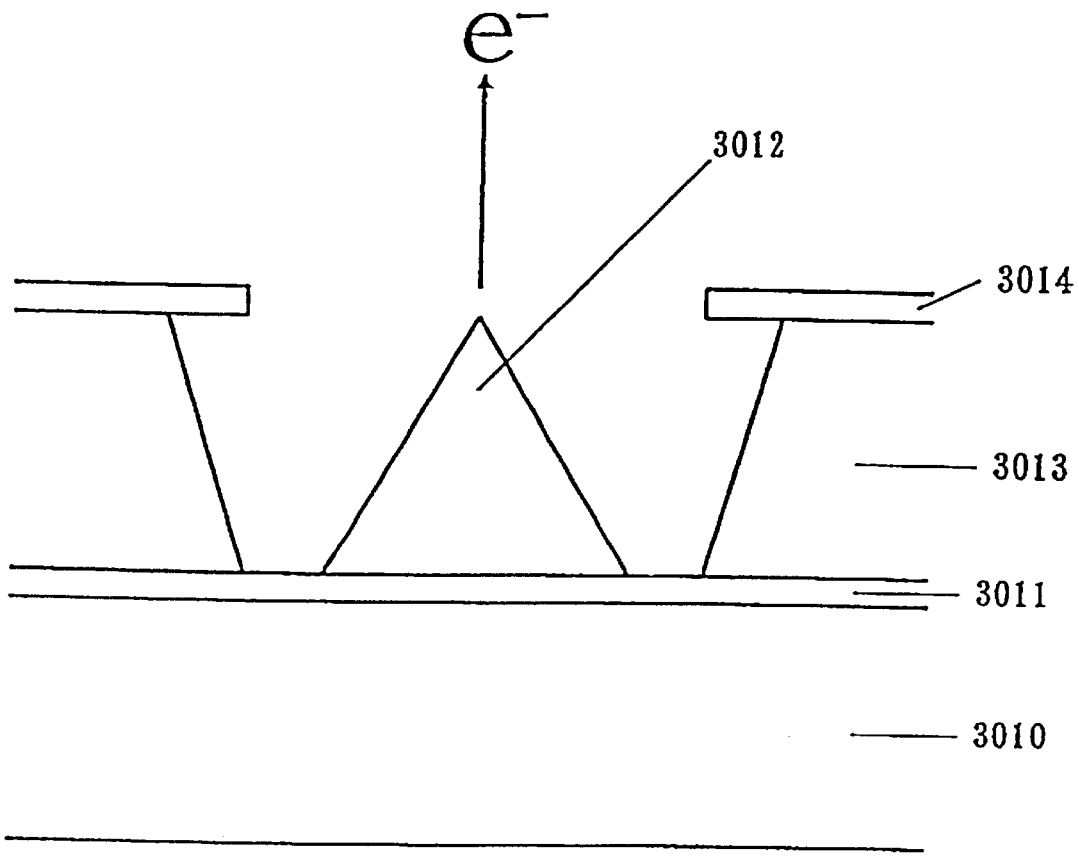
FIG. 28 is a diagram showing an example of an FE element.
Figure 29:
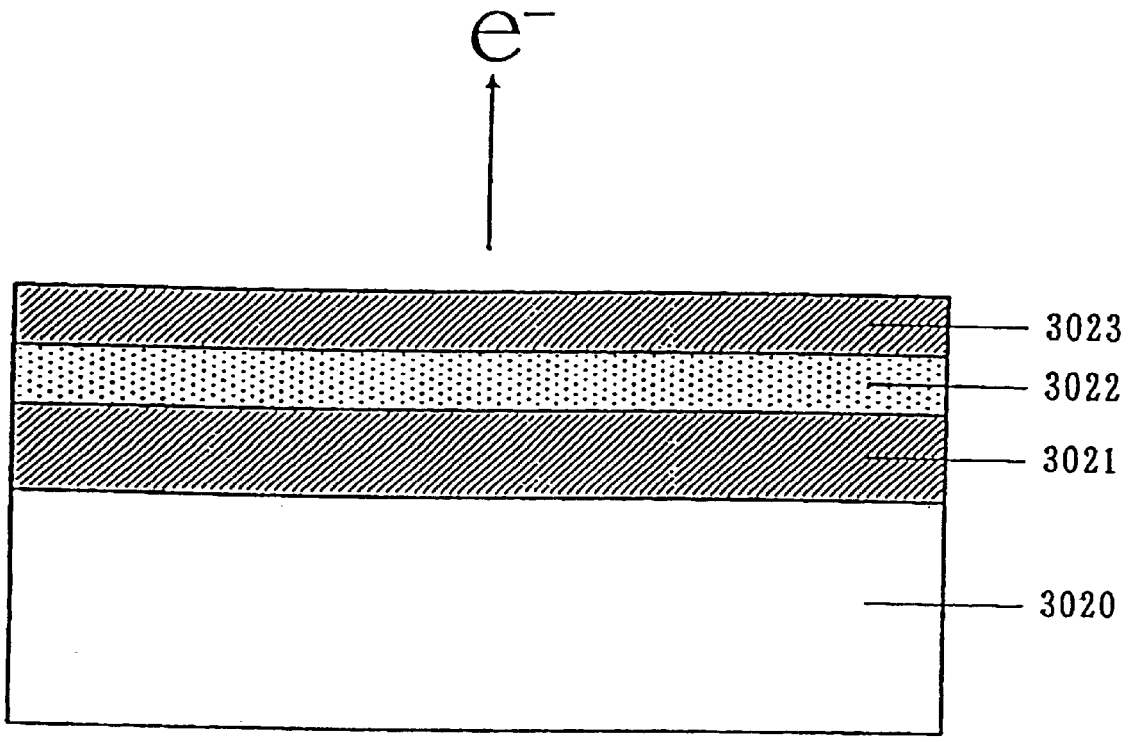
FIG. 29 is a diagram showing an example of an MIM element.

FIG. 26 is a view showing the structure of an image forming apparatus with a ladder type arrangement electron source. Reference numeral 1120 denotes a grid electrode, 1121 is holes through which the electrons pass, 1122 is container external terminals made up of $D_{ox}$1, $D_{ox}$2, . . . $D_{ox}$m, 1123 is container external terminals made up of G1, G2 . . . Gn which are connected to the grid electrode 1120, and 1011 is an electron source substrate where the common wirings between the respective element rows are the same wiring as described above. The same references as those in FIGS. 25 and 26 denote the same members. A difference of the image forming apparatus with a ladder type arrangement electron source from the image forming apparatus (FIG. 11) of the above-described simple matrix arrangement resides in that a grid electrode 1120 is disposed between the electron source substrate 1011 and the face plate 1017.

The above-described panel structure can provide a spacer 120 between the face plate 1017 and the rear plate 1015 as necessary in the structure of the atmosphere in any cases in which the electron source arrangement is of the matrix wiring or the ladder type arrangement.

The grid electrode 1120 is disposed in the center of the substrate 1011 and the face plate 1017. The grid electrode 1120 can modulate the electron beam emitted from the surface conduction type electron emission element, and provides one circular opening 1121 in correspondence with each of the elements in order to allow the electron beam to pass through the stripe electrode orthogonal to the element rows of the ladder type arrangement. The configuration and the located position of the grid need not always be arranged as shown in FIG. 26. A large number of through-holes may be formed in a mesh as the openings, and also may be disposed, for example, around or in the vicinity of the surface conduction type electron emission element.

The container external terminal 1122 and the grid container external terminal 1123 are electrically connected to the drive circuit shown in FIG. 24.

In the image forming apparatus of this embodiment, the modulated signal for one line of the image is applied to the grid electrode row at the same time in synchronism with the sequential drive (scanning) of the element rows every one row (one line), thereby enabling control of the irradiation of the respective electron beams onto the phosphors and display of the image every one line.

The structures of the above two image display devices are examples of the image forming apparatus to which the present invention is applicable, and various modifications can be conducted on the basis of the concept of the present invention. The input signal is of the NTSC system, but the input signal is not limited to this system. The PAL, SECAM system as well as the TV signal (high grade TV) system using a larger number of scanning lines can be also applied.

Also, according to the present invention, there can be provided not only the image display device of the television broadcast, but also an image forming apparatus suitable for the image display device of a television conference system, a computer, etc. In addition, the image display device is applicable as the optical printer made up of a photosensitive drum, etc.

Hereinafter, the present invention will be described in more detail with reference to embodiments.

In the following respective embodiments, as the multiple electron beam source, there is used the multiple electron beam source in which the above-described surface conduction type electron emission element of n×m (n=3072, m=1024) of the type having the electron emission portion on the electrically conductive fine particle film between the electrodes are wired in a matrix (refer to FIGS. 11 and 14) by m row-directional wirings and n column-directional wirings.

[Embodiment 1]

A spacer used in this embodiment was produced as follows:

A ceramic substrate into which zirconia and alumina were mixed with each other at the weight ratio of 65:35 so as to provide the same coefficient of thermal expansion as that of the soda lime glass substrate which was the same in quality as the rear plate was subjected to a grinding process so that its outer dimensions became 0.2 mm in thickness, 3 mm in height and 40 mm in length. The average value of the roughness of the surface was 100 [Å]. The substrate will be referred to as a0.

First, prior to a film forming process, after the above spacer substrate a0 was cleaned by ultrasonic waves in pure water, IpA and acetone for 3 minutes, and then dried at 80° C. for 30 minutes, it was subjected to UV ozone cleaning to remove the organic remaining material on the substrate surface.

In addition, fine particles of silica 1000 Å in average diameter of the particles (900 to 1100 Å in the distribution of 3σ) were previously dispersed in a metal alkoxide solution 6.0% in weight comprised of Ti:Si in a ratio of 1:1, and printing in the solution was conducted by using a solution extended plate 5 μm in roughness. Thereafter, pre-baking was conducted at 100° C. for about 10 minutes, UV irradiation was also conducted, and a heat baking process was conducted at 300° C. for about 1 hour. The thickness of a binder portion of the insulating film was set at 200 Å.

Thereafter, a target of Cr and Al was sputtered at a high frequency power supply as additional film that constitutes an antistatic film, to thereby form a high resistive film so that a Cr—Al alloy nitride film had a thickness of 200 Å in thickness. A sputtering gas was a mixture gas of Ar:$N_2$ at 1:2, and a total pressure was 1 mTorr.

The present invention is not limited to this, but various fine particle dispersion antistatic film can be used.

The resistance of the spacer in the film surface direction was R/□=8×$10^9$ Ω/□ in sheet resistance, and the first and second cross point energies of the secondary electron emission coefficient on a smooth film formed at the same time under the above conditions were 30 eV and 5 keV, respectively.

In addition, a low resistive film was formed in a region that formed a joint portion of the upper and lower substrate through the following method. A titanium film 10 nm in thickness and a Pt film 200 nm in thickness were formed on a band-like member 200 μm in parallel with the joint portion through a gas phase manner by sputtering. In this situation, the Ti film was required as an under layer that reinforces the film adhesion of the Pt film. Thus, a spacer 1020 with the low resistive film was obtained, which will be referred to as a spacer A. In this situation, the thickness of the low resistive film was 210 nm, and the sheet resistance was 10 [Ω/□].

A cross-sectional view of the spacer A thus obtained was shown in FIG. 1(*a*), and a cross-sectional view in the vicinity of the joint portion to which the low resistive film was given was one as shown in FIG. 1(*b*). In addition, a result of observing the substrate configuration in detail through a section TEM was one shown in FIG. 6, and the convex configuration of the uppermost surface in correspondence with the convex portion of the fine particles was recognized. The thickness of the binder portion was 400 Å, and the height of the convex portion was 1200 Å. Further, it was recognized that a Cr—Al alloy nitride film formed through sputtering goes around the convex portion and was covered on the convex portion.

The incident angle multiplication coefficient $m_0$ of the secondary electron emission coefficient of the spacer A was 5 with respect to the incident electron energy of 1 kV.

In this embodiment, a display panel in which the spacers 1020 shown in FIG. 11 described above were arranged was manufactured. Hereinafter, the details will be described with reference to FIGS. 11 and 12. First, the substrate 1011 on which the row-directional wiring electrodes 1013, the column-directional wiring electrodes 1014, the interelectrode insulating layers (not shown) and the element electrodes and the electrically conductive thin films of the surface conduction type emission elements 1012 were formed in advance was fixed onto the rear plate 1015. Then, the spacers A were fixed as the spacers 1020 onto the row-directional wirings 1013 of the substrate 1011 at regular intervals in parallel with the row-directional wirings 1013. Thereafter, the face plate 1017 on an inner surface of which the fluorescent film 1018 and the metal back 1019 were disposed was disposed 5 mm above the substrate 1011 through the side wall 1016, and the respective joint portions of the rear plate 1015, the face plate 1017, the side wall 1016 and the spacer 1020 were fixed. The joint portion of the substrate 1011 and the rear plate 1015, the joint portion of the rear plate 1015 and the side wall 1016, and the joint portion of the face plate 1017 and the side wall 1016 were coated with flit glass (not shown), and then baked at 400 to 500° C. in the atmosphere for 10 minutes or longer so that the respective joint portions were sealed with the flit glass. Also, the spacers 1020 were disposed on the row-directional wirings 1013 (line width 300 [μm]) at the substrate 1011 side and on the metal back 1019 surface at the face plate 1017 side, through the electrically conductive flit glass (not shown) which was mixed with an electrically conductive filler or an electrically conductive material such as metal, and then baked at 400 to 500° C. in the atmosphere for 10 minutes or longer while the hermetic container was sealed, to thus conduct adhesion and electric connection.

In this embodiment, the fluorescent film 1018 was shaped in such stripes that the phosphors 1301 of the respective colors extend in the row direction (Y-direction) as shown in FIG. 16(*a*), and the black electrically conductive material 1010 is formed of a fluorescent film which was so disposed as to separate not only between the respective phosphors (R, G, B) 1301, but also between the respective pixels in the Y-direction, and the spacers 1020 were disposed through the metal back 1019 within a region (line width 300 [μm]) which was in parallel with the row direction (X-direction) of the black electrically conductive material 1010. Because the respective phosphors 1301 and the respective elements 1013 disposed on the substrate 1011 must correspond to each other when the above-mentioned sealing is conducted, the rear plate 1015, the face plate 1017 and the spacer 1020 were sufficiently positioned.

After the gas was exhausted from the interior of the hermetic container thus completed through an exhaust tube (not shown) by a vacuum pump and the sufficient degree of vacuum was obtained, electricity was supplied to the respective elements 1013 through the row-directional wiring electrodes 1013 and the column-directional wiring electrodes 1014 via the container external terminals Dx1 to Dxm and Dy1 to Dyn to conduct the above-described energization forming process and energization activating process, thereby manufacturing the multiple electron beam source. Then, the exhaust tube not shown was heated by a gas burner at the degree of vacuum of about $10^{-6}$ [Torr] and melted to seal the envelope (hermetic container).

Finally, in order to maintain the degree of vacuum after sealing, a gettering process was conducted.

In the image display device using the display panel shown in FIGS. 11 and 12 which was completed in the above manner, a scanning signal and a modulated signal were supplied to the respective cold cathode elements (surface conduction type emission elements) 1012 through the container external terminals Dx1 to Dxm and Dy1 to Dyn by a signal generating means not shown, to thereby emit electrons. A high voltage was applied to the metal back 1019 through the high voltage terminal Hv, to thereby accelerate the emission electron beam, the electrons were permitted to collide with the fluorescent film 1018, and the phosphors 1301 of the respective colors (R, G and B in FIG. 16) were excited and emit the light, to thereby display an image. The applied voltage Va to the high voltage terminal Hv was applied in a range of from 3 to 12 [kV] till the limit voltage at which discharge gradually occurs, and the applied voltage Vf between the respective wirings 1013 and 1014 was set to 14 [V]. In the case where the continuous drive could be made for one hour or longer with the application of a voltage of 8 kV or higher to the high pressure terminal Hv, it was judged that a withstand voltage was excellent.

In this situation, the withstand voltage was excellent in the vicinity of the spacer A. In addition, light emission spot trains including the light emission spots caused by the emitted electrons from the cold cathode element 1012 at positions close to the spacers A were formed at regular intervals two-dimensionally, thereby being capable of displaying a color image visible and excellent in color reproducibility. This exhibits that even if the spacer A was located, the turbulence of the electric field which adversely affected the electron orbit did not occur.

[Embodiment 2]

The following glass substrate g0 was used as a spacer substrate, and a spacer having the concave and convex surface was manufactured in the same manner as that in the Embodiment 1.

As a low alkali glass substrate which was the same in quality as the rear plate, a prototype of PD200 made by Asahi Glass Corp., was subjected to a cutting process and a mirror grinding process so that its outer dimensions became 0.2 mm in thickness, 3 mm in height and 40 mm in length. The average value of the roughness of the surface at this time was 50 [Å]. The substrate will be referred to as g0. First, prior to a film forming process, after the above spacer substrate g0 was cleaned by ultrasonic waves in pure water, IpA and acetone for 3 minutes, and then dried at 80° C. for 30 minutes, it was subjected to UV ozone cleaning to remove the organic remaining material on the substrate surface.

In addition, as in Embodiment 1, fine particles of silica 650 Å in average diameter of the particles (500 to 800 Å in the distribution of 3σ) were previously dispersed in a metal alkoxide solution of 12.0 weight % containing the component of Ti:Si with the ratio of 1:1, and printing in the solution was conducted by using a solution extended plate 5 μm in roughness. Thereafter, pre-baking was conducted at 100° C. for about 10 minutes, UV irradiation was also conducted, and a heat baking process was conducted at 270° C. for about 1 hour. The thickness of a binder portion of the insulating film was set at 150 Å.

Thereafter, as in the Embodiment 1, a target of Cr and Al was further sputtered at a high frequency power supply as another film that constitutes an antistatic film, to thereby form a Cr—Al alloy nitride film 200 Å in thickness. A sputtering gas was a mixed gas of Ar:$N_2$ at 1:2, and the total pressure was 1 mTorr.

The resistance of the spacer in the film surface direction was R/□=8×$10^9$ Ω/□ in sheet resistance, and the first and second cross point energies of the secondary electron emission coefficient on the smooth film formed at the same time under the above conditions were 30 eV and 5 keV, respectively.

In addition, as in the Embodiment 1, a low resistive film was formed in a region that formed a joint portion of the upper and lower substrate through the following method. A titanium film 10 nm in thickness and a Pt film 200 nm in thickness were formed on a band-like member 200 $\mu$m, in parallel with the joint portion, both through a gas phase manner by sputtering. In this situation, the Ti film was required as an under layer that reinforces the film adhesion of the Pt film. Thus, a spacer 1020 with the low resistive film was obtained, and will be referred to as a spacer B. At this time, the thickness of the low resistive film was 210 nm, and the sheet resistance is 10 [Ω/□].

A cross-sectional view of the spacer B thus obtained formed the same surface as that in Embodiment 1, and the convex configuration of the uppermost surface in correspondence with the convex portion of the fine particles was recognized. At this time, the thickness of the binder portion was 350 Å, and the height of the convex portion was 850 Å. Further, it was confirmed that a Cr—Al alloy nitride film formed through sputtering went around the convex portion and continuously covered the side surface of the spacer.

Further, as in the Embodiment 1, a low resistive film was prepared through sputtering, and will be referred to as a spacer B. The incident angle multiplication coefficient $m_0$ of the secondary electron emission coefficient of the spacer B was 8.9 with respect to the incident electron energy of 1 kV.

In addition, as in the Embodiment 1, the electron beam emission device was prepared together with the rear plate assembled with the electron beam emission element, etc., and the application of a high voltage and the drive of the elements were conducted under the same condition as that in the Embodiment 1.

In this situation, the withstand voltage was excellent in the vicinity of the spacer B. In addition, light emission spot trains including the light emission spots caused by the emitted electrons from the cold cathode element 1012 at positions close to the spacers B were formed at regular intervals two-dimensionally, thereby enabling display of a color image that was visible and excellent in color reproducibility. This exhibited that even if the spacer B was located, the turbulence of the electric field which adversely affected the electron orbit did not occur.

[Embodiment 3]

The glass substrate g0 employed in the Embodiment 2 was used as a spacer substrate, and a spacer having the concave and convex surface was manufactured in the same manner as that in the Embodiment 1.

As in the Embodiment 1, first, prior to a film forming process, after the above spacer substrate g0 was cleaned by ultrasonic waves in pure water, IpA and acetone for 3 minutes, and then dried at 80° C. for 30 minutes, it was subjected to UV ozone cleaning to remove the organic remaining material on the substrate surface.

In addition, as in the Embodiment 1, fine particles of silica 650 Å in average diameter of the particles (500 to 800 Å in the distribution of 3σ) and tin oxide particles 50 Å in average diameter of the particles for enhancing the adhesion were previously dispersed in a metal alkoxide solution of 12.0 weight % containing the component of Ti:Si with the ratio of 1:1, and printing in the solution was conducted by using a solution extended plate 5 $\mu$m in roughness. Thereafter, pre-baking was conducted at 100° C. for about 10 minutes, UV irradiation was further conducted, and a heat baking process was conducted at 270° C. for about 1 hour. The thickness of a binder portion of the insulating film was set at 200 Å.

Thereafter, as in the Embodiment 1, a target of Cr and Al was further sputtered at a high frequency power supply as another film that constitutes an antistatic film, to thereby form a Cr—Al alloy nitride film 400 Å in thickness. A sputtering gas was a mixed gas of Ar:$N_2$ at 1:2, and the total pressure was 1 mTorr.

The resistance of the spacer in the film surface direction was R/□=$4\times10^9$ Ω/□) in sheet resistance, and the first and second cross point energies of the secondary electron emission coefficient on a smooth film formed at the same time under the above conditions were 30 eV and 5 keV, respectively.

In addition, as in the Embodiment 1, a low resistive film was formed in a region that formed a joint portion of the upper and lower substrate through the following method. A titanium film 10 nm in thickness and a Pt film 200 nm in thickness were formed on a band-like member 200 $\mu$m in parallel with the joint portion through a gas phase manner by sputtering. In this situation, the Ti film was required as an under layer that reinforced the film adhesion of the Pt film. Thus, a spacer 1020 with the low resistive film was obtained, and will be referred to as a spacer C. At this time, the thickness of the low resistive film was 210 nm, and the sheet resistance was 10 [Ω/□].

A cross-sectional view of the spacer C thus obtained formed the same surface as that in the Embodiment 1. A result of further observing the substrate configuration with the film by a section TEM in detail was one shown in FIG. 8, and the convex configuration of the uppermost surface in correspondence with the convex portion of the fine particles was recognized. Further, the fine particles were dispersed and included in the binder portion and at this time, the thickness of the binder portion was 600 Å, and the height of the convex portion was 1050 Å. Furthermore, it was recognized that a Cr—Al alloy nitride film formed through sputtering went around the convex portion and covers the side surface of the spacer.

Further, as in the Embodiment 1, a low resistive film was prepared through sputtering, and will be referred to as a spacer C. The incident angle multiplication coefficient $m_0$ of the secondary electron emission coefficient of the spacer C was 5.5 with respect to the incident electron energy of 1 kV.

In addition, as in the Embodiment 1, the electron beam emission device was prepared together with the rear plate assembled with the electron beam emission element, etc., and the application of a high voltage and the drive of the elements were conducted under the same condition as that in the Embodiment 1.

At this time, the withstand voltage was excellent in the vicinity of the spacer C. In addition, light emission spot trains including the light emission spots caused by the emitted electrons from the cold cathode element 1012 at positions close to the spacers C were formed at regular intervals two-dimensionally, thereby enabling display of a color image that was visible and excellent in color reproducibility. This exhibited that even if the spacer C was located, the turbulence of the electric field which adversely affected the electron orbit did not occur.

[Embodiments 4 and 5]

The glass substrate g0 employed in the Embodiment 2 was used as a spacer substrate, and a spacer having the concave and convex surface was manufactured in the same manner as that in the Embodiment 1. As in the Embodiment 1, first, prior to a film forming process, after the above spacer substrate g0 was cleaned by ultrasonic waves in pure water, IpA and acetone for 3 minutes, and then dried at 80° C. for 30 minutes, it was subjected to UV ozone cleaning to remove the organic remaining material on the substrate surface.

In addition, as the fine particle dispersion solution, tin oxide fine particles doped with antimony 50 to 100 Å in diameter of the particles and silica fine particles 100 Å in diameter of the particles were previously dispersed at a rate of 90%:10% in a silicon-metal alkoxide solution of 12.0 weight % containing the component of Ti:Si with the ratio of 1:4, and printing in the solution was conducted by using a solution extended plate of 5 μm in roughness. Thereafter, pre-baking was conducted at 100° C. for about 10 minutes, UV irradiation was also conducted, and a heat baking process was conducted at 270° C. for about 1 hour. The thickness of the high resistive film was set at 1400 Å. The spacer substrate with the roughened-surface film will be referred to as g1.

Thereafter, as in the Embodiment 1, a target of Cr and Al was further sputtered on the spacer substrate g1 at a high frequency power supply as another layer that constituted an antistatic film, to thereby form a high resistive film so that a Cr—Al alloy nitride film became 150 Å in thickness. A sputtering gas was a mixture gas of $Ar:N_2$ at 1:2, and a total pressure was 1 mTorr. The spacer substrate thus obtained will be referred to as g2.

In addition, as in the Embodiment 1, a low resistive film was formed on the spacer substrates g1 and g2 in a region that formed a joint portion of the upper and lower substrate through the following method. A titanium film 10 nm in thickness and a Pt film 200 nm in thickness were formed on a band-like member 200 μm in parallel with the joint portion through a gas phase manner by sputtering. In this situation, the Ti film was required as an under layer that reinforces the film adhesion of the Pt film. Thus, spacers 1020 with the low resistive film were obtained, which will be referred to as spacers D and E.

The incident angle multiplication coefficients $m_o$ of the secondary electron emission coefficient of the spacers D and E were 9.5 and 9.4, respectively, with respect to the incident electron energy of 1 kV.

The resistances of the spacers D and E in the film surface direction were $R/\square=8\times10^7$ Ω/□, respectively and the volume resistance in the film surface direction was $1.1\times10^3$ Ωcm by thickness conversion, and the volume resistance of the monitor substrate formed at the same time under the above condition in the thickwise direction was $1.3\times10^2$ Ωcm.

Figure 7:
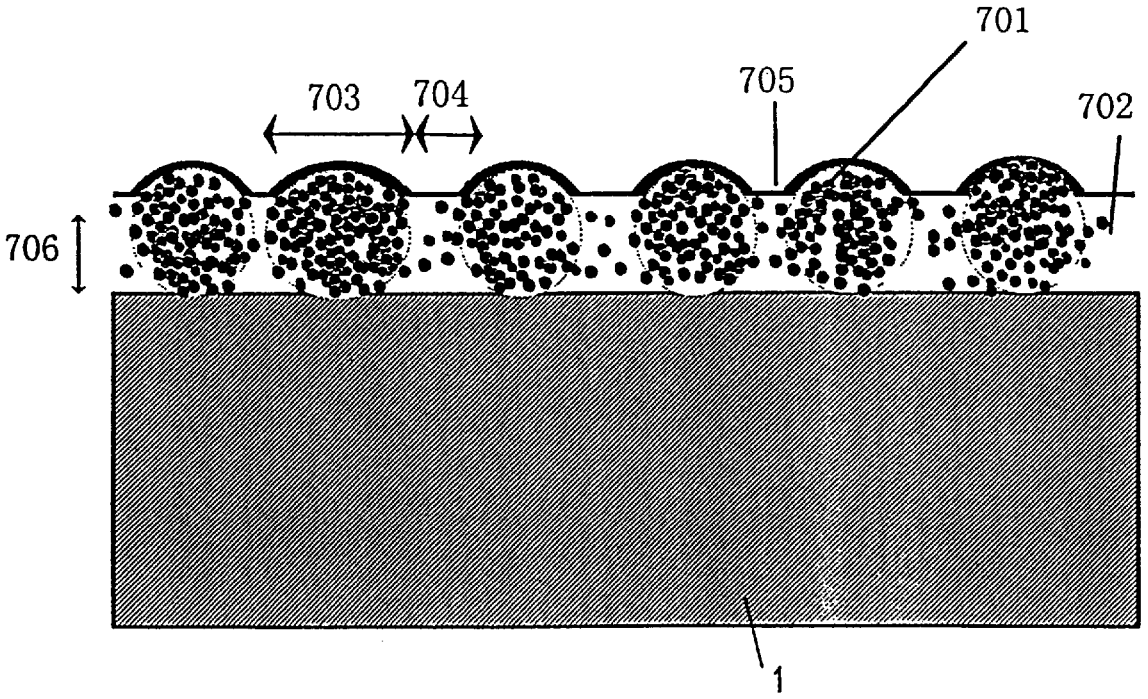
FIG. 7 is an explanatory diagram showing the surface structure of the spacer in accordance with another embodiment of the present invention.
Figure 9:
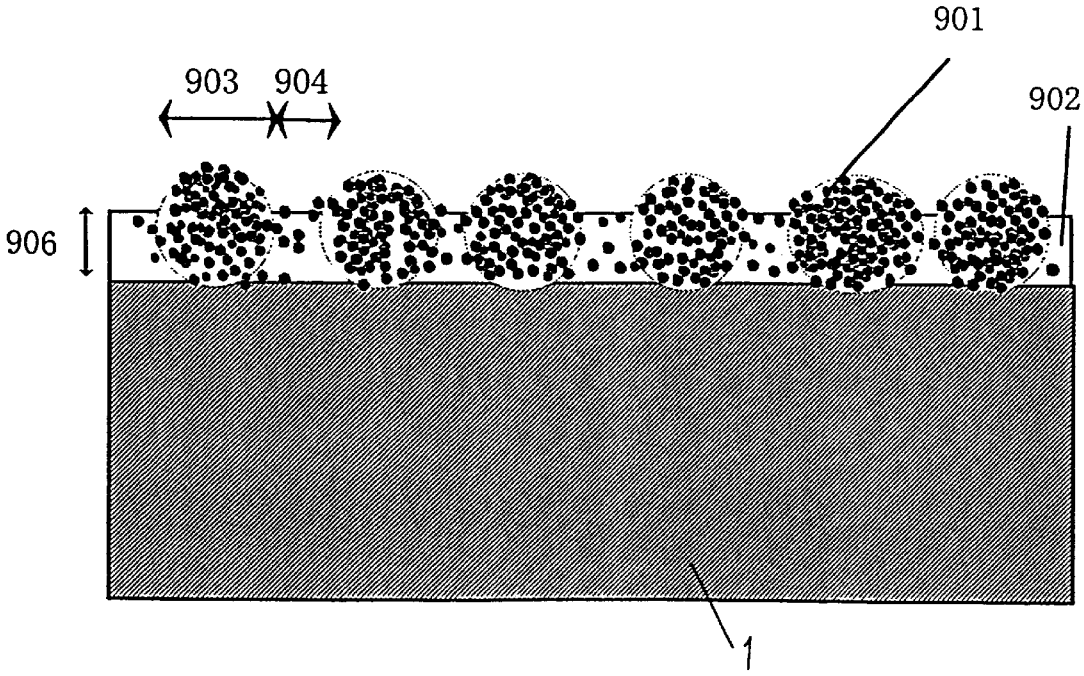
FIG. 9 is an explanatory diagram showing the surface structure of the spacer in accordance with yet still another embodiment of the present invention.

The results of observing the configurations of the obtained substrates with the film with respect to the spacer D and the spacer E with additional layer by a section TEM in detail were one shown in FIGS. 9 and 7, respectively, and the convex configuration of the uppermost surface in correspondence with the convex portion of the fine particles was recognized. In this case, the thicknesses of the regions 904 and 704 where the primary particle distributions were sparse were 1150 Å and 1300 Å, respectively, and the thicknesses of the regions 903 and 703 where the primary particle distributions were crowded were 1450 Å and 1600 Å, respectively.

In addition, as in Embodiment 1, the electron beam emission device was prepared together with the rear plate assembled with the electron beam emission element, etc., and the application of a high voltage and the drive of the elements were conducted under the same condition as that in Embodiment 1.

In this situation, the withstand voltages were excellent in the vicinity of the spacers D and E. In addition, light emission spot trains including the light emission spots caused by the emitted electrons from the cold cathode element 1012 at positions close to the spacers D and E were formed at regular intervals two-dimensionally, thereby being capable of displaying a color image visible and excellent in color reproducibility. This exhibits that even if the spacer D is located, the turbulence of the electric field which adversely affects the electron orbit does not occur.

The volume content of the fine particles contained in the spacers g1 in accordance with this embodiment was 30%.

The average diameter of fine particles (average particle diameter, diameter) contained in the layer with the fine particles in this embodiment was recognized in the following manner.

In the state where the spacer was located within the display device, a plane that was a portion which was in parallel with the applied accelerating electric field direction and located within a display region as a spacer side surface and which was in parallel with the perpendicular of the spacer side surface (in many cases, a surface of the maximum area) was cut off as a cut surface. The above cutting was conducted twice with parallel surfaces as cut surfaces, to thereby cut off a thin piece including the spacer surface. The thickness of the cut-out thin piece (an interval between the parallel cut surfaces) might be set to any values if a two-dimensional image could be recorded, but it is better that the spacer is cut off with the thickness as 100 times as large as the diameter of the particles, or with the thickness 10 times as large as the film thickness so as to prevent an influence of deviating the particles in the thickwise direction of the sliced piece in calculation of the particle content.

Subsequently, by using a scanning type transmission electron microscope with an electric field emission type electron gun, the cutting plane of the spacer surface was observed with a magnification ×50,000, and was photographically recorded in the two-dimensional image. The diameter of the particles projected in the photographic image was found. The determination of the diameter of the particles, the particle sectional area, and so on could be conducted by extracting the features of the contour information, etc., from the two-dimensional image, but the determination was made by the following method in the present invention. That is, (1) A portion where the fine particles existed and a portion where the fine particles did not exist according to the present invention were determined on the basis of the density of the fine particle image, and the total of the sectional area of the fine particles within the evaluation area, that is, the total sectional area was found. As a threshold value for distinguishing the portion where the fine particles existed from the portion where the fine particles did not exist according to the present invention, an intermediate value between the density of the center of the fine particle image and the density of the portion where the fine particles did not exist in the two-dimensional image was adopted.

(2) This was divided by the number of fine particles within the evaluation area to obtain the average sectional area per one fine particle.

(3) Then, assuming that a circle was the fine particle model of the projected image, the average particle diameter $\phi$ of the fine particles was obtained from $S=\pi\phi^2/4$.

Also, in the samples of Embodiments 1, 2 and 3 where the diameters of the particles were relatively large, the cutting direction of the samples were made identical, and one portion of the cross-section could be readily observed by using a scanning type reflection electron microscope instead of the above-mentioned scanning type transmission electron microscope.

Also, the volume content of the fine particles contained in the layer with the fine particles according to this embodiment was found as follows:

As in the above-mentioned size measurement of the fine particles contained in the layer, the density (unit $m^{-2}$) of the fine particles projected in the cross-section in the unit area was obtained, and then divided by the evaluated depth to obtain the density (unit $m^{-3}$) of the fine particles in the unit volume. Further, the average particle volume was obtained from the above-mentioned average diameter of the particles with spheres as model configurations and then multiplied by the above-mentioned density in the volume to obtain the volume content (unit 1).

In this case, although there is the possibility that the actual value may includes an error in the lower valves due to a shadow of the fine particle group, the minimum estimate value of the content of particles can be identified.

Also, if the specific gravity of the fine particles of the solid portion and the specific gravity of the binders are known as the raw material, the volume content of the fine particles can be estimated from the weight mixture ratio of the raw material, and also a method of chemically separating the components and conducting the determination can be combined with the above manner. For example, if that the main component of the binder raw material among the solid portion is silica (silicon dioxide) is known, it is possible that the silica component is dissolved in hydrofluoric acid aqueous solution and the weight of the remaining particles in the solution is weighed.

Also, the film thickness of the spacer according to the present invention was obtained by a distance between the boundaries of the upper and lower structures of the fine-particle contained layer from the above-mentioned cutting plane observation image of the electron microscope. As another method, a trace type step meter may be used.

Further, it is preferable that the fine particles in the spacer film according to the second embodiment mode have the sparse and crowded distribution of the fine particle density in the film surface direction due to the aggregating effect. The sparse and crowded distribution is readily recognized by the above-mentioned electron microscope image of the cross section of the surface of the spacer, and it is judged that in a region at least about 0.1 times of the film thickness in the film surface direction among the sectional image, a region in which the particle density is about 0.3 times or less of the average particle density is a sparse particle density region.

When the spacers A, B, C, D and E formed in the above-described embodiments are compared with each other in surface configuration, the incident angle dependency of the secondary electron emission coefficient, the displacement of a light emission point and the applied withstand voltage of the anode, all of them are excellent in electric contact, the displacement of the light emission point and the withstand voltage as their panel characteristics, and a spacer with the antistatic film proper for the vacuum resistant spacer in the electron beam apparatus can be formed. The electric contact is directed to a contact between the antistatic film and the substrate wiring as well as the face plate wiring through the low resistive film. The incident angle multiplication coefficients $m_o$ of the secondary electron emission coefficient was suppressed to 10 or less, and the charge of the obliquely incident electrons which was made incident to the spacer was suppressed. In addition, because the multiplex emission phenomenon of the secondary electrons was also suppressed, a spacer high in the stability of the beam and the discharge suppression capacity was obtained.

Also, the deviation of the distribution of the fine particles in the layer containing the fine particles or the distribution of the secondary particles formed by aggregating the fine particles was excellently suppressed, and the electric characteristics such as the resistance was stabilized. Also, an influence of heat could be suppressed.

In addition, in the above-described respective embodiments, since the layer containing the fine particles was used as the roughened-surface layer, various effects could be obtained by the following actions.

A first action is an action that reduces the amount of charges of the incident electrons in the high incident angle mode which occupies most of the charge amount. The incident angle multiplication coefficient $m_0$ of the secondary electron emission coefficient defined in the above general expression (1) is reduced by the action of roughening the surface due to the fine particles, and can be suppressed to the level of about ⅓ or less as compared with the uniform film of normal inorganic oxide or nitride. This effect is particularly effective to the direct incident electrons from the closest electron emission element having the high incident angle of 80° or more.

Also, a second action is that a region occupied by the binders produced by gaps between the fine particles in the film serves as an accumulated body of fine Faraday cups to obtain the action of enclosing the secondary electrons, thereby obtaining the effect of suppressing the absolute value of $\delta$.

In addition, a third action is the action of suppressing the multiplex emission secondary electrons. The emitted secondary electrons receive an energy from the accelerating electric field and take orbit in the anode direction while accelerating. However, since the energy immediately after emission is relatively small, the secondary electrons are pulled into the local charge region and reenter the spacer. At this point, the positive charges of $(\delta-1)$ times are produced. In this state, as compared with normal inorganic oxide, nitride, etc., the probability that the reentrance takes place is conducted between the convex portions of the film increases, and there can be provided the effect that the electrons are again made incident to suppress the storage of the positive charges under the conditions where $\delta-1 \leqq 0$ or $\delta-1>0$ but the absolute value $|\delta-1|$ is not very large.

A fourth action is the incident angle suppression action with respect to the anode radiation electrons. The flying paths of the incident electrons to the spacers are variously distributed, and particularly in the re-incidence of the reflected electrons from the face plate (hereinafter referred to as "FP radiation electrons"), because the emission direction has a substantially concentric distribution, the reflected electrons are distributed in multiple directions in the surroundings.

In this situation, in the distribution of the orbit of the FP radiation electrons when viewed from the high voltage applying direction, as a result of studying the spacer of the spacer charge for each element, a distance between the emission elements, and the anode applied voltage dependency by the present inventors, it has been found that the radiation electrons from the anode substrate (the metal back or the anode electrode provided in the face plate) are emission electrons from the electron elements of not only the closest (first closest) but also the second, third and fourth closest.

The above phenomenon means that in the case where the distance between the light emission point and the spacer is short among the FP reflection, the incident angle at the time of re-incidence of the electrons to the incident point far on the spacer is doubled. For that reason, as the secondary electron emission suppressing effect of the oblique mode on the reflected electrons, the network structure in the interior of the film substantially uniformly formed at random effectively functions in the total incident direction.

As has been described above, according to this embodiment, a spacer which suppresses not only the effect of relaxing the incident angle and the effect of suppressing the cumulative incidence/emission of the secondary electrons make it possible to provide the charge caused by the direct incident electrons due to the closest electron source, but also the charge caused by the reflected electrons from the face plate and the cumulative generation of the emission electrons which are multiplex-emitted onto the edge surface of the spacer by the anode applied voltage.

With the above effects, there can be manufactured an electron beam type image display device with the excellent display quality and the long-term reliability which suppresses the displacement of the light emission point due to the charge and the creeping discharge.

In addition, because it is easy to control the resistance, and the film manufacturing process can be realized by the coating process and the heat drying process, the spacer according to this embodiment is superior in the material use efficiency as well as the simpleness of the film forming process and costlessness to the antistatic film produced through the film forming process by another sputtering film forming device.

The above description has been given of the embodiment in which the layer containing the fine particles is used also as the roughened-surface layer. However, the application range of the present invention is not limited to the description of the embodiments above. Even if the layer containing the fine particles does not satisfy the conditions of the above-mentioned first and second modes for suitably roughening the surface, if the requirements of the present invention are satisfied, the electric characteristics can be stabilized, and the preferred electron beam apparatus or image forming apparatus can be realized.

Also, the scope of the present invention is not limited to the structure in which the layer containing the fine particles is disposed on the spacer, but the layer of the present invention can be preferably employed as a film provided at a location within the electron beam apparatus where the layer stabilized in the electric characteristic is intended to be provided. In particular, it is preferable that the layer is used as the antistatic film that suppresses the charge or suppresses an influence of the charge.

Also, in the present invention, it is preferable that the requirements regulated by the present invention are satisfied in a region broader than 100 times×100 times of the average particle diameter of the fine particles.

Industrial Applicability

The present invention can be employed in the field of an electron beam apparatus such as an image forming apparatus.

What is claimed is:

1. An electron beam apparatus, comprising:

a hermetic container;

an electron source disposed within said hermetic container; and a spacer, wherein said spacer includes at least a region where a layer including fine particles exists, a sheet resistance measured at the surface of said region of said spacer is $10^7$ Ω/□ or more, and said fine particles are sized to 1000 Å or less in the average diameter of the particles and includes at least metal elements, and wherein the volume percentage of the fine particles in said layer including fine particles is 30% or more.

2. The electron beam apparatus according to claim 1, wherein said layer including fine particles is disposed on a base substance that constitutes said spacer.

3. An electron beam apparatus, comprising:

a hermetic container;

an electron source disposed within said hermetic container; and a spacer, wherein said spacer includes at least a region where a layer including fine particles exists, a sheet resistance measured at the surface of said region of said spacer is $10^7$ Ω/□ or more, and said fine particles are sized to 1000 Å or less in the average diameter of the particles and includes at least metal elements, and wherein said layer including fine particles includes said fine particles and the binders.

4. The electron beam apparatus according to claim 3, wherein said layer including fine particles is disposed on a base substance that constitutes said spacer.

5. An electron beam apparatus, comprising:

a hermetic container;

an electron source disposed within said hermetic container; and a spacer, wherein said spacer includes at least a region where a layer including fine particles exists, a sheet resistance measured at the surface of said region of said spacer is $10^7$ Ω/□ or more, and said fine particles are sized to 1000 Å or less in the average diameter of the particles and includes at least metal elements, and wherein the average diameter of the particles of said fine particles is set to 0.1 times or less of the thickness of said layer including fine particles.

6. The electron beam apparatus according to claim 5, wherein said layer including fine particles is disposed on a base substance that constitutes said spacer.

7. An electron beam apparatus, comprising:

a hermetic container;

an electron source disposed within said hermetic container; and a spacer, wherein said spacer includes at least a region where a layer including fine particles exists, a sheet resistance measured at the surface of said region of said spacer is $10^7$ Ω/□ or more, and said fine particles are sized to 1000 Å or less in the average diameter of the particles and includes at least metal elements, wherein said fine particles contain elements of group IIIB or group VB.

8. The electron beam apparatus according to claim 7, wherein said layer including fine particles is disposed on a base substance that constitutes said spacer.

9. An electron beam apparatus, comprising:

a hermetic container;

an electron source disposed within said hermetic container; and a spacer, wherein said spacer includes at least a region where a layer including fine particles exists, a sheet resistance measured at the surface of said region of said spacer is $10^7$ Ω/□ or more, and said fine particles are sized to 1000 Å or less in the average diameter of the particles and includes at least metal elements, wherein said fine particles contain Sb or P.

10. The electron beam apparatus according to claim 9, wherein said layer including fine particles is disposed on a base substance that constitutes said spacer.

* * * * *

UNITED STATES PATENT AND TRADEMARK OFFICE

CERTIFICATE OF CORRECTION

PATENT NO. : 6,600,263 B1
DATED : July 29, 2003
INVENTOR(S) : Nobuhiro Ito

It is certified that error appears in the above-identified patent and that said Letters Patent is hereby corrected as shown below:

Column 3,
Line 27, “self light” should read -- self-light --.

Column 7,
Line 46, “partially” should read -- partial --.

Column 18,
Line 31, “above described” should read -- above-described --.

Column 21,
Line 49, “advantageous” should read -- advantages --.

Column 31,
Line 32, “1113” should read -- 1113 is --.

Column 34,
Line 61, “such” should read -- such as --.

Column 44,
Line 19, “under layer” should read -- underlayer --.

Column 45,
Line 30, “under layer” should read -- underlayer --.

Column 47,
Line 12, “includes” should read -- include --.

UNITED STATES PATENT AND TRADEMARK OFFICE

CERTIFICATE OF CORRECTION

PATENT NO. : 6,600,263 B1
DATED : July 29, 2003
INVENTOR(S) : Nobuhiro Ito

It is certified that error appears in the above-identified patent and that said Letters Patent is hereby corrected as shown below:

Column 49,
Line 19, “simpleness” should read -- simplicity --.

Signed and Sealed this

Thirteenth Day of January, 2004

JON W. DUDAS
*Acting Director of the United States Patent and Trademark Office*